US006053595A

United States Patent [19]

Otsuka et al.

[11] Patent Number: 6,053,595

[45] **Date of Patent: *Apr. 25, 2000**

[54] MULTI RECORDING SYSTEM USING MONOCHROME PRINTER

[75] Inventors: Naoji Otsuka; Atsushi Arai, both of Kawasaki; Kentaro Yano, Yokohama; Yuji Akiyama, Yokohama; Kiichiro Takahashi, Yokohama; Hitoshi Nishikori, Yokohama; Osamu Iwasaki, Tokyo, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.:

08/575,582

[22] Filed: Dec. 20, 1995

Related U.S. Application Data

[63] Continuation of application No. 08/028,940, Mar. 8, 1993, abandoned.

[30] Foreign Application Priority Data

| | | | |
|---|---|---|---|
| Mar. 9, 1992 | [JP] | Japan | 4-050637 |
| Mar. 27, 1992 | [JP] | Japan | 4-071273 |
| Mar. 27, 1992 | [JP] | Japan | 4-071274 |
| Mar. 27, 1992 | [JP] | Japan | 4-071278 |
| Mar. 27, 1992 | [JP] | Japan | 4-071279 |
| Mar. 27, 1992 | [JP] | Japan | 4-071280 |
| May 20, 1992 | [JP] | Japan | 4-127049 |
| Jul. 10, 1992 | [JP] | Japan | 4-183995 |
| Jul. 10, 1992 | [JP] | Japan | 4-183996 |

[51] Int. Cl.[7] ..... B41J 29/38

[52] U.S. Cl. ..... 347/9

[58] Field of Search ..... 347/9, 12, 13, 347/15, 43, 105, 3, 5, 180, 181, 182, 172; 355/326 R

[56] References Cited

U.S. PATENT DOCUMENTS 1,957,646 5/1934 Hilton ..... 347/43

(List continued on next page.)

FOREIGN PATENT DOCUMENTS 282283 9/1988 European Pat. Off. .
0315417 5/1989 European Pat. Off. .

(List continued on next page.)

*Primary Examiner*—N. Le
*Assistant Examiner*—Judy Nguyen
*Attorney, Agent, or Firm*—Fitzpatrick, Cella, Harper & Scinto

[57] ABSTRACT

An ink jet color recording method forms a multi-color image on a single recording medium using a monochrome recording apparatus, which includes a mounting portion for detachably mounting an ink recording head for recording by ejecting a monochrome ink, a feed unit for feeding the recording medium, and a discharge unit for discharging the recording medium. First recording information is supplied to a first ink recording head, attached to the mounting portion, for ejecting a first ink, recording is performed using the first ink on the recording medium fed to the recording region by the feed unit, and the recording medium is discharged by the discharge unit. Next, second recording information is supplied to a second ink recording head, attached to the mounting portion in place of the first ink recording head, for ejecting a second ink, the recording medium, on which recording using the first ink has been completed, is fed to the recording region, recording is performed using the second ink, and the recording medium is discharged by the discharge unit. Subsequently, third recording information is supplied to a third ink recording head, attached to the mounting portion in place of the second ink recording head, for ejecting a third ink, the recording medium, on which recording using the first and second inks has been completed, is fed to the recording region by the feed unit, recording is performed using the third ink, and the recording medium is discharged by the discharge unit.

49 Claims, 56 Drawing Sheets

U.S. PATENT DOCUMENTS

| | | | |
|---|---|---|---|
| 4,313,124 | 1/1982 | Hara | 347/57 |
| 4,329,698 | 5/1982 | Smith | 347/87 |
| 4,345,262 | 8/1982 | Shirato et al. | 347/10 |
| 4,401,024 | 8/1983 | Frentress | 347/102 X |
| 4,459,600 | 7/1984 | Sato et al. | 347/47 |
| 4,463,359 | 7/1984 | Ayata et al. | 347/56 |
| 4,515,487 | 5/1985 | Minami | 395/109 |
| 4,528,576 | 7/1985 | Koumura et al. | 347/43 |
| 4,533,928 | 8/1985 | Sugiura et al. | 347/3 |
| 4,558,333 | 12/1985 | Sugitani et al. | 347/65 |
| 4,631,548 | 12/1986 | Milbrandt | 347/43 |
| 4,709,244 | 11/1987 | Piatt et al. | 347/19 |
| 4,723,129 | 2/1988 | Endo et al. | 347/56 |
| 4,740,796 | 4/1988 | Endo et al. | 347/56 |
| 4,783,681 | 11/1988 | Tanaka et al. | 347/3 |
| 4,815,869 | 3/1989 | Van Dyck | 400/83 |
| 4,967,203 | 10/1990 | Doan et al. | 347/13 |
| 5,103,244 | 4/1992 | Gast et al. | 347/33 |
| 5,477,246 | 12/1995 | Hirabayashi et al. | 347/12 |
| 5,594,478 | 1/1997 | Matsubara et al. | 347/12 |

FOREIGN PATENT DOCUMENTS

| | | | |
|---|---|---|---|
| 0380199 | 8/1990 | European Pat. Off. . | |
| 0391570 | 10/1990 | European Pat. Off. . | |
| 0418817 | 3/1991 | European Pat. Off. . | |
| 57-049570 | 3/1982 | Japan . | |
| 59-123670 | 7/1984 | Japan . | |
| 59-138461 | 8/1984 | Japan . | |
| 60-228158 | 11/1985 | Japan . | |
| 63-8657 | 1/1988 | Japan | 355/326 R |
| 3-146351 | 6/1991 | Japan | 347/43 |

| FIG. 20A |
| --- |
| FIG. 20B |

| |
|---|
| FIG. 64A |
| FIG. 64B |

MULTI RECORDING SYSTEM USING MONOCHROME PRINTER

This application is a continuation of application Ser. No. 08/028,940 filed Mar. 8, 1993, now abandoned.

BACKGROUND OF THE INVENTION

1. Field of the Invention

The present invention relates to an ink jet color recording method utilizing a monochrome ink jet recording technique and to an epoch-making invention, which allows to use a monochrome ink jet recording apparatus as a color recording apparatus. The present invention can be applied to an apparatus for recording an ink of a coloring liquid (to be simply referred to as an ink hereinafter) onto a recording medium such as a paper sheet, a cloth, a transparency (OHP) film, and the like.

2. Related Prior Art

As a color image formation method, a method of performing recording by attaching a liquid ink onto a recording medium has been known before an electrophotographic color recording method, but is applied to a small number of products. On the market, therefore, electrophotographic color recording apparatuses are popular. In general, a recording apparatus, which receives a recording medium, and discharges a recording medium on which a color image in a plurality of colors is formed, is known as a color recording apparatus.

As an ink jet recording apparatus, in past years, a monochrome ink jet recording apparatus capable of performing monochrome recording, and a color ink jet recording apparatus for performing color recording are available. The former apparatus is inexpensive, while the latter apparatus is expensive and large in size. In particular, although the color ink jet recording apparatus can satisfactorily perform recording on a specific recording medium (special-purpose coating paper), it often causes relative deterioration of image quality on various recording media such as normal high-quality paper, or a transparency (OHP) film.

On the other hand, a user who uses the monochrome ink jet recording apparatus sometimes wants to perform color recording although the frequency of such occasions is low. As a result, demand has arisen for a compact, inexpensive color ink jet recording apparatus, which can be easily used by a user.

In a conventional color ink jet recording apparatus, when recording dots are modulated so as to achieve recording with high image quality, the arrangement of the apparatus becomes complicated and bulky, resulting in an expensive apparatus in order to obtain a practical recording speed. For this reason, most of commercially available color ink jet recording apparatuses perform pseudo gradation processing for achieving gradation expression using a plurality of pixels. Thus, deterioration of image quality is observed relative to an electrophotographic color recording apparatus, and the like, which can achieve multi-gradation expression using only one pixel.

SUMMARY OF THE INVENTION

It is an object of the present invention to provide an ink jet recording method, which can solve problems inherent to ink jet recording (e.g., blurring of an ink, expansion/contraction of a recording medium, and the like), and can form a monochrome gray-scale image or a good color image in at least two colors using a monochrome ink jet recording apparatus.

It is another object of the present invention to provide an ink jet recording method, which can stably perform recording with high image quality even when a plurality of ink recording heads are used.

It is still another object of the present invention to provide an ink jet recording method with high image quality, which can achieve gradation expression or color expression by only one pixel using a monochrome ink jet recording apparatus.

It is still another object of the present invention to provide an ink jet recording method, which can perform proper recording according to the type of mounted recording head, or the type of supplied recording data.

It is still another object of the present invention to provide an ink jet recording apparatus, which can eliminate a recording position error in units of processes even in an ink jet recording apparatus which performs paper feed/discharge processes a plurality of number of times, and exchanges a recording head cartridge with another a plurality of number of times, and can form a high-quality image using a plurality of inks without impairing compact, inexpensive, and easy-to-use merits of the apparatus itself.

It is still another object of the present invention to provide an ink jet recording method, which can record a high-quality image even when states and conditions are different.

In order to achieve the above objects, according to the present invention, there is provided an ink jet color recording method for forming a multi-color image on a single recording medium using a monochrome ink jet recording apparatus, which comprises a mounting portion for detachably mounting ink recording means for performing recording on the recording medium by ejecting a monochrome ink, feed means for feeding the recording medium to a recording region of the ink recording means, and discharge means for discharging the recording medium passing the recording region, comprising:

the first step of supplying first recording information to first ink recording means, attached to the mounting portion, for ejecting a first ink, performing recording using the first ink on the recording medium fed to the recording region by the feed means, and discharging the recording medium by the discharge means;

the second step of supplying second recording information to second ink recording means, attached to the mounting portion in place of the first ink recording means, for ejecting a second ink of a color different from the first ink, feeding the recording medium, on which recording using the first ink has been completed, to the recording region by the feed means, performing recording using the second ink, and discharging the recording medium by the discharge means; and the third step of supplying third recording information to third ink recording means, attached to the mounting portion in place of the second ink recording means, for ejecting a third ink of a color different from the first and second inks, feeding the recording medium, on which recording using the first and second inks has been completed, to the recording region by the feed means, performing recording using the third ink, and discharging the recording medium by the discharge means.

Also, according to the present invention, when an ink jet recording apparatus uses a plurality of ink recording heads, a mode for performing recording on a single recording medium a plurality of number of times is detected or recognized, and a multiple ink recording head mode can be executed by setting a recovery condition and sequence automatically or manually, so that stable recording is assured even when the plurality of ink recording heads are used.

Furthermore, according to the present invention, a plurality of recording processes are executed in the order from a color corresponding to the highest dot density of recording color information, or from an ink color having the highest brightness.

Moreover, according to the present invention, an apparatus comprises a means for discriminating the types of various recording data or various recording heads.

In addition, according to the present invention, an apparatus comprises a recording position error detection means for detecting a recording position error in units of recording processes, and a recording position error correction means for correcting the recording position error in units of recording processes.

DESCRIPTION OF THE PREFERRED EMBODIMENTS

The present invention has been made while paying attention to the merits unique to ink jet recording by renouncing a common sense that a monochrome ink jet recording apparatus has no margin for additionally mounting a plurality of recording heads, and cannot consequently perform color recording using a plurality of colors.

More specifically, in a conventional color ink jet recording apparatus, how to form a high-quality color image has been studied by causing inks of a plurality of colors to be attached to a recording area of a recording medium within a short period of time, thereby preventing an ink overflow and blurring of inks at the boundaries of different colors. In the current state, if an image formation condition falls outside a specific condition, a satisfactory image cannot be obtained. That is, when the inks of the plurality of colors are attached, excessive color mixing occurs due to not only the inks but also expansion/contraction of a recording medium and an ink overflow.

On the other hand, when a recording medium is discharged outside the apparatus after monochrome recording like in a monochrome ink jet recording apparatus, the fixing characteristics of an image are relatively stable. It is found that when the recorded recording medium is fed from a feeder again, the previously recorded image is completely fixed when the recording medium reaches a recording area for sequential recording, and the state of the recording medium is also recovered to a state before the previous ink recording. Furthermore, when an ink in a different color is recorded on the previously recorded image under this condition, since the recording position of the previous image corresponds to a position, where the previous image is to be recorded, of the recording medium before recording. For this reason, an image formed by a plurality of ink colors has high image quality and good color development characteristics.

The same applies to a case wherein the above-mentioned processes are executed using three or four different color inks.

The preferred embodiments of the present invention will be described in detail below with reference to the accompanying drawings.

FIGS. 1 to 9 are explanatory views for explaining each of and the relationships among an ink jet unit IJU, an ink jet head IJH, an ink tank IT, an ink jet cartridge IJC, an ink jet recording apparatus main body IJRA, and a carriage HC, to which the present invention is suitably applied.

(i) Description of Outline of Apparatus Main Body

Figure 1:
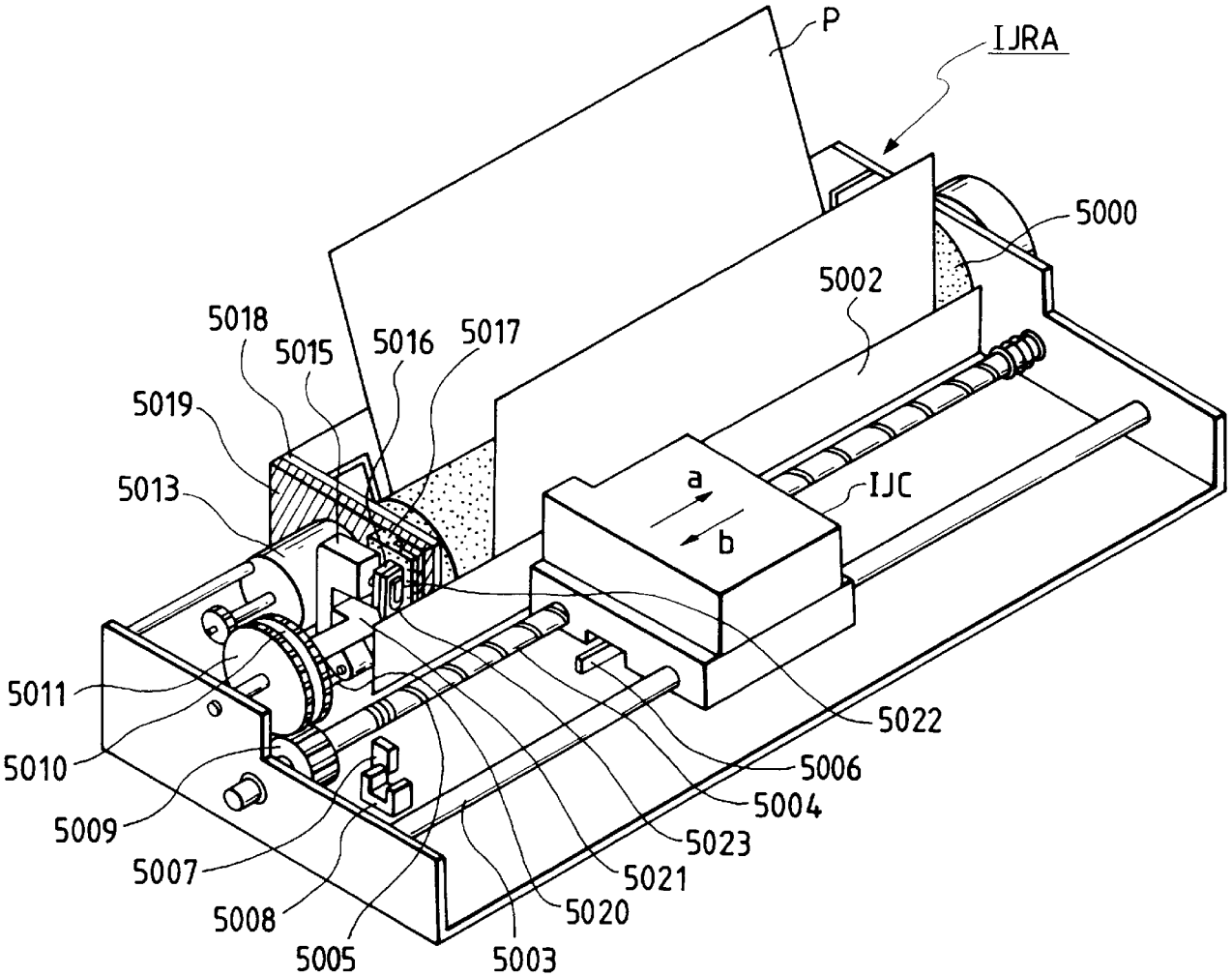
FIG. 1 is a perspective view showing an ink jet recording apparatus main body to which the present invention is applied.

FIG. 1 is a schematic view showing an arrangement of the ink jet recording apparatus IJRA to which the present invention is applied. In FIG. 1, the carriage HC is engaged with a spiral groove 5005 of a lead screw 5004, which is rotated via driving force transmission gears 5011 and 5009 in cooperation with a forward/reverse rotation of a driving motor 5013. The carriage HC has a pin (not shown), and is reciprocally moved in the directions of arrows a and b. The carriage HC carries the ink jet cartridge IJC. A paper pressing plate 5002 presses a paper sheet against a platen 5000 across the carriage moving direction. Photocouplers 5007 and 5008 constitute a home position detection means for detecting the presence of a lever 5006 of the carriage in a corresponding area, and performing, e.g., switching of the rotational direction of the motor 5013. A member 5016 supports a cap member 5022 for capping the front surface of a recording head, and a suction means 5015 draws the interior of the cap member by suction so as to perform a suction recovery operation of the recording head via an intra-cap opening 5023. A cleaning blade 5017 is supported by a member 5019 to be movable in the back-and-forth direction. These members are supported on a main body support plate 5018. The present invention is not limited to the illustrated shape of the blade. For example, a known cleaning blade can be applied to the present invention, as a matter of course.

Figure 2:
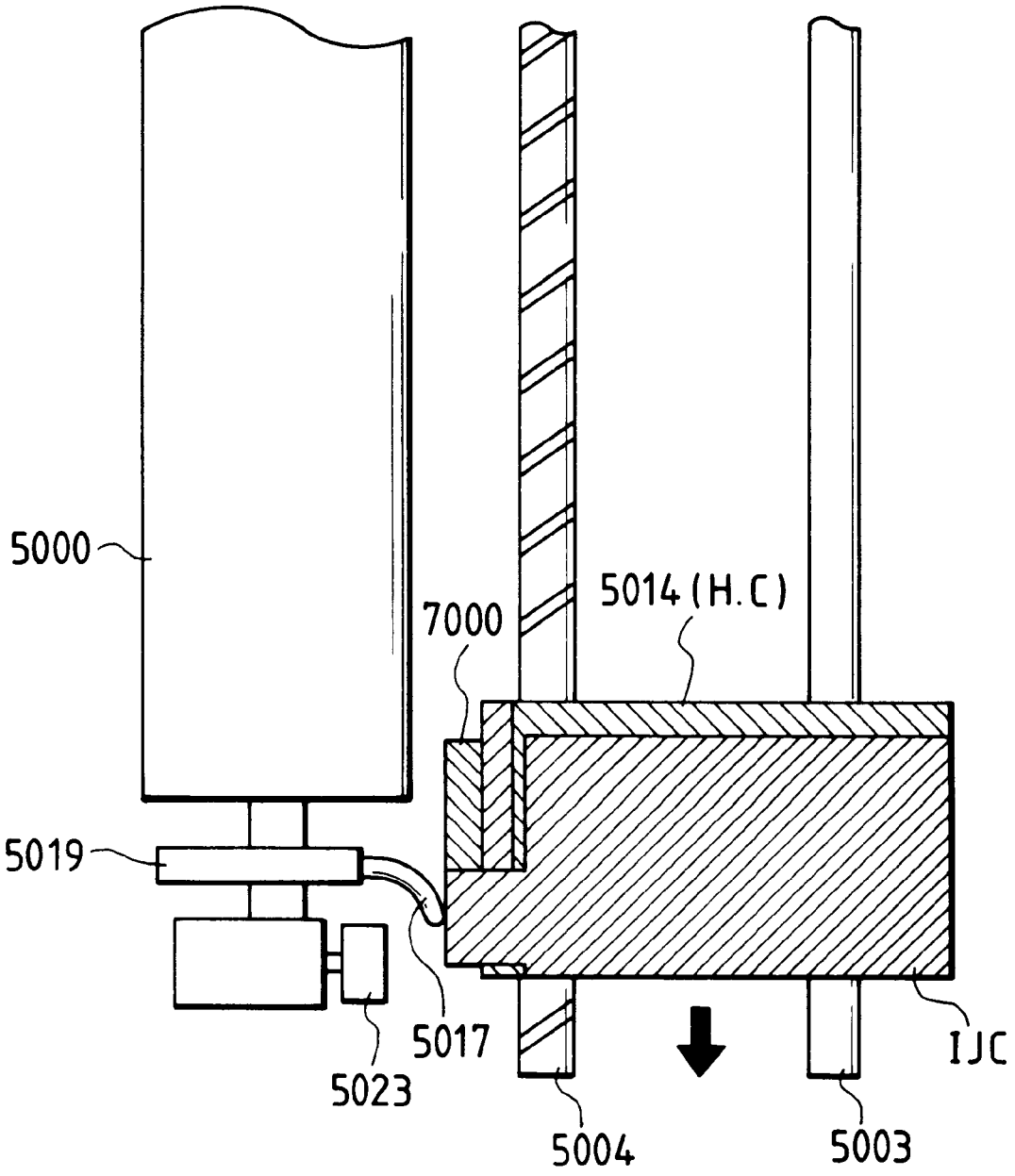
FIG. 2 is a schematic view showing an arrangement of a cleaning unit of the recording apparatus main body used in the present invention.

FIG. 2 shows an arrangement of a cleaner for cleaning the cleaning blade 5017. The cleaner has a function of preventing re-attachment of ink droplets to the ink jet head IJH by absorbing or scraping off large ink droplets attached to the cleaning blade 5017. More specifically, as shown in FIG. 2, ink droplets attached onto the cleaning blade 5017 are absorbed by an ink absorbing member 7000 arranged on a carriage 5014. This absorbing member is arranged on the carriage in FIG. 2. However, the absorbing member may be fixed on the ink jet cartridge IJC, and may be disposed together with the IJC.

A lever 5021 is used for starting suction in the suction recovery operation, and is moved upon movement of a cam 5020 engaged with the carriage. In this case, the driving force from the driving motor is controlled by a known transmission means (e.g., clutch switching means).

These capping, cleaning, and suction recovery means are arranged so that desired processing operations can be executed at corresponding positions upon operation of the lead screw 5005 when the carriage reaches an area at the home position side. However, the present invention is not limited to this as long as desired operations are performed at known timings.

Figure 3:
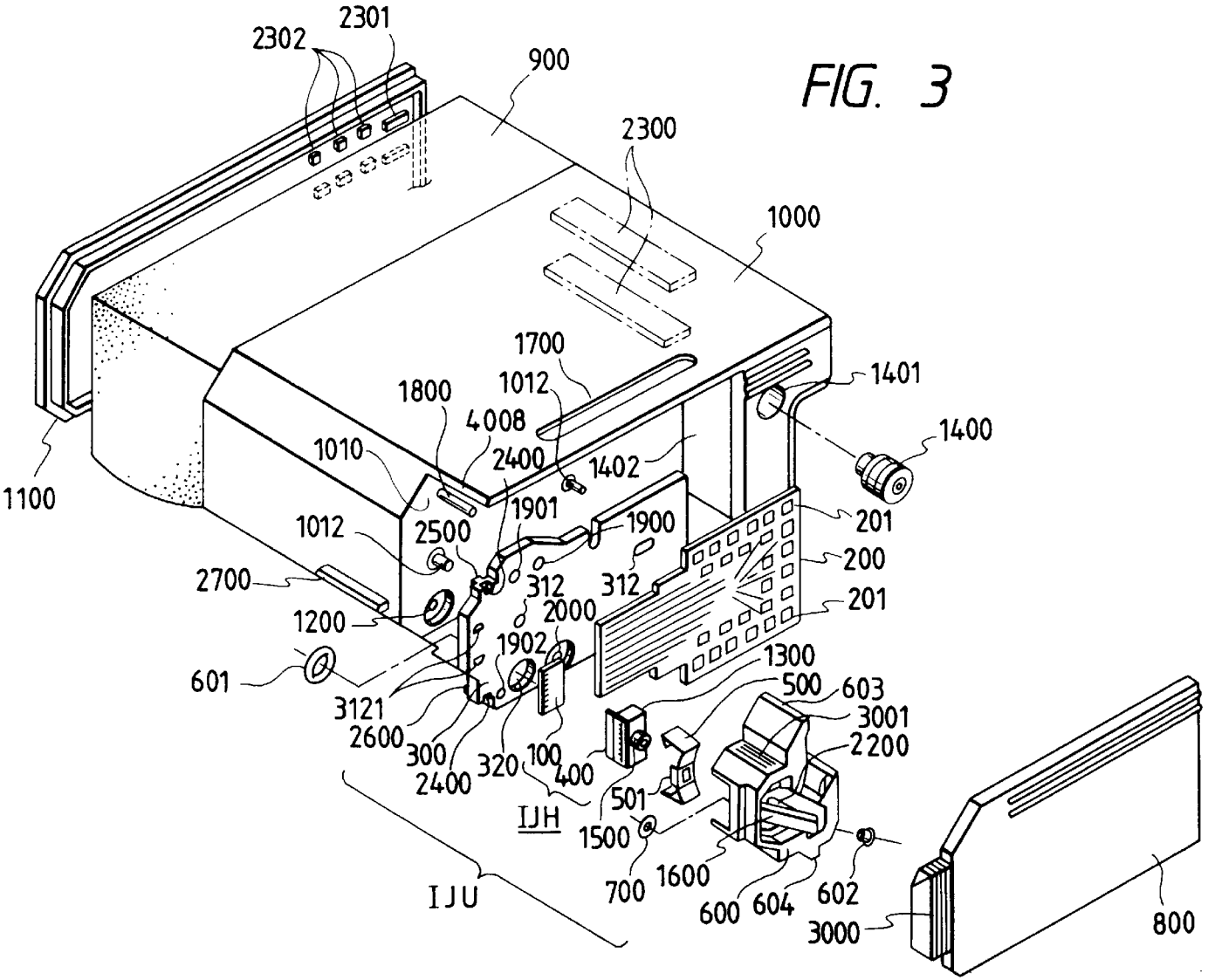
FIGS. 3 to 6 are views for explaining an ink jet cartridge.
Figure 4:
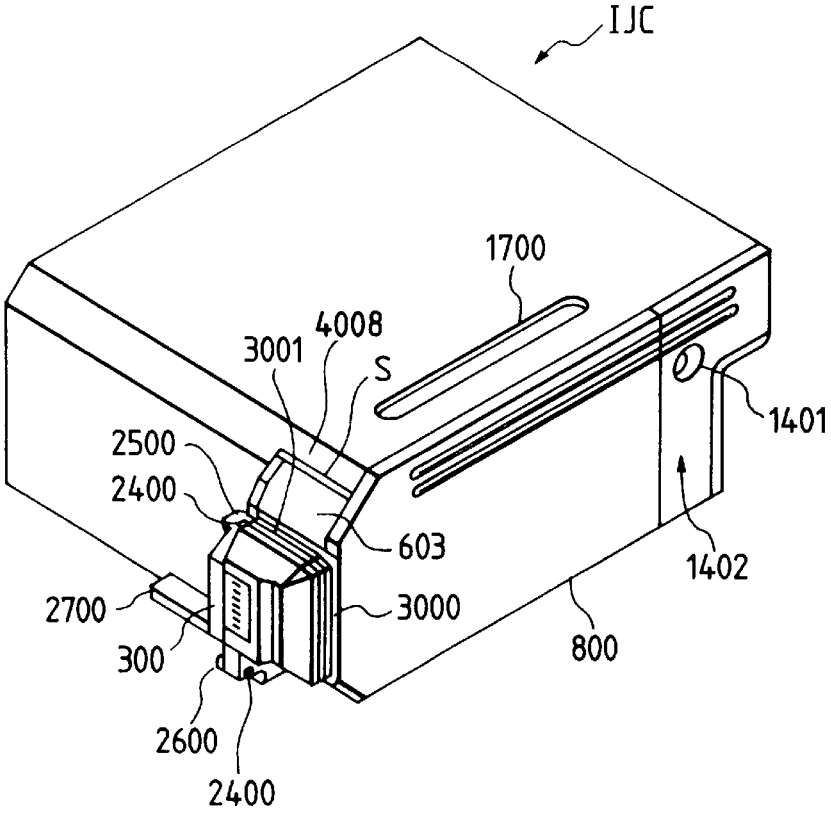

As can be seen from the perspective view of FIG. 3, the ink jet cartridge IJC of the present invention has an increased ink storage space factor, and the distal end portion of the ink jet unit IJU slightly projects from the front surface of the ink tank IT. This ink jet cartridge IJC is fixed and supported by a positioning means and electrical contacts (to be described later) of the carriage HC (FIG. 1) mounted on the ink jet recording apparatus main body IJRA, and is detachable from the carriage HC.

(ii) Description of Arrangement of Ink Jet Unit IJU

The ink jet unit IJU is a unit of a type for performing recording using electro-thermal conversion elements for generating heat energy, which causes film boiling in an ink, according to an electrical signal.

In FIG. 3, a heater board 100 is constituted by forming a plurality of arrays of electro-thermal conversion elements (ejection heaters), and, e.g., an Al electrical wiring pattern for supplying an electrical power to these heaters on an Si substrate by a film formation technique. A wiring board 200 for the heater board 100 has a wiring pattern corresponding to the wiring pattern on the heater board 100 (connected by, e.g., wire-bonding), and pads 201, located at the end portions of the wiring pattern, for receiving electrical signals from the main body apparatus.

A grooved top plate 1300 is provided with partition walls for partitioning a plurality of ink paths, a common ink chamber, and the like, and is formed by integrally molding an ink reception port 1500 for receiving an ink supplied from the ink tank, and guiding the received ink toward the common ink chamber, and an orifice plate 400 having a plurality of ejection orifices. As a material used for integrally molding these members, polysulfone is preferable. However, other molding resin materials may also be used.

A support member 300 consisting of, e.g., a metal, supports the rear surface of the wiring board 200 by a flat surface, and serves as a bottom plate of the ink jet unit. A pressing spring 500 has an M shape, presses the common ink chamber by the center of the M shape, and presses a portion of the ink path by an apron portion 501 at a linear pressure. The leg portions of the pressing spring 500 are engaged with the rear surface side of the support member 300 via holes 3121 of the support member 300, while sandwiching the heater board 100 and the top plate 1300 therebetween, so that the heater board 100 and the top plate 1300 are brought into contact with and fixed to each other by the biasing forces of the pressing spring 500 and its apron portion 501. The support member 300 has positioning holes 312, 1900, and 2000, which are respectively engaged with two positioning projections 1012 and positioning/thermally fusion bonding projections 1800 and 1801 of the ink tank IT, and also has positioning projections 2500 and 2600 for the carriage HC of the apparatus main body IJRA on its rear surface side. In addition, the support member 300 has a hole 320, which receives an ink supply tube 2200 (to be described later) so as to allow ink supply from the ink tank. The wiring board 200 is adhered to the support member 300 by, e.g., an adhesive. Recess portions 2400 of the support member 300 are formed near the positioning projections 2500 and 2600. In this case, in the assembled ink jet cartridge IJC (FIG. 3), the recess portions 2400 are located at extended points of a head distal end area whose three sides are formed by a plurality of parallel grooves 3000 and 3001, so that foreign matter such as dust, ink, or the like does not reach the projections 2500 and 2600. As can be seen from FIGS. 3 and 4, a lid member 800 formed with the parallel grooves 3000 forms the outer wall of the ink jet cartridge IJC, and defines a space portion for storing the ink jet unit IJU. In an ink supply member 600 formed with the parallel grooves 3001, an ink guide tube 1600 continuous with the above-mentioned supply tube 2200 is formed as a cantilever, the supply tube 2200 side of which is fixed, and a seal pin 602 for assuring a capillarity between the fixed side of the ink guide tube and the ink supply tube 2200 is inserted in the ink guide tube. Note that a packing 601 provides a seal upon coupling between the ink tank IT and the supply tube 2200, and a filter 700 is arranged on an end portion, on the side of a tank, of the supply tube.

Since the ink supply member 600 is formed by molding, it has low cost and high positional precision, and is free from a decrease in precision in the manufacture. In addition, since the ink supply member 600 has the cantilever-shaped guide tube 1600, the press-contact state of the guide tube 1600 to the above-mentioned ink reception port 1500 can be stabilized even in mass production. In this embodiment, a sealing adhesive need only be flowed from the ink supply member side in this press-contact state, thus reliably obtaining a complete communication state. Note that the ink supply member 600 can be easily fixed to the support member 300 in such a manner that pins (not shown) formed on the rear surface of the ink supply member 600 are caused to project through holes 1901 and 1902 of the support member 300, and the portions projecting toward the rear surface side of the support member 300 are thermally fusion-bonded. Since the slightly projecting regions of the thermally fusion-bonded rear surface portions are received in a recess (not shown) formed in the wall surface, on the side of the ink jet unit IJU mounting surface, of the ink tank IT, the positioning surface of the unit IJU can be precisely obtained.

(iii) Description of Arrangement of Ink Tank IT

The ink tank is constituted by a cartridge main body 1000, an ink absorbing member 900, and a lid member 1100 for sealing a side surface, opposite to the unit IJU mounting surface, of the cartridge main body 1000 after the ink absorbing member 900 is inserted therefrom in the main body 1000. The ink absorbing member 900 is used for impregnating an ink, and is arranged in the cartridge main body 1000. A supply port 1200 is used for supplying an ink to the unit IJU constituted by the above-mentioned members 100 to 600, and is also used for injecting an ink therethrough in a process before the unit is arranged on a portion 1010 of the cartridge main body 1000 so as to perform ink impregnation of the absorbing member 900.

In this embodiment, ink supply capable portions are an air communication port and this supply port. In order to satisfactorily perform ink supply from the ink absorbing member, an intra-tank air region defined by ribs 2300 in the main body 1000 and partial ribs 2301 and 2302 of the lid member 1100 extends continuously from the air communication port 1401 side to a corner region farthest from the ink supply port 1200. Therefore, it is important to relatively satisfactorily and uniformly perform ink supply to the absorbing member from the supply port 1200 side. This method is very effective in practical use. The ribs 2300 include four ribs parallel to the carriage moving direction on the rear surface of the main body 1000 of the ink tank, so as to prevent the absorbing member from contacting the rear surface. The partial ribs 2301 and 2302 are similarly arranged at positions on extended lines of the corresponding ribs 2300 on the inner surface of the lid member 1100. Unlike the ribs 2300, each of the ribs 2301 and 2302 is divided into some pieces so as to increase the air space as compared to the ribs 2300. Note that the partial ribs 2301 and 2302 are distributed on an area half or less the total area of the lid member 1100. With these ribs, an ink in the corner region, farthest from the ink supply port 1200, of the ink absorbing member can be stabilized and reliably guided by a capillary force toward the supply port 1200. The air communication port 1401 is formed on the lid member to cause the interior of the cartridge to communicate with air. An ink repellant member 1400 is arranged inside the air communication port 1401, thereby preventing an ink from leaking from the air communication port 1401.

Since the ink storage space of the above-mentioned ink tank IT has a rectangular section, and often has a long side of the rectangular section on a side surface, the above-mentioned arrangement of the ribs are particularly effective. However, when the rectangular section has a long side in the carriage moving direction or when the ink storage space is defined by a cube, ribs are arranged on the entire inner surface of the lid member 1100, thereby stabilizing ink supply from the ink absorbing member 900.

Figure 5:
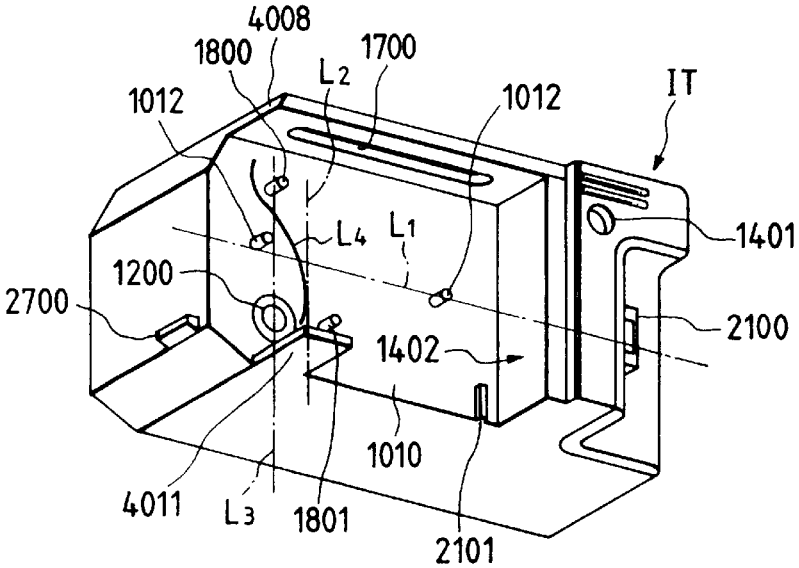

FIG. 5 shows the arrangement of the unit IJU mounting surface of the ink tank IT. If a straight line passing substantially the center of a projection port of the orifice plate 400, and parallel to the bottom surface of the tank IT or a placement reference plane of the surface of the carriage is represented by L1, the two positioning projections 1012 engaging with the holes 312 of the support member 300 are located on this straight light L1. The height of each projection 1012 is slightly smaller than the thickness of the support member 300, and the projections 1012 are used for positioning the support member 300. In FIG. 5, a pawl 2100 to be engaged with a 90° engaging surface 4002 of a positioning hook 4001 of the carriage is located on the extended line of the straight line L1, so that the positioning force for the carriage acts in a plane region parallel to the above-mentioned reference plane including the straight line L1. As will be described later with reference to FIG. 5, the positioning precision of the ink tank alone is equivalent to that of the ejection orifices of the head, thus providing an effective arrangement.

The projections 1800 and 1801 of the ink tank corresponding to the fixing holes 1900 and 2000 for fixing the support member 300 to the ink tank side surface are longer than the above-mentioned projections 1012, and are used for fixing the support member 300 to the side surface of the ink tank by thermally fusion-bonding the portions of the projections 1800 and 1801 projecting through the support member 300. If a straight line perpendicular to the line L1 and passing the projection 1800 is represented by L3, and a straight line perpendicular to the line L1 and passing the projection 1801 is represented by L2, since substantially the center of the supply port 1200 is located on the straight line L3, these projections serve to stabilize the coupling state between the supply port 1200 and the supply tube 2200. Even when the ink cartridge is dropped or a shock is applied to the cartridge, the load on the coupling state of these members can be reduced, thus providing a preferable arrangement. Since the straight lines L2 and L3 do not coincide with each other, and the projections 1800 and 1801 are present near the projection 1012 at the ejection orifice side of the head IJH, they can provide a positioning reinforcement effect of the head IJH with respect to the tank. Note that a curve L4 represents the outer wall position when the ink supply member 600 is attached. Since the projections 1800 and 1801 are located along the curve L4, they provide a sufficient mechanical strength and position precision with respect to the weight of the distal end side arrangement of the head IJH. A distal end color 2700 of the ink tank IT is inserted in a hole of a front plate 4000 of the carriage, and is arranged as a countermeasure against an abnormal state wherein the displacement of the ink tank is extremely worsened. An engaging portion 2101 is engaged with another positioning portion of the carriage HC.

The ink tank IT encloses the unit IJU except for a lower opening since it is covered by the lid member 800 after the unit IJU is attached. However, as for the ink jet cartridge IJC, since the lower opening used for placing the unit on the carriage HC is close to the carriage HC, a substantially four-direction enclosed space is undesirably formed. Heat generated by the head IJH arranged in the enclosed space is effective for keeping the temperature in this space, but causes a slight temperature rise. For this reason, in this embodiment, a slit 1700 having a smaller width than this space is formed on the upper surface of the cartridge IJC so as to help natural heat dissipation of the support member, so that the temperature distribution of the entire unit IJU can be made uniform independently of an environment while preventing the temperature rise.

When the ink jet cartridge IJC is assembled, an ink is supplied from the interior of the cartridge into the supply member 600 via the supply port 1200, the hole 320 formed on the support member 300, and an inlet port formed on the central rear surface side of the supply member 600, and passes through the interior of the supply member 600. Thereafter, the ink is flowed from an outlet port into the common ink chamber via a proper supply tube and the ink reception port 1500 of the top plate 1300. Packings consisting of, e.g., silicone rubber, butyl rubber, or the like are provided to connection portions of the above-mentioned ink communication path, so as to provide seals, thereby assuring an ink supply path.

In this embodiment, the top plate 1300 is simultaneously molded integrally with the orifice plate 400 in metal molds using a resin having a high ink resistance, such as polysulfone, polyethersulfone, polyphenylene oxide, polypropylene, or the like.

As described above, since the ink supply member 600, the top plate and the orifice plate, and the ink tank main body 1000 are integrally molded members, a high assembling precision can be assured, and quality in mass production can be very effectively improved. In addition, since the number of parts can be decreased as compared to a conventional arrangement, required characteristics can be reliably provided.

(iv) Description of Mounting of Ink Jet Cartridge IJC on Carriage HC

Figure 6:
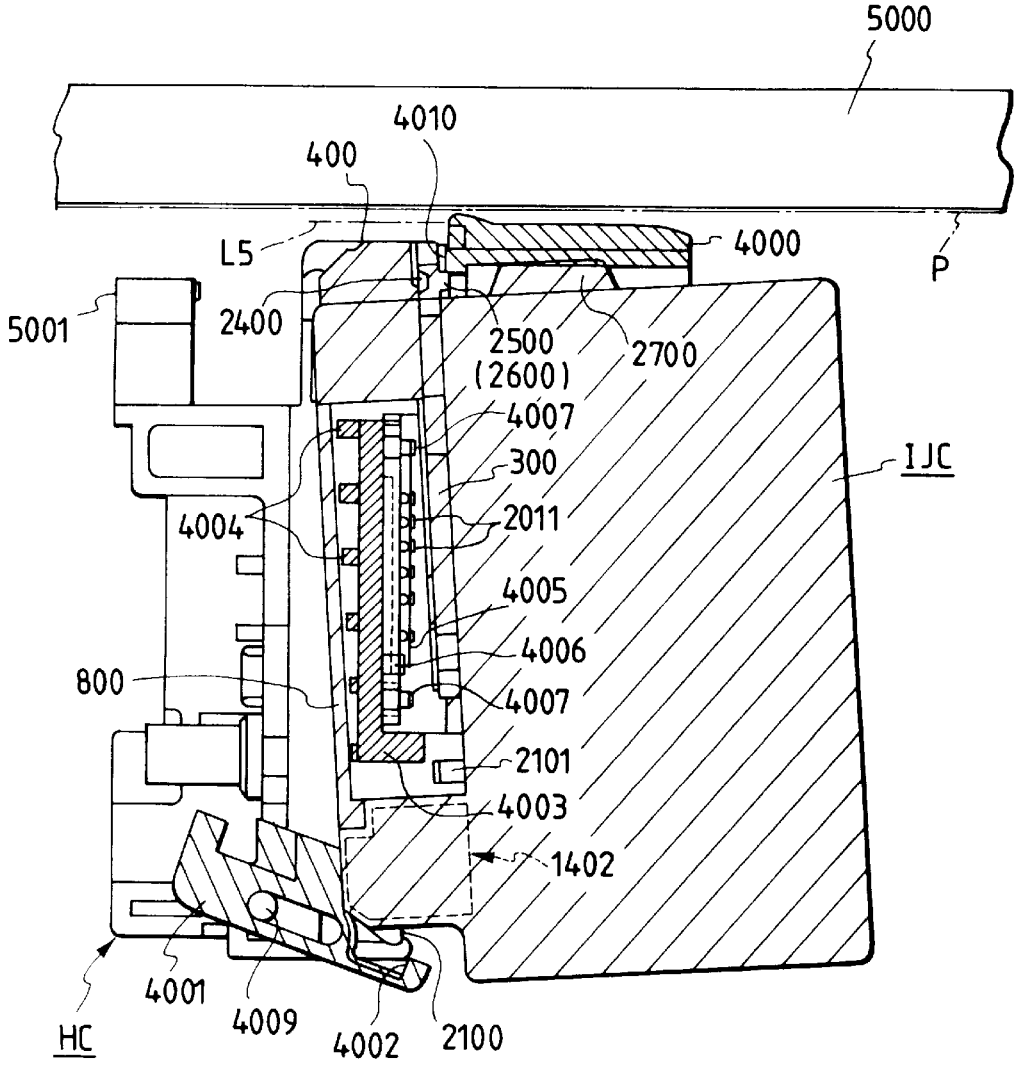

In FIG. 6, a platen roller 5000 guides a recording medium P from the lower side in the plane of the drawing toward the upper side. The carriage HC is moved along the platen roller 5000, and is provided with the front plate (2 mm thick) 4000 located at the front surface side of the ink jet cartridge IJC, a flexible sheet 4005 having pads 2011 corresponding to the pads 201 of the wiring board 200, an electrical connection portion support plate 4003 for holding a rubber sheet 4006 with projections for generating biasing forces for pressing the pads 2011 from the rear surface side, and the positioning hook 4001 for fixing the ink jet cartridge IJC at a recording position. The front plate 4000 has two positioning projecting surfaces 4010 in correspondence with the above-mentioned positioning projections 2500 and 2600 of the support member 300 of the cartridge, and receives a vertical force acting toward the projecting surfaces 4010 after the cartridge is mounted. For this reason, a plurality of reinforcement ribs are arranged on the platen roller side of the front plate to extend in the direction of the vertical force. The ribs form head protection projections projecting, toward the platen roller side, slightly (by about 0.1 mm) from a front surface position L5 defined when the cartridge IJC is mounted. The electrical connection portion support plate 4003 has a plurality of reinforcement ribs 4004 not in the direction of the above-mentioned ribs but in the vertical direction, and the heights of the ribs are gradually decreased from the platen side toward the hook 4001 side. These ribs have a function of obliquely defining the cartridge mounting position, as shown in FIG. 6. The support plate 4003 also has a platen-side positioning surface 4008 and a hook-side positioning surface 4007 so as to stabilize an electrical contact state, forms a pad contact region between these surfaces, and uniquely defines the deformation amount of the rubber sheet 4006 with projections corresponding to the pads 2011. When the cartridge IJC is fixed in a recording possible position, these positioning surfaces contact the surface of the wiring board 200. In this embodiment, since the pads 201 of the wiring board 200 are distributed to be symmetrical about the above-mentioned line L1, the deformation amounts of the projections on the rubber sheet 4006 are made uniform, thereby more stabilizing the contact pressures between the pads 2011 and 201. In this embodiment, the pads 201 are distributed in two upper and lower arrays, and in two vertical arrays.

The hook 4001 has an elongated hole to be engaged with a fixing shaft 4009. The hook is pivoted counterclockwise from the position illustrated in FIG. 6 by utilizing a movable space of the elongated hole, and is then moved leftward along the platen roller 5000, thereby positioning the ink jet cartridge IJC with respect to the carriage HC. The movement of the hook 4001 is not particularly limited, but an arrangement for moving the hook with, e.g., a lever is preferably adopted. In any case, upon pivotal movement of the hook 4001, the cartridge IJC is moved to a position where the positioning projections 2500 and 2600 are able to contact the positioning surfaces 4010 of the front surface, while being moved toward the platen roller side. Upon leftward movement of the hook 4001, the 90° hook (engaging) surface 4002 turns the cartridge IJC in the horizontal plane about a contact region between the positioning surfaces 2500 and 4010 while contacting a 90° surface of the pawl 2100 of the cartridge IJC, and finally, the pads 201 and 2011 begin to be brought into contact with each other. When the hook 4001 is held in a predetermined position, i.e., a fixing position, the complete contact state between the pads 201 and 2011, the complete surface contact state between the positioning surfaces 2500 and 4010, the two-surface contact state between the 90° surface 4002 and the 90° surface of the pawl, and the surface contact state between the wiring board 200 and the positioning surfaces 4007 and 4008 are simultaneously formed, thus completing the holding operation of the cartridge IJC to the carriage.

(v) Description of Heater Board

Figure 7:
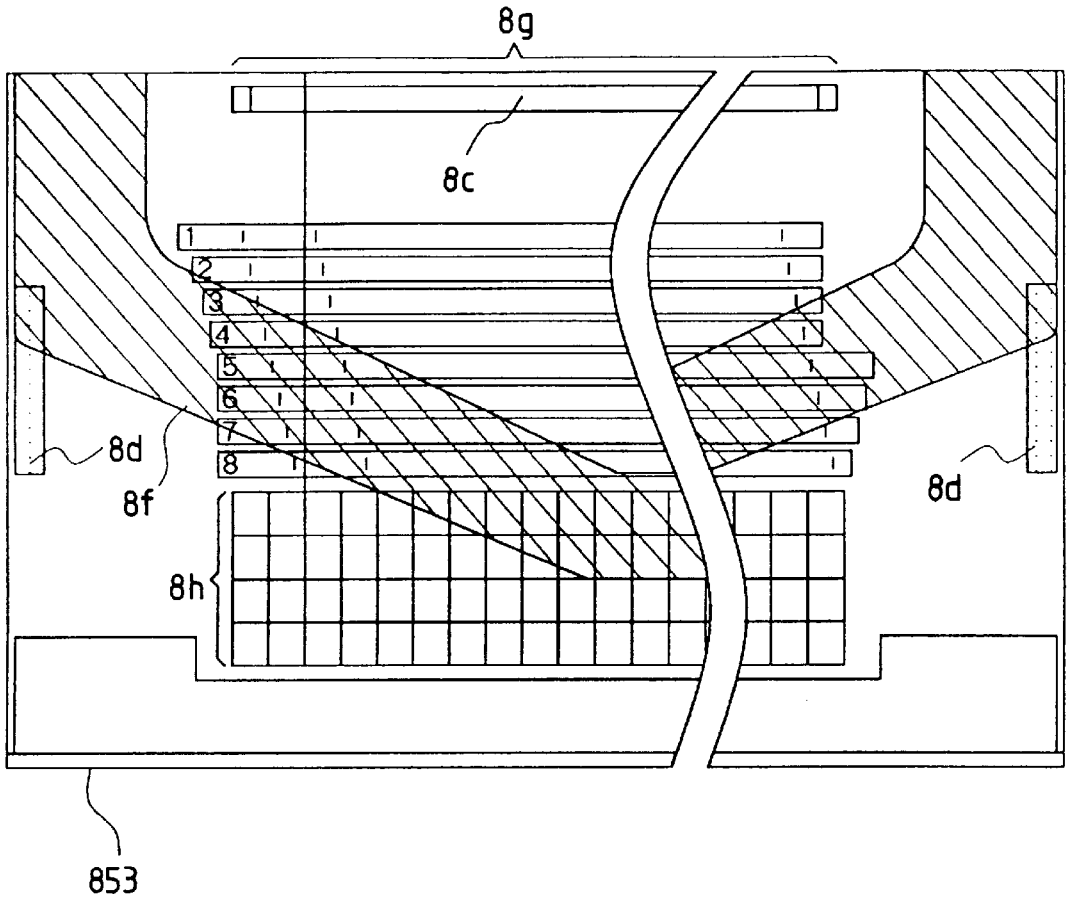
FIG. 7 is a plan view for explaining a heater board.

FIG. 7 shows the heater board 100 used in this embodiment. Temperature control (sub) heaters 8*d* for controlling the temperature of the head, ejection portion arrays 8*g* provided with ejection (main) heaters 8*c* for ejecting an ink, and driving elements 8*h* are formed on a single substrate to have the positional relationship thereamong, as shown in FIG. 7. When the elements are arranged on the single substrate in this manner, detection and control of the head temperature can be efficiently performed, and a compact head and a simple manufacturing process can be attained. FIG. 7 also illustrates the positional relationship of an outer wall section 8*f* of the top plate for separating the heater board into a region where the heater board is filled with an ink and a region where no ink is filled. The region on the side of the ejection heaters 8*d* of the outer wall section 8*f* of the top plate serves as the common ink chamber. Note that grooves formed on the ejection portion arrays 8*g* of the outer wall section 8*f* of the top plate form ink paths.

(vi) Description of Control Arrangement

The control arrangement for executing recording control of the respective sections of the above-mentioned apparatus arrangement will be described below with reference to the block diagram shown in FIG. 8. A control circuit shown in FIG. 8 includes an interface 10 for inputting a recording signal, an MPU 11, a program ROM 12 for storing a control program to be executed by the MPU 11, and a dynamic RAM 13 for storing various data (e.g., the above-mentioned recording signal, recording data to be supplied to the head, and the like), a gate array 14 for performing supply control of recording data to a recording head 18, and also performing data transfer control among the interface 10, the MPU 11, and the RAM 13, a carrier motor 20 for scanning the recording head 18, a conveying motor 19 for conveying a recording sheet, a head driver 15 for driving the head, and motor drivers 16 and 17 for respectively driving the conveying motor 19 and the carrier motor 20.

Figure 8:
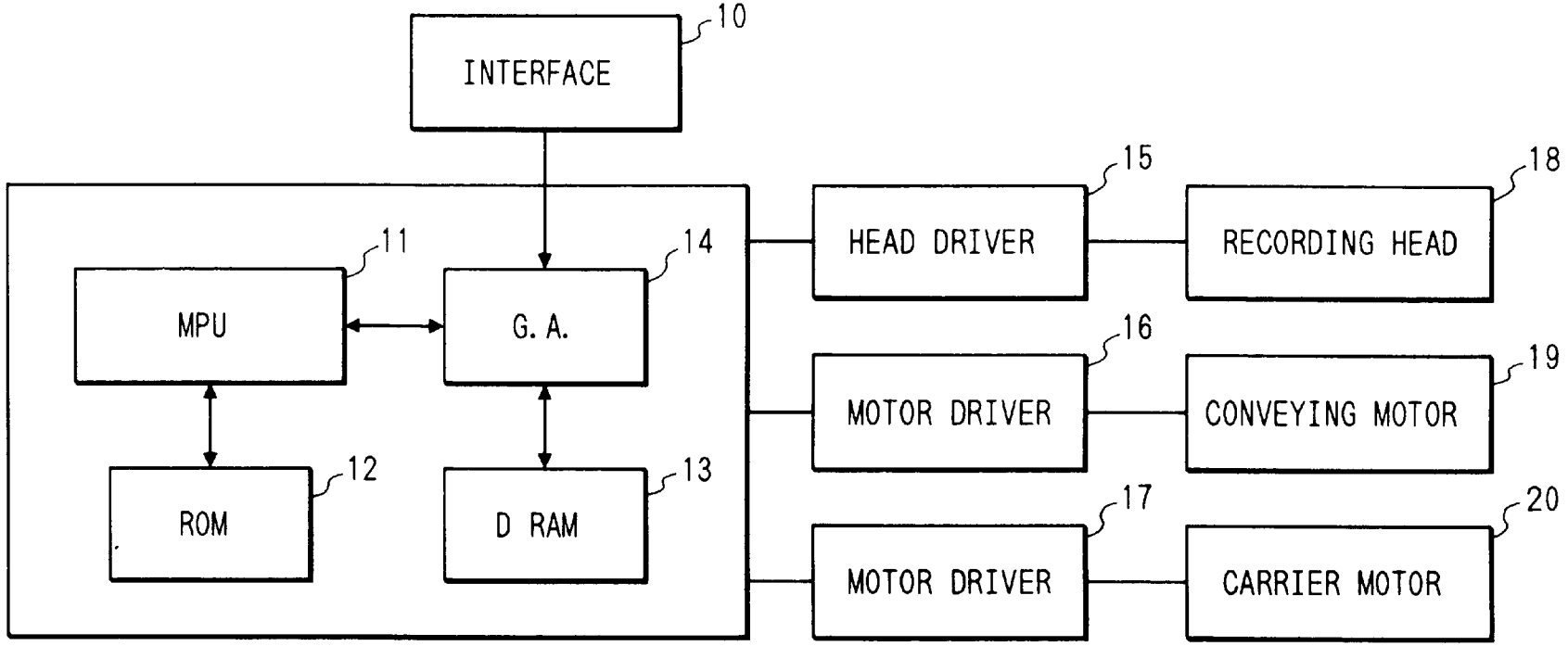
FIG. 8 is a block diagram showing a control circuit of the recording apparatus.
Figure 9:
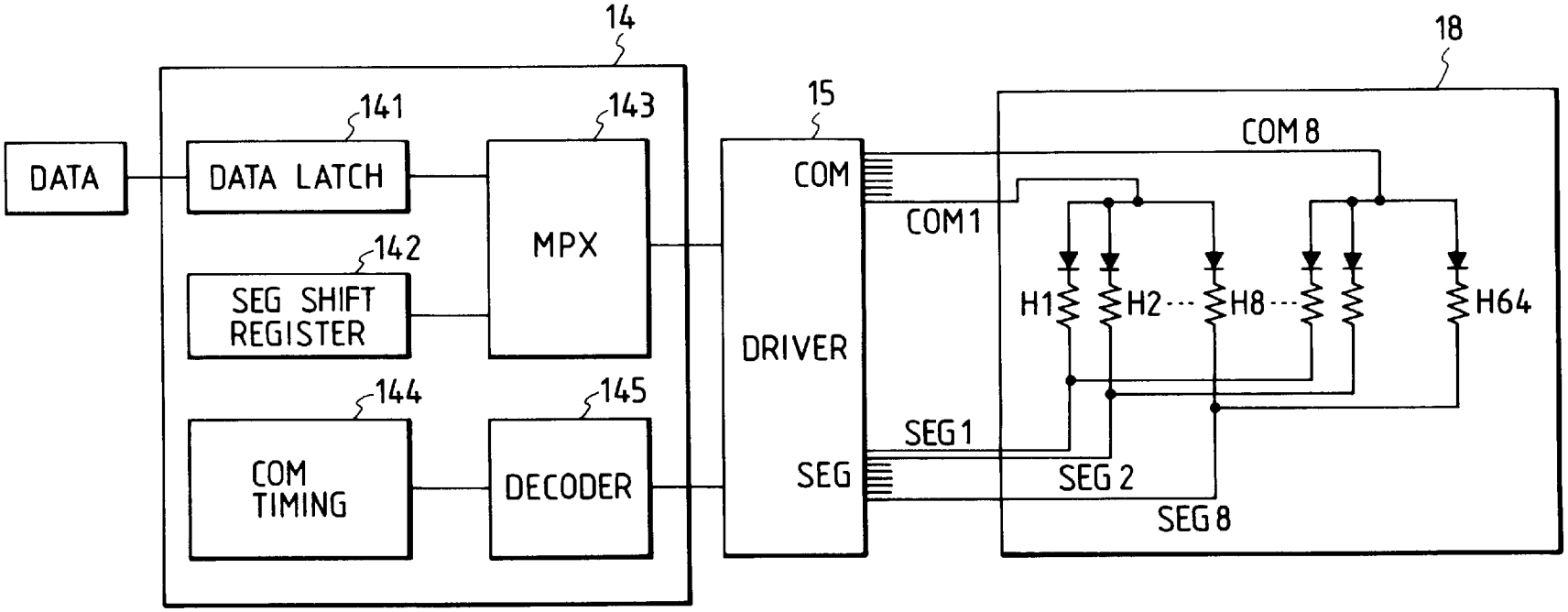
FIG. 9 is a block diagram showing a driving control circuit for an ink jet recording head.

FIG. 9 is a circuit diagram showing the details of the respective units in FIG. 8. The gate array 14 has a data latch 141, a segment (SEG) shift register 142, a multiplexer (MPX) 143, a common (COM) timing generator 144, and a decoder 145. The recording head 18 adopts a diode matrix arrangement, and a current is supplied to an ejection heater (H1 to H64) where a common signal COM and a segment signal SEG coincide with each other, thereby heating and ejecting an ink.

The decoder 145 decodes a timing generated by the common timing generator 144, and selects one of common signals COM1 to COM8. The data latch 141 latches recording data read out from the RAM 13 in units of 8 bits, and the multiplexer 143 outputs the recording data as segment signals SEG1 to SEG8 according to the segment shift register 142. The outputs from the multiplexer 143 can be changed according to the content of the shift register 142 (e.g., in units of 1 bits, 2 bits, or all 8 bits), as will be described later.

The operation of the control arrangement will be described below. When a recording signal is input to the interface 10, the recording signal is converted into print recording data between the gate array 14 and the MPU 11. The motor drivers 16 and 17 are driven, and the recording head is driven according to the recording data supplied to the head driver 15, thereby performing the print operation.

FIRST EMBODIMENT

The embodiments of the present invention will be described hereinafter using the above-mentioned apparatus.

Figure 10:
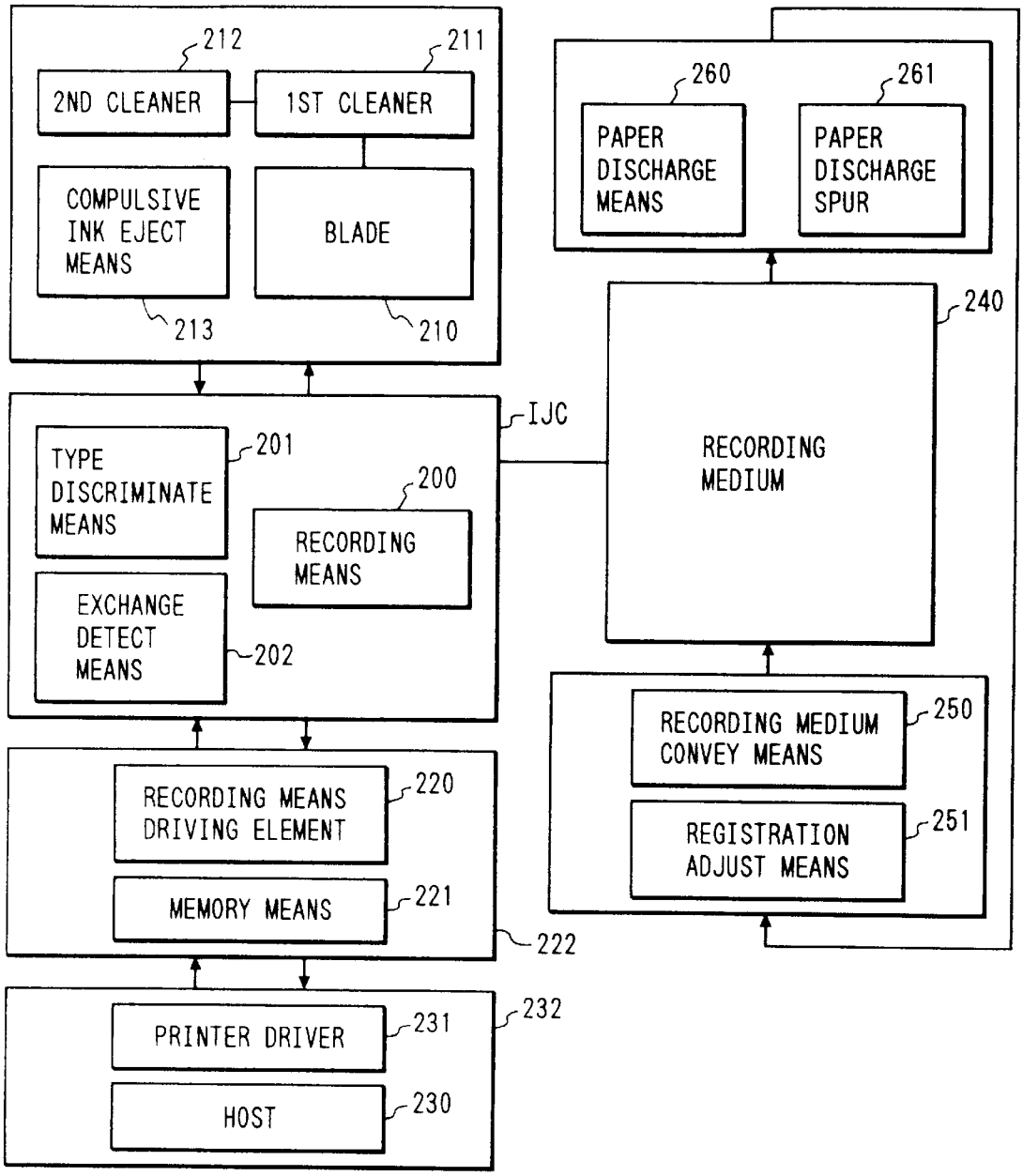
FIG. 10 is a block diagram showing the details of a control arrangement according to the first embodiment of the present invention.

FIG. 10 is a block diagram showing the overall system of the present invention. The system shown in FIG. 10 comprises an IJC unit constituted by a recording means 200 and preferably, a type discriminate means 201, an exchange detect means 202, and the like, which are attached to the means 200; a cleaning unit 214 constituted by a blade 210 for performing a maintenance of the head at, e.g., a home position for the IJC unit, a blade cleaner (first cleaner) 211 for cleaning the blade, an ink reception member (second cleaner) 212 for receiving an ink ejected from the recording means 200 so as to maintain a stable recording state, a compulsive ink ejection means 213 for causing the recording means 200 to compulsively eject an ink from its nozzles, and the like; a control unit 222 having a recording means driving element 220 for supplying a recording signal to the recording means 200, and a memory means 221 such as a line buffer memory for supplying a print pattern to the recording means driving element 220; and a host unit 232 including a printer driver 231 for converting a print pattern from a host 230 into a format suitable for the control unit 222. The system further comprises a recording medium convey means 250 used for recording an image on a recording medium 240 by the recording means 200, and preferably, a registration adjust means 251 for registering the recording medium at that time. Even when recording operations are performed while a single recording medium is conveyed by the recording medium convey means a plurality of number of times, these means can eliminate recording position errors. Furthermore, the system comprises a paper discharge means 260 for discharging a recorded recording medium. As for the paper discharge means, some methods have already been proposed. In general, a method of discharging a printed recording medium while pressing the printing surface of the printed recording medium using a paper discharge spur 261 is popular.

Figure 11A:
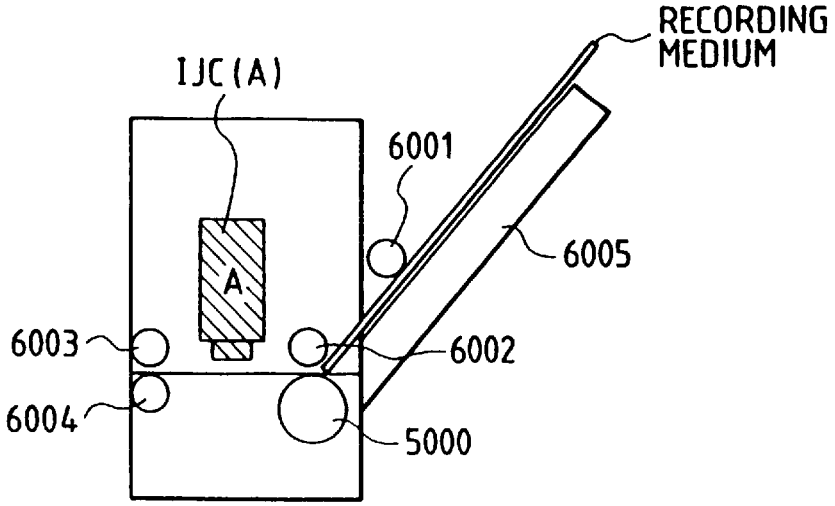
FIGS. 11A to 11C are views showing the principle of a recording method of the first embodiment.
Figure 11B:
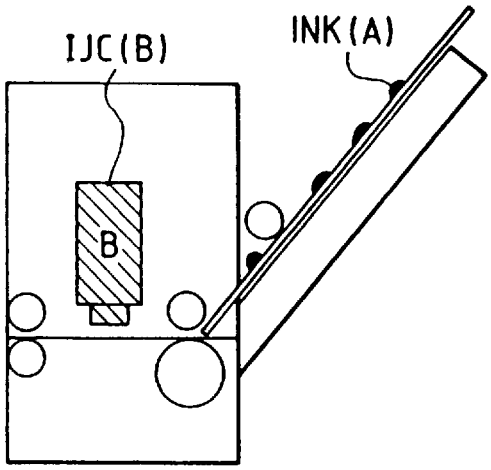
Figure 11C:
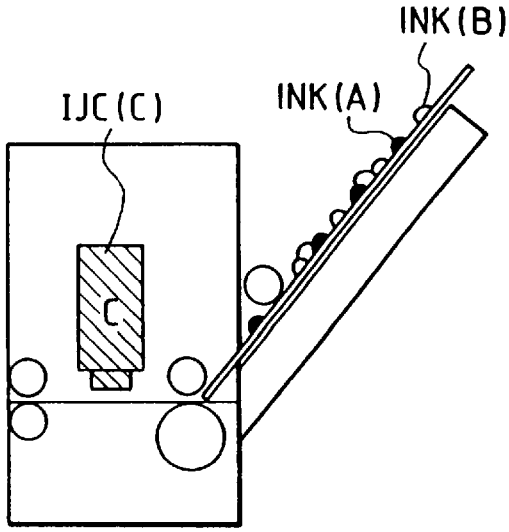

FIGS. 11A to 11C show a sequence for executing recording operations a plurality of number of times using a single recording medium in the system of the present invention. FIG. 11A shows a state wherein the first recording operation is about to be executed. In FIG. 11A, the system also includes an auto sheet feeder 6005 and a pickup roller 6001. A needle roller 6002 extends parallel to a platen roller 5000, and is in tight contact therewith. The needle roller 6002 generates a conveying force for conveying a recording medium in the conveying direction. A paper discharge spur 6003 generates a conveying force for discharging the recording medium together with a paper discharge roller 6004. FIG. 11B shows a state wherein the discharged recording medium for which the first recording operation has been completed is re-set on the auto sheet feeder 6005, and the IJC unit is exchanged with a unit of a different type. Therefore, an ink (A) printed by the first recording operation is attached onto the recording medium. FIG. 11C shows a state wherein the IJC unit is exchanged again, and the recording medium is re-set to perform a recording operation.

In a print pattern, any known image processing may be adopted, and dots may or may not overlap with each other. Furthermore, density gradation characteristics or area gradation characteristics may be attained by combinations of IJC units having different ink densities or large and small ink ejection amounts.

Figure 12:
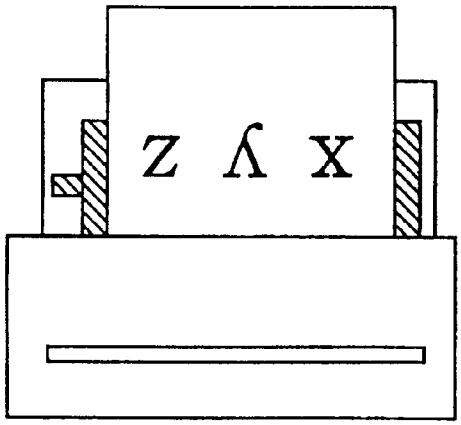
FIG. 12 is a view showing an example of an image printed according to the first embodiment.
Figure 13:
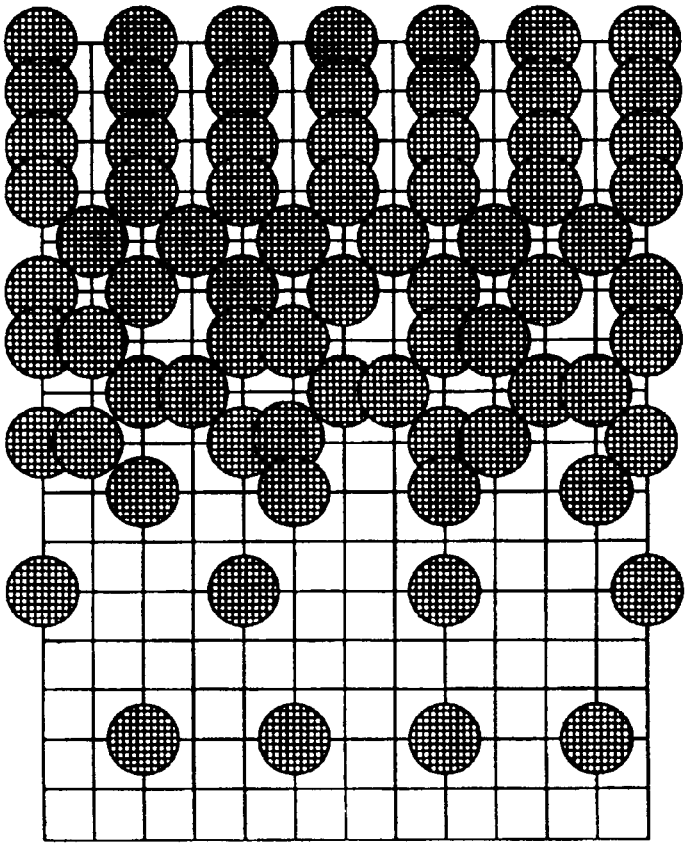
FIGS. 13 to 15 are views respectively showing image states after recording using first, second, and third inks.
Figure 14:
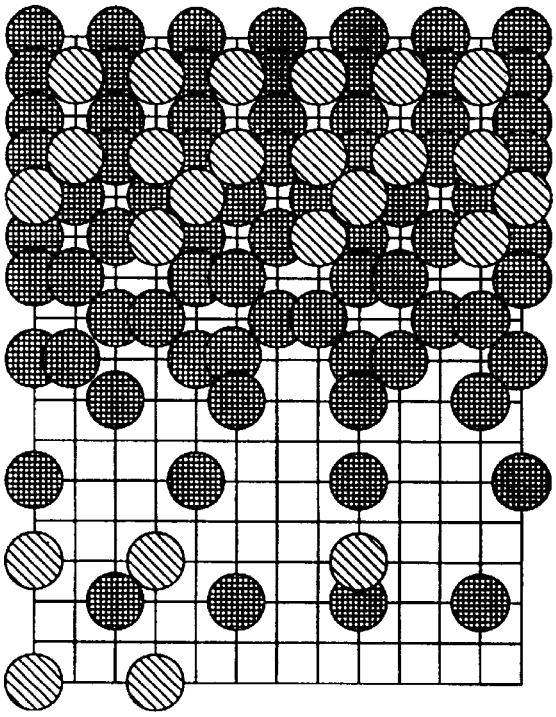
Figure 15:
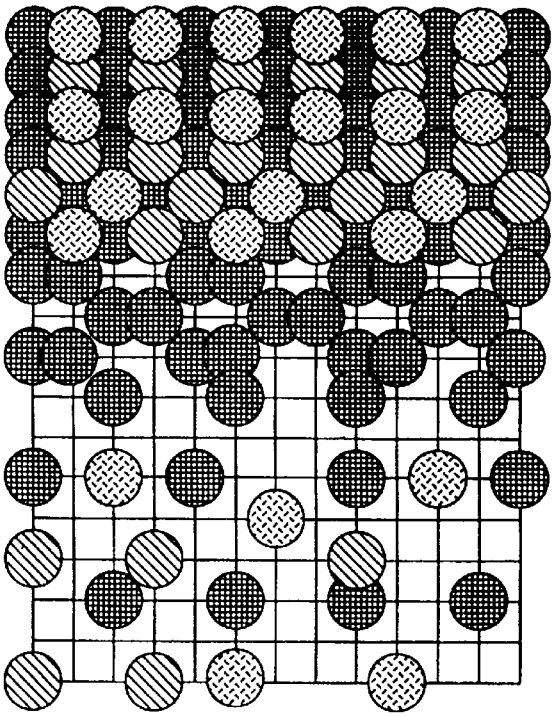

FIG. 12 shows an example of an image printed according to the present invention. FIG. 13 shows a printed state after the first print operation, FIG. 14 shows a printed state after the second print operation, and FIG. 15 shows a printed state after the third print operation. In a print pattern, any known image processing may be adopted, and dots may or may not overlap with each other. Furthermore, density gradation characteristics or area gradation characteristics may be attained by combinations of IJC units having different ink densities or large and small ink ejection amounts.

Figure 16:
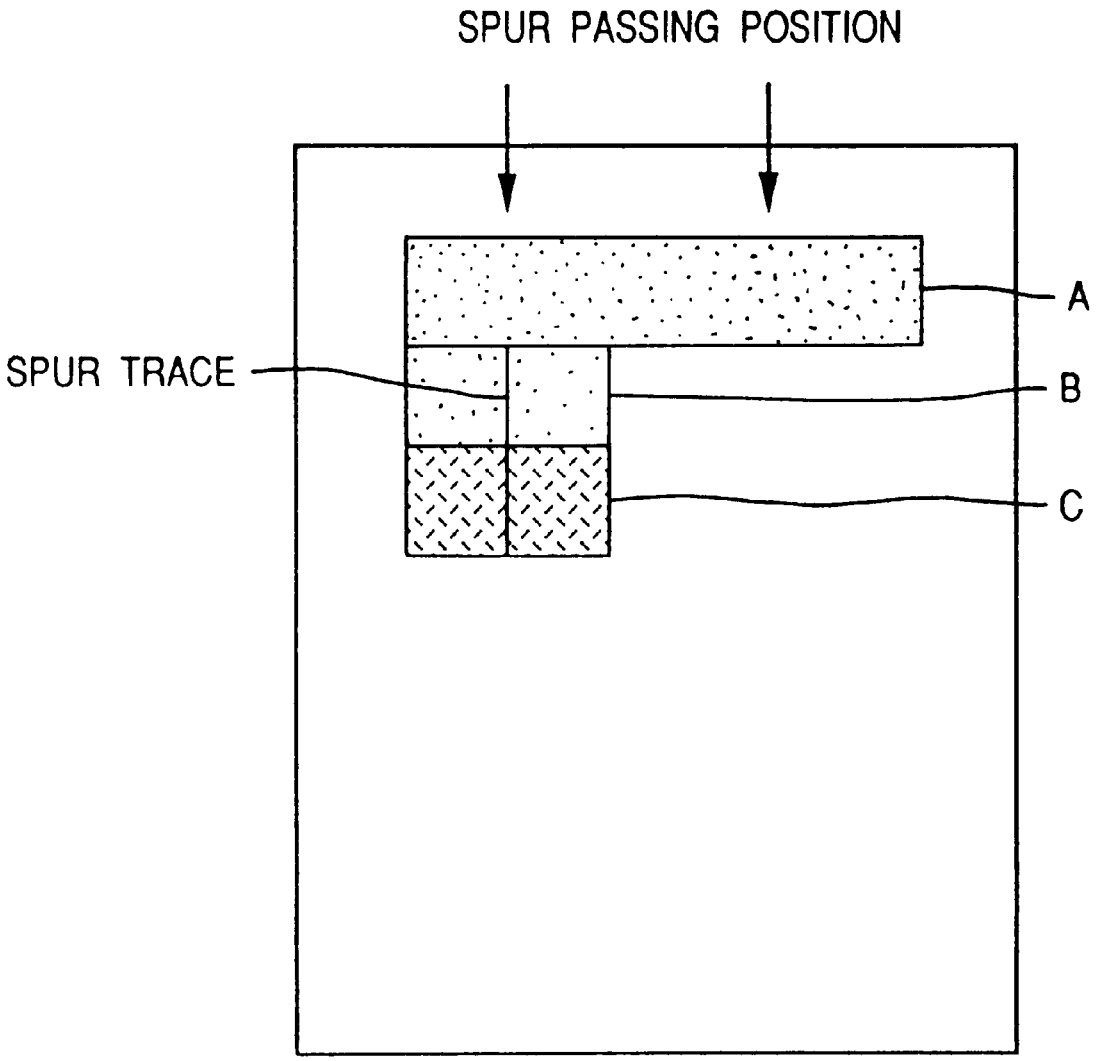
FIGS. 16 to 17B are views for explaining a spur trace.
Figure 17A:
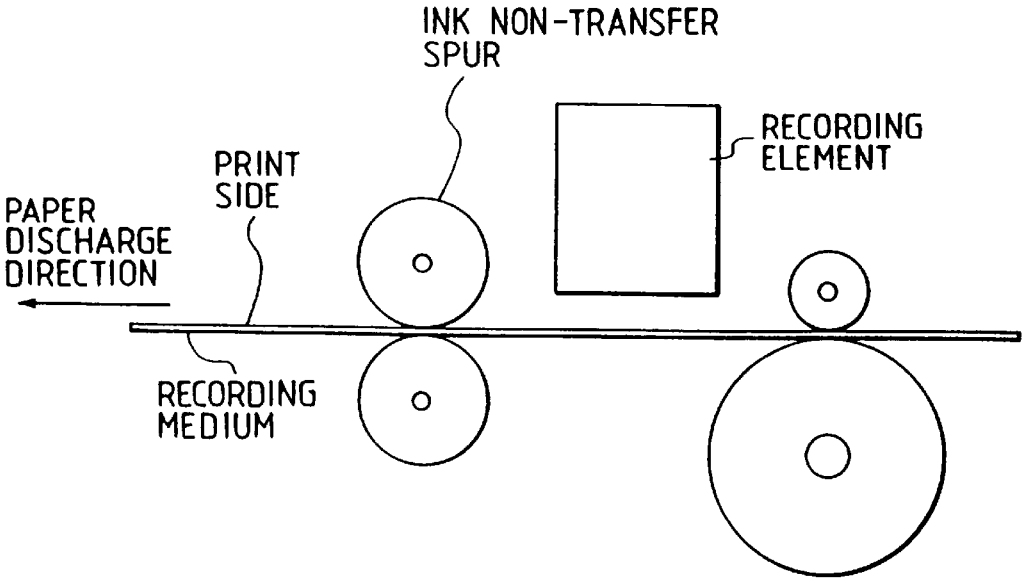
Figure 17B:
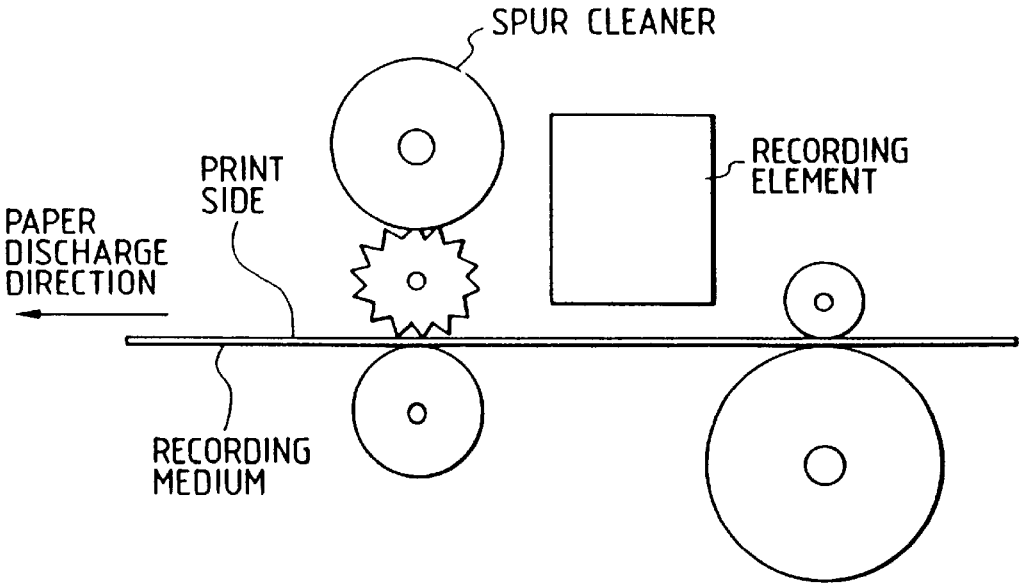

FIG. 16 shows a state wherein spur traces appear only when the spur passes on different inks. FIG. 17A shows a paper discharge system using an ink non-transfer paper discharge spur, and FIG. 17B shows a system using a star-shaped paper discharge spur. Although not shown, a system using a spur cleaner rotated together with the spur in the system shown in FIG. 17A is also available.

FIG. 2 shows an arrangement of the cleaning unit of a recording apparatus main body used in the present invention. An ink absorbing member 7000 is used for absorbing and removing ink droplets attached to a cleaning blade 5017. In an operation, after the cleaning blade scrapes off an ink around the nozzles of the IJC unit, it then reaches the absorbing member 7000. The ink absorbing member may be arranged on either the carriage or the IJC unit. When the ink absorbing member is arranged on the IJC unit, a very preferable arrangement can be attained in consideration of durability and color mixing.

Figure 18A:
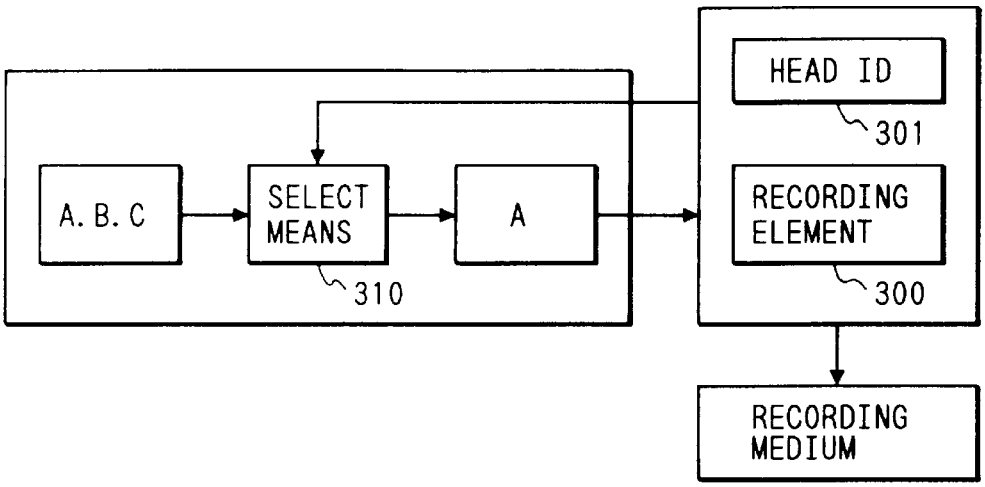
FIGS. 18A and 18B are block diagrams showing a circuit for discriminating a coincidence between a recording element and recording data.
Figure 18B:
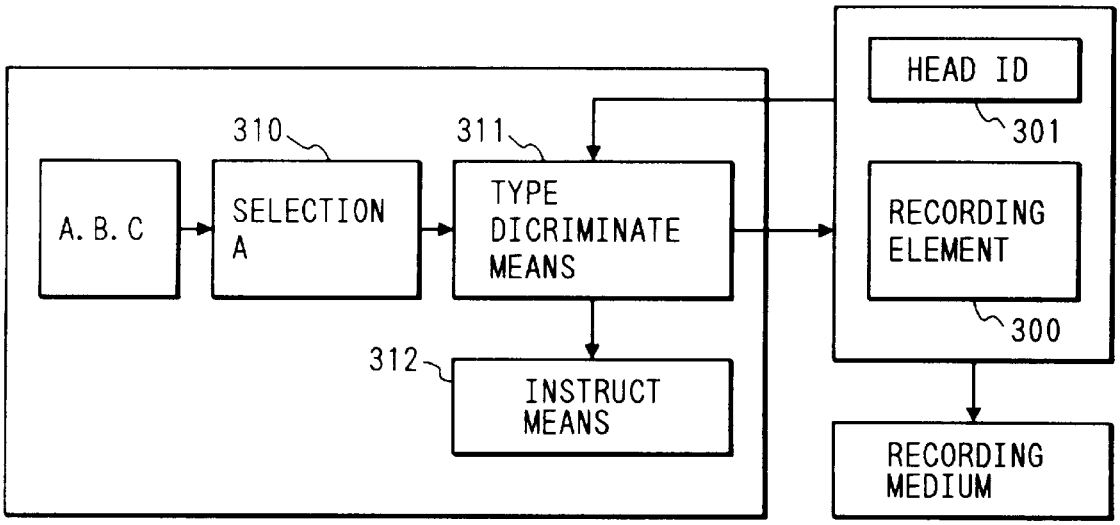

FIGS. 18A and 18B show a discrimination system for discriminating whether or not a recording element and recording data coincide with each other. FIG. 18A shows a state wherein information indicating which of data is selected from data of the host is read from a head ID 301 provided to a recording element 300, data is selected by a select means 310 according to the read information, and the selected data is supplied to the recording element 300.

FIG. 18B shows a state wherein when a user selects data, it is discriminated by a type discriminate means 311 for discriminating the type of the currently selected recording element 300, and when the selected data and recording element are different from each other, an instruct means 312 issues a proper instruction.

Assume that print operations are performed using C, M, Y, and K inks. A Y head is attached to the recording apparatus, and a recording medium is set. In this case, the auto sheet feeder is preferably used so as to register (align) the recording medium. More specifically, it is preferable that an arrangement capable of performing a vertical registration operation is adopted or a vertical registration operation is performed, and an arrangement for performing a horizontal registration operation for pressing a recording medium against a positioning side plate is adopted or a reference side plate according to a sheet width so as to horizontally register the recording medium is used. Then, Y data is supplied from the host to the recording apparatus, and a recording operation is started. In this case, an ID is provided to the recording element, and an IJC unit which does not correspond to a color designated on the printer driver is attached, a print inhibition or head exchange instruction may be issued. In this manner, upon completion of the print operation of the Y data, the recording medium is normally discharged. Of course, if a printer driver which issues a print command for a different color during the print operation is used, the head may be exchanged during the print operation without discharging the recording medium. When M data is printed, the discharged recording medium is inserted in the auto sheet feeder again. The IJC unit is exchanged with an M unit, and the print operation is performed again. In this case, certain registration precision can be assured by the arrangement capable of performing a registration operation or by the registration operation. When the auto sheet feeder is not used, an abutting portion or a positioning mark may be prepared on a manual paper feed portion. Thereafter, the print operation is similarly repeated to complete a color image.

In the monochrome print operation, since print operations are performed in units of colors, image errors such as color mixing blurring, boundary blurring, and the like are very hard to occur as compared to a system having, on a single carriage, a plurality of recording elements of different colors for almost simultaneously performing print operations. For this reason, print operations can be achieved with very high image quality without using any special-purpose sheets such as coating sheets. Furthermore, even when a single recording medium for which at least the first print operation has been completed is re-inserted, since the wait time of at least several tens of seconds is required for, e.g., exchanging the head and data before the next print operation is started, an ink is not easily re-transferred to a paper feed system, and the like.

The print order may be preferably changed depending on the types of colors, print patterns, or types of recording media. For example, when a background color upon printing is present, and, e.g., a character pattern is to be printed on the background color, i.e., when a print region surrounded by the background color is present, a portion such as characters or lines to be surrounded by the background color is preferably printed later.

Such a pattern may be extracted by a software program of, e.g., a printer driver, and an optimal print order may be instructed. Alternatively, a method of eliminating image errors caused by ejection amount nonuniformity or displacement of nozzles by executing, e.g., checker and reverse checker overlay print operations normally executed in color printing, or a plurality of number of times of print operations using different nozzles (called a fine mode), may be used. In such a method, a first print operation may be performed using a thin-out pattern, and after a recording medium is discharged, a second print operation may be performed to compensate for the thin-out pattern using the same or different head. Furthermore, an image may be completed by executing a plurality of number of times of scans while gradually feeding a recording medium by a distance corresponding to a sum of at least one nozzle and the number of nozzles used. Moreover, an image improvement method for changing the number of nozzles to be used in units of colors, or changing the registration position of a seam between adjacent lines may be added. In the case of monochrome printing, since print operations are performed in units of colors to overlay colors, the color print orders of forward and backward scans in reciprocal color printing are never changed unlike in a color ink jet recording apparatus, which has a plurality of recording heads aligned almost horizontally. Therefore, even when the reciprocal color printing is executed, since no color tone difference caused by different print orders of the forward and backward scans is formed, a high-quality color print free from blurring and having a stable color tone can be obtained without executing any special color tone control.

The advantage that a high-quality print can be obtained has been described so far. However, when recording operations are performed a plurality of number of times on a single recording medium, a problem that has been solved in monochrome printing may be highlighted. This is a problem associated with the paper discharge spur. Some applications of the paper discharge spur are available. As the most high-performance and simplest method, a paper discharge spur is rotated, so that its circumferential surface continuously contacts the print surface, and consists of a material having high water repellant performance (e.g., a fluorine compound), so that an ink is not transferred onto its circumferential surface. With this spur, not only in a single print operation on a single recording medium but also in a plurality of print operations on a single recording medium, the print operations can be performed without transferring an ink on a printed portion onto a non-print portion, i.e., without forming so-called spur traces.

However, when recording operations are performed a plurality of number of times on a single recording medium using a plurality of IJC units of different colors, a problem, as shown in FIG. 16, may often be posed. More specifically, when the spur passes on printed portions in different colors having high print duties, spur traces appear on only different colors. The principle of this phenomenon will be described below. That is, the spur traces are formed in such a manner that ink droplets attached not on the circumferential surface but on the side surface of the spur are mixed on a different color ink. If the color of ink droplets on the side surface is the same as that of the current print portion, no problem is posed even when the ink droplets on the side surface are mixed. However, a problem is posed if the above-mentioned colors are different from each other. Since a non-printed portion or a printed portion having a low print duty suffers from less deformation caused by swelling of paper, the ink droplets on the side surface of the spur never pose any problem. When print operations are performed using a plurality of different color inks, it is ideal to exchange, e.g., a spur unit. More specifically, a combination of known means, e.g., a means with a spur cleaner, a means with no spur, and the like may be proposed.

As described above, according to this embodiment, in an ink jet recording apparatus for performing recording by ejecting an ink, the problem of a recording medium caused by inks can be solved, and color recording with high image quality can be easily realized.

SECOND EMBODIMENT

The second embodiment corresponds to a further improvement of the first embodiment. When recording is performed on a single recording medium while exchanging a plurality of ink recording heads like in the first embodiment, recording operations are not always performed in the same state, and the following problems are expected.

(1) Color Mixing in Suction Recovery

When a plurality of ink recording heads are selectively used in a single ink jet recording apparatus, if a suction recovery operation is performed in a state wherein an ink of a different color drawn in the immediately preceding suction recovery operation is left in a recovery device, the remaining ink is caught up into an ink convection in suction, and undesirably becomes attached to the ink recording head. Then, the attached ink is directly drawn into nozzles, and is mixed with a different ink. Even though the attached ink is not directly drawn into the nozzles, if, e.g., a wiping operation is performed for the purpose of stable recording, the different color ink attached near the nozzles is guided into the nozzles, and is mixed with another ink. If such color mixing occurs, image quality is considerably deteriorated.

(2) Image Quality on Single Recording Medium

When recording operations on a single recording medium are performed for a plurality of recording media, the ink recording heads are not always in the same state, and the temperature rise upon continuous execution of recording is different from that upon intermittent execution of recording. Also, the temperature rise of the ink recording head varies depending on the print duty. When the temperature of the ink recording head varies, the ejection amount varies accordingly, and a recovery sequence optimal for the ink recording head also changes. An optimal recovery condition also varies depending on the environmental temperature or the use frequency of the ink recording head.

The above-mentioned problems are posed since recording operations are performed a plurality of number of times on a single recording medium while exchanging a plurality of ink recording heads, and must be solved when a high-quality color image in at least two colors is to be stably formed by a monochrome ink jet recording apparatus using a plurality of ink recording heads.

As the second embodiment, a method of controlling a recovery sequence for stabilizing ejection in an ink jet recording apparatus for performing recording on a single recording medium using a plurality of ink recording heads will be described below.

Figure 19:
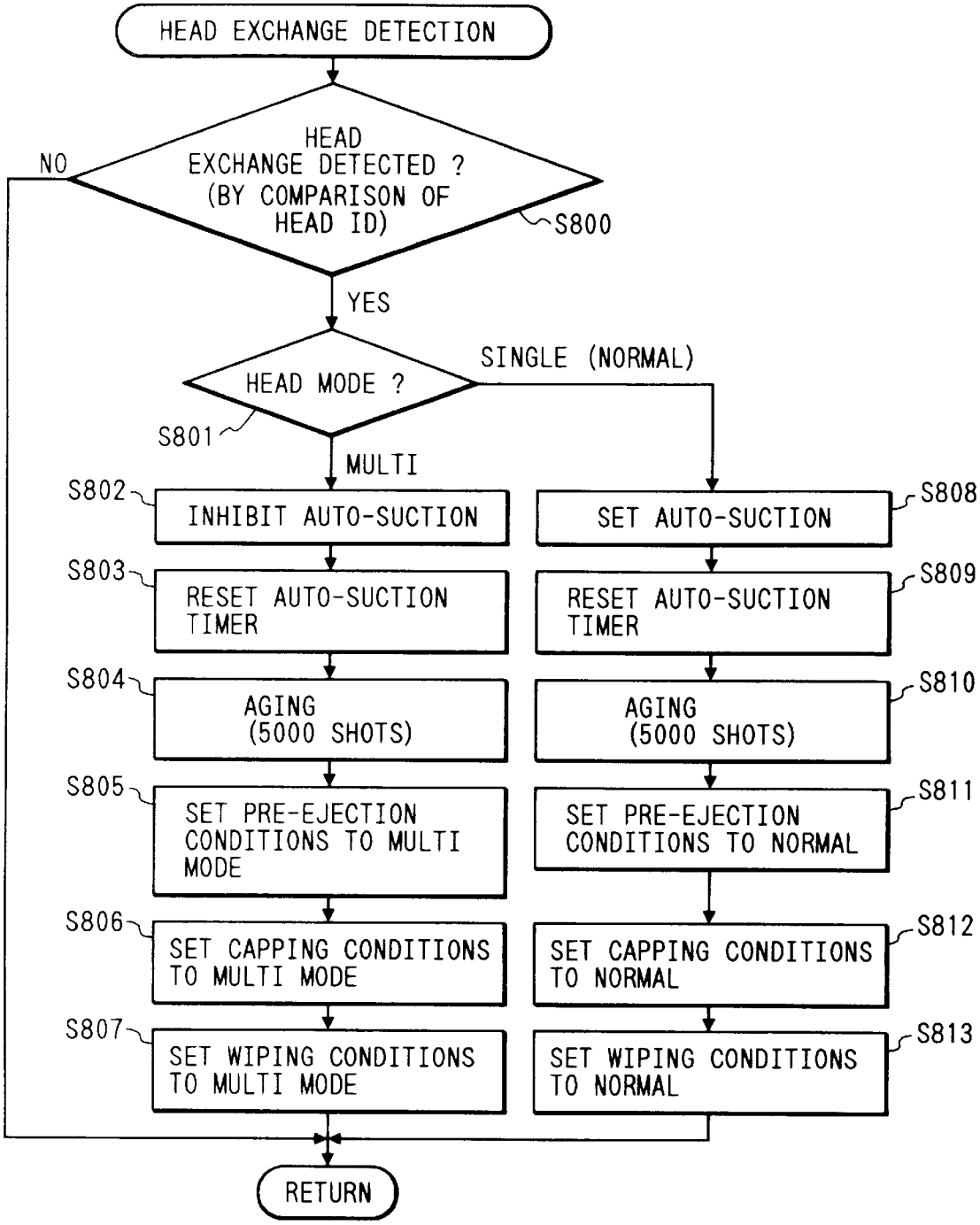
FIG. 19 is a flow chart showing a recovery sequence upon exchange of ink recording heads so as to explain the basic principle of the second embodiment.

FIG. 19 shows a recovery sequence according to this embodiment. When exchange of an ink recording head is detected or recognized by an exchange detect means in step S800, the mode of the ink recording head is detected or recognized in step S801.

If a mode for using a plurality of ink recording heads (multi mode) is detected or recognized, an auto-suction operation is inhibited (step S802 and S803). This is to prevent considerable deterioration of image quality due to color mixing caused when an ink recording head having an ink different from a normally used ink recording head is attached, and a suction recovery operation is performed. In step S804, aging of the ink recording head is performed. In the multi mode, since recording operations are performed a plurality of number of times on a single recording medium, even a single erroneous recording operation considerably affects image quality as compared to a normal mode using a single ink recording head (normal or single mode). For this reason, aging is performed to reliably perform recording. In this case, in consideration of the ink consumption amount, aging is performed only when the ink recording head is exchanged. The aging is performed by 5,000 shots of ink droplets, but the number of shots may be changed according to the type of the recording head, the environmental temperature, and the like. Furthermore, in order to perform aging more satisfactorily, the head may be driven at a voltage higher than that in a recording mode.

Then, a pre-ejection condition, a capping condition, and a wiping condition are set in the multi mode (steps S805 to S807). These conditions may also be changed according to the type of the recording head, the environmental temperature, and the like. The operation to be inhibited in the multi mode is not limited to the auto-suction operation. For example, even when a user inputs a suction recovery command, no suction recovery operation is performed, and an error indication or a message displayed on a CRT of a host urges the user to separately perform the suction recovery operation.

When the normal mode is detected or recognized, the auto-suction mode is set (steps S808 and S809), and aging is then executed (step S810). The aging is performed for the same reason as that in the multiple mode since this mode may be started during recording operations on a single recording medium using the plurality of ink recording heads. Then, a pre-ejection condition, a capping condition, and a wiping condition are set in the normal mode (steps S811 to S813). Normally, an ink recording head used in a monochrome ink jet recording apparatus is a monochrome head, and a black (Bk) ink is ordinarily used. However, the monochrome ink is not limited to the black ink, and a state wherein one type of ink recording head is used in the single ink jet recording apparatus is determined as the normal mode.

Figures 20, 20A:
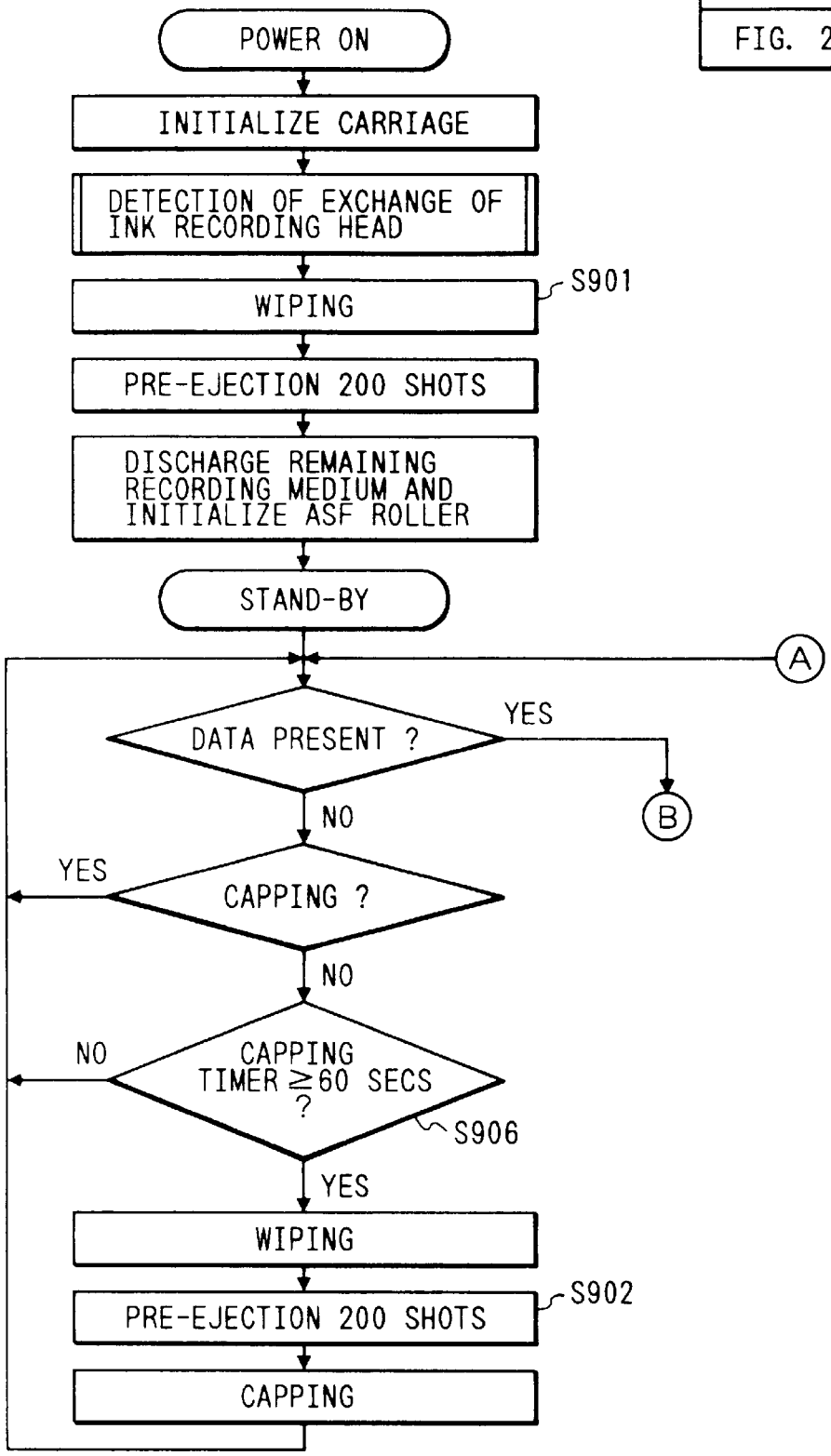
FIG. 20, which is comprised of FIGS. 20A and 20B, 21 and 22 are flow charts showing sequences of a multi ink recording head mode of the second embodiment.
Figure 20B:
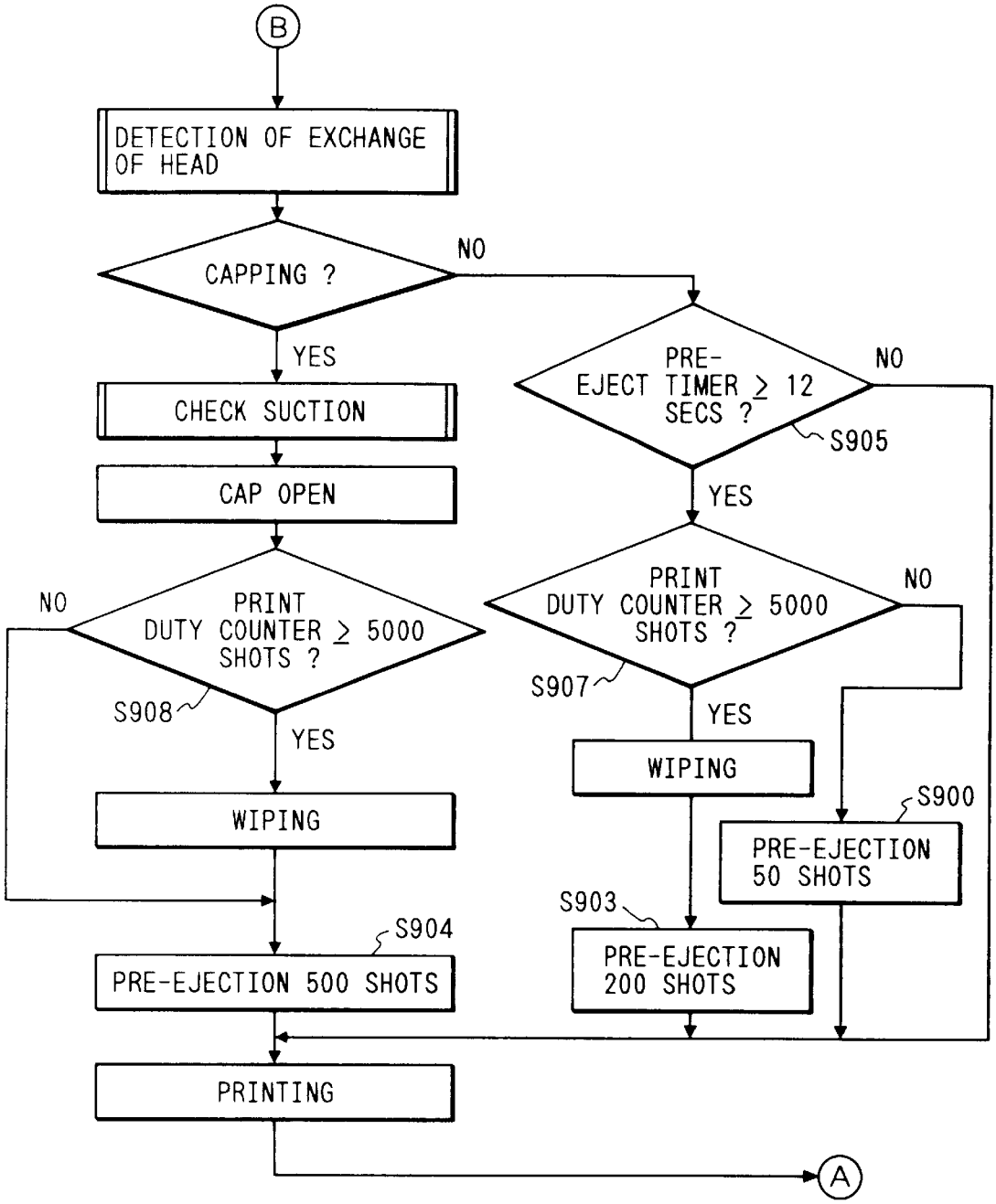
Figure 21:
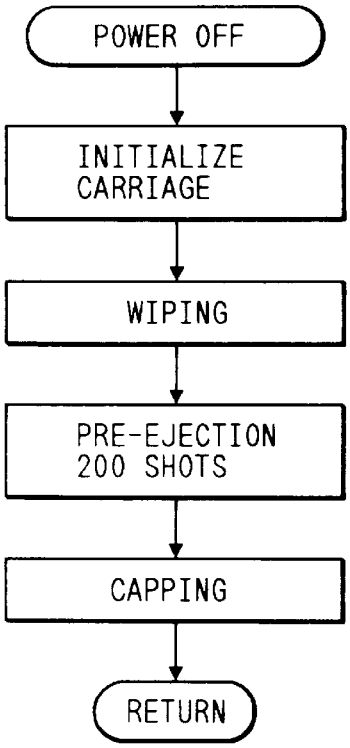
Figure 22:
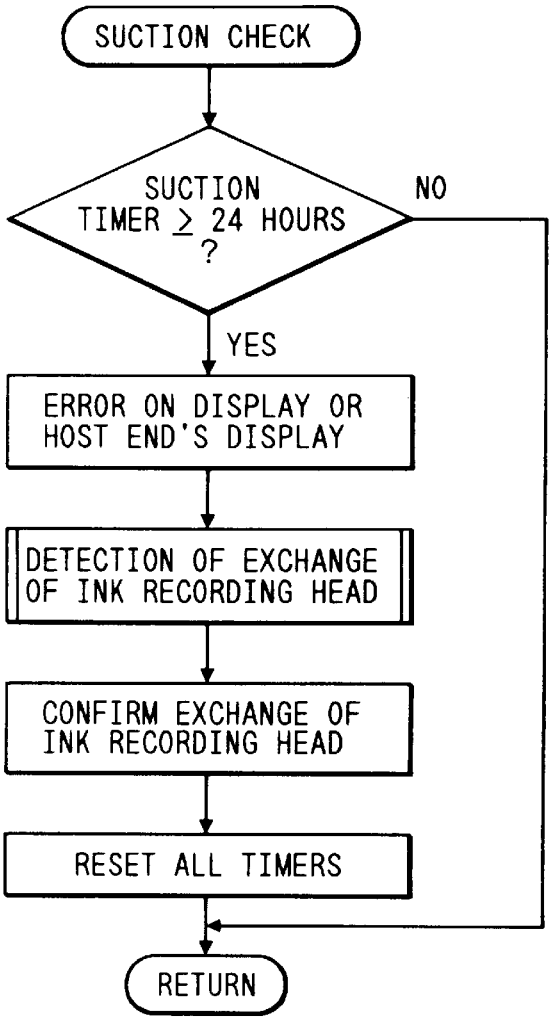

FIG. 20 shows a power-ON sequence in the multi mode, FIG. 21 shows a power-OFF sequence, and FIG. 22 shows a suction check sequence. As shown in FIG. 20, exchange detection of the ink recording head is performed at a power-ON timing and a print start timing. A pre-ejection during printing is attained by 50 shots (step S900). After wiping, the number of shots in the pre-ejection is set to be 200 so as to reliably remove a different color ink mixed in the nozzles since different ink droplets attached to the head face may be mixed in the nozzles (steps S901 to S903). Furthermore, after capping and wiping, a pre-ejection of 500 shots larger than those in the normal mode is performed since a possibility of mixing of a different color ink in the nozzles is higher (step S904). The pre-ejection interval is set to be 12 sec (step S905). However, in order to improve reliability, the interval may be shortened. Furthermore, the pre-ejection may be controlled based on the print duty count (the number of dots) in place of time control.

If no print data is supplied over 60 sec or more, capping is executed (step S906). However, when the capping is executed, a different color ink left in the cap may be transferred onto the head face. Thus, capping may be inhibited in the multi mode. This is because the head will not be left unused for a long period of time since the recording heads are exchanged for recording operations in units of pages.

In order to effectively perform wiping, the wiping is controlled based on the print duty count in place of time control, so that the wiping is performed according to the wet state of the head face (steps S907 to S908). Since the wiping may cause mixing of a different color ink in the nozzles, the wiping may be inhibited in the multi mode like in capping.

In this manner, no suction recovery operation is performed, and an error indication or a message displayed on the CRT of the host urges a user to separately perform the suction recovery operation. An auto-suction timer is used, and when a suction recovery timing is reached, a user is urged to perform the suction recovery operation by the same method. In place of the suction recovery operation, a recovery mode as a combination of aging and wiping, with which an effect approximate to that of the suction recovery operation can be expected in terms of cleaning of the head face, may be executed.

As described above, the mode of performing print operations a plurality of number of times on a single recording medium is detected or recognized, and the recovery conditions and sequence are set in the unique multi mode, so that stable recording can be assured even when the plurality of ink recording heads are used.

THIRD EMBODIMENT

In this embodiment, a case will be explained below wherein the condition of a recovery sequence is changed according to the type or state of each ink recording head.

When a plurality of ink recording heads are used, the state of each ink recording head varies between a case wherein the ink recording head is initially used upon head exchange, and a case wherein the ink recording heads are used while repetitively and continuously performing recording operations and exchange operations. Initially, since ejection heaters are not sufficiently used, the surface of the head may be contaminated, and sufficient aging is required. In contrast to this, when the recording and exchange operations are continuously repeated, each ink recording head is subjected to sufficient aging by ejections, and no remarkable effect of another aging is expected. It is considered that such aging is wasteful in terms of ink consumption.

Upon detection of exchange of ink recording heads, the number of exchange times of the ink recording head to be used upon head exchange is stored in, e.g., a RAM, and the number of shots in aging is changed according to the number of exchange times with reference to Table 1 below. In this embodiment, when the head is exchanged for the first time, aging of 10,000 shots is performed. However, in the second and subsequent exchanges of the head, the number of shots in aging is decreased according to the number of exchange times. Thus, in a recording method using a plurality of ink recording heads, ejection can be stabilized, and ink consumption can be saved. The RAM for storing the number of exchange times may have an area for storing the numbers of exchange times in units of types of inks of the ink recording heads, and when the ink recording head of the same type is mounted, a counter may be reset.

TABLE 1

Aging Table According to State of Ink Recording Head

| No. of Exchange Times of Ink Recording Head | No. of Shots in Aging |
|---|---|
| 1 | 10,000 |
| 2 to 10 | 5,000 |
| 10 to 20 | 3,000 |
| more than 20 | 1,000 |

Similarly, the wiping interval can be controlled by counting the number of exchange times of the ink recording head. A water repellant is coated on the face of the ink recording head. The water repellant is weak against friction, and as the number of times of wiping is increased, the water repellant is gradually peeled. In the ink recording head from which the water repellant is peeled, a possibility of deposition of an ink around nozzles is increased, thus causing an ejection error. In order to decrease the deposition amount of the ink, wiping may be performed more frequently. When recording operations are performed a plurality of number of times on a single recording medium, color mixing may be caused by wiping. For this reason, the wiping frequency cannot simply be increased.

In this embodiment, the use frequency of the ink recording head is predicted by counting the number of exchange times of the ink recording head, and the wiping interval is controlled according to Table 2 below. Thus, the state of each ink recording head can be predicted without requiring a new wiping counter, and the wiping timing can be set for each recording head in correspondence with the predicted state. In pre-ejection, capping, and the like, recovery conditions can be set according to each ink recording head by the same method as described above.

TABLE 2

Wiping Interval Table According to State of Ink Recording Head

| No. of Exchange Times of Ink Recording Head | Print Duty Count |
|---|---|
| less than 50 | 8,000 |
| 50 to 100 | 7,000 |
| 100 to 200 | 6,000 |
| 200 to 300 | 5,000 |
| more than 300 | 4,000 |

As described above, ejection can be stabilized by counting the number of exchange times of the ink recording head inherent to the mode for performing recording operations a plurality of number of times on a single recording medium, and high image quality can be maintained at low cost. Sequences other than a sequence for setting recovery conditions in the multi mode are the same as those in the second embodiment.

FOURTH EMBODIMENT

In this embodiment, a case will be explained below wherein the condition of a recovery sequence is changed according to the environmental temperature or the temperature of an ink recording head.

The state of each ink recording head varies depending on the environmental temperature. In a high-temperature environment, the ink ejection amount is increased, and the number of bubbles, which cannot be caused to disappear in nozzles, is increased, thus easily causing an ink omission state. Conversely, in a low-temperature environment, ejection is not easily performed, and the ink ejection amount is decreased. Thus, in order to perform stable ejection while maintaining high image quality, the recovery condition must be set according to the environmental temperature or the temperature of the ink recording head. In a mode for performing recording operations a plurality of number of times on a single recording medium (multi mode), the environmental temperature or the temperature of ink recording heads is detected upon exchange of ink recording heads, and the recovery condition is set according to the temperature of each ink recording head. Since the recovery condition is set upon exchange of ink recording heads, an optimal condition for an ink recording head to be used next can be set.

The detailed recovery conditions will be described below. In the multi mode, aging upon exchange of ink recording heads is performed to reliably perform recording as compared to a normal mode using a single ink recording head (normal mode). However, in a high-temperature environment, generation of bubbles is promoted by aging, thus causing an ink omission state. In a low-temperature environment, the temperature of the ink recording head is increased by executing aging for the purpose of maintaining high image quality, thereby minimizing a decrease in ejection amount. Therefore, the number of shots in aging can be set in units of ink recording heads according to the environmental temperature or the temperature of the ink recording head to be used next upon exchange of ink recording heads. Table 3 below summarizes the setting conditions. Thus, the adverse affect of aging in the high-temperature environment can be eliminated as much as possible, and aging in the low-temperature environment can be effectively performed.

TABLE 3

Aging Table According to Temperature

| Environmental Temperature or Temperature of Ink Recording Head (° C.) | No. of Shots in Aging |
|---|---|
| less than 10 | 20,000 |
| 10 to 15 | 15,000 |
| 15 to 20 | 10,000 |
| 20 to 25 | 5,000 |
| 25 to 30 | 3,000 |
| 30 to 35 | 1,000 |
| more than 35 | 500 |

When a suction recovery timing is informed to a user in the multi mode, the timing can be set by the same method according to the environmental temperature or the temperature of the ink recording head to be used next upon exchange of ink recording heads. In a high-temperature environment, bubbles are easily generated, and when a print operation is performed for a long period of time, an ink omission state may be easily caused. When the suction timing is set for each ink recording head according to the environmental temperature or the temperature of the ink recording head to be used next upon exchange of ink recording heads with reference to Table 4 below, an optimal recovery condition can be set. In pre-ejection, wiping, capping, and the like, optimal recovery conditions can be set by the same method according to the environmental temperature or the temperature of the ink recording head.

TABLE 4

Suction Timer Table According to Temperature

| Environmental Temperature or Temperature of Ink Recording Head (° C.) | Suction Timer Interval (hours) |
|---|---|
| less than 10 | 72 |
| 10 to 15 | 48 |
| 15 to 20 | 36 |
| 20 to 25 | 24 |
| 25 to 30 | 12 |
| 30 to 35 | 8 |
| more than 35 | 4 |

As described above, since the recovery conditions are set according to the environmental temperature or the temperature of the ink recording head upon exchange of ink recording heads inherent to the multi mode, ejection can be stabilized under conditions optimal for the enviroment. Sequences other than a sequence for setting recovery conditions in the multi mode are the same as those in the second embodiment.

As described above, according to the second to fourth embodiments, in an ink jet recording apparatus for performing recording by ejecting an ink, since recovery operations are performed under proper conditions in an ink recording mode for performing recording operations a plurality of number of times on a single recording medium, the problem of color mixing can be solved, and a color image in at least two colors can be stably and easily formed while maintaining high image quality.

FIFTH EMBODIMENT

An embodiment wherein a host computer connected to a recording apparatus, dip switches, operation keys on an operation panel, a memory means provided to the recording apparatus, or the like is used as designation information generation means, and an image formation control condition is varied according to designation information will be described below. The designation information of this embodiment is, e.g., the order of image recording processes from the designation information generation means.

Figure 23A:
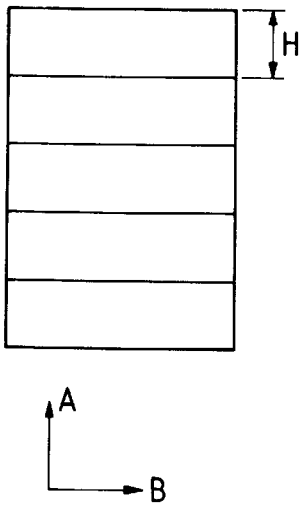
FIGS. 23A to 23C are views showing banding positions of recording scans according to the fifth embodiment of the present invention.
Figure 23B:
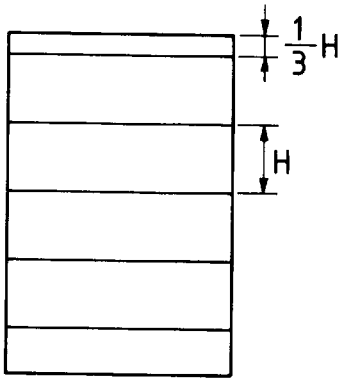
Figure 23C:
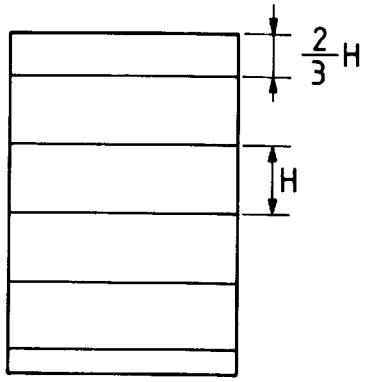

FIGS. 23A to 23C show banding positions of recording scans of a recorded image. In FIGS. 23A to 23C, the convey direction of a recording medium is denoted by reference symbol A, and the scanning direction of a recording head is denoted by reference symbol B. A recording head of the present invention has 64 ejection orifices at 1/360-inch intervals, and the recording width per scan is about 4.5 mm. H in FIGS. 23A to 23C corresponds to this recording width per scan.

FIG. 23A shows the banding position of recording scans in a first process, FIG. 23B shows the banding position of recording scans in a second process, and FIG. 23C shows the banding position of recording scans in a third process. The banding positions of the recording scans in these processes are shifted by 1/3H in the convey direction of the recording medium.

In conventional image formation control, when an ink is ejected by causing a change in state in the ink by heat, a nonuniform temperature distribution is formed in the ejection orifice array of the recording head. In particular, the temperature at the end portions of the ejection orifice array is lower than the central portion, and the flying ink droplet amounts of these portions are decreased. As a result, an image density at the end portions of the ejection orifice array corresponding to the banding positions of recording scans is decreased, thus deteriorating image quality. Furthermore, a white or black stripe may often be formed at a banding position between the first and second recording scans due to the problem of conveying precision of a recording medium of the recording apparatus.

According to this embodiment, when the banding positions of recording scans are changed in the respective color image recording processes, a decrease in image density at the banding position, and formation of the white or black stripe can be minimized, and a good image can be obtained.

In this embodiment, the banding positions in the first to third processes may be changed in the order of FIGS. 23C, 23B, and 23A.

The same effect as described above can be expected when an image formation control condition is controlled using image recording colors or the number of image recording colors as the above-mentioned designation information.

SIXTH EMBODIMENT

In this embodiment, a case will be described below wherein image formation condition control different from the fifth embodiment is executed.

Figure 24A:
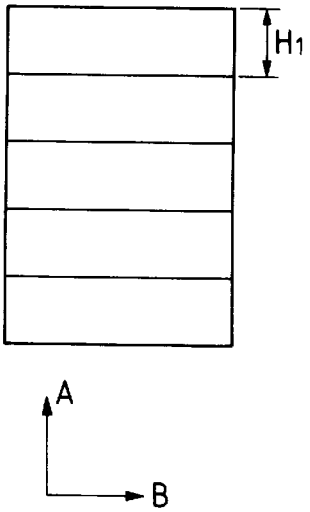
FIGS. 24A to 24C are views showing the recording widths of recording images according to the sixth embodiment of the present invention.
Figure 24B:
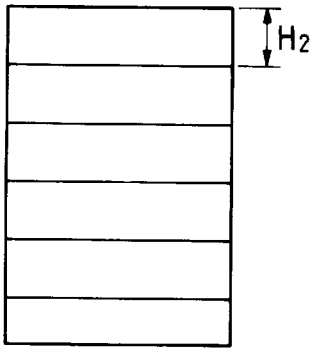
Figure 24C:
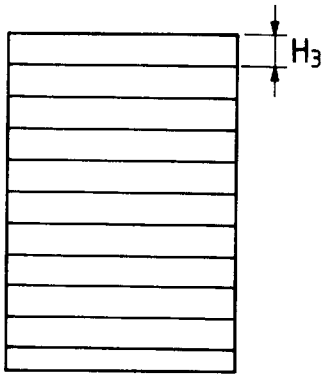

FIGS. 24A to 24C show the recording widths of a recorded image. In FIGS. 24A to 24C, the convey direction of a recording medium is denoted by reference symbol A, and the scanning direction of a recording head is denoted by reference symbol B. A recording head of the present invention has 64 ejection orifices at 1/360-inch intervals, and the recording width per scan is about 4.5 mm. H1 in FIG. 24A corresponds to this recording width per scan.

FIG. 24A shows the recording width in a first process, FIG. 24B shows the recording width in a second process, and FIG. 24C show the recording width in a third process. These recording widths satisfy a relation $H3<H2<H1$. The recording widths in the respective processes preferably have a difference of one dot or more.

Furthermore, in the first to third processes, if control for decreasing the recording width to increase the number of divisions of an image is performed in a later process, a stripe between adjacent scans tends to become conspicuous. Therefore, recording operations are preferably performed under a division condition opposite to that described above, i.e., in the order of FIGS. 24C, 24B, and 24A.

Upon execution of the image formation condition control according to this embodiment, the same effect as in the above embodiment can be expected.

SEVENTH EMBODIMENT

In this embodiment, a case will be described below wherein a host computer connected to a recording apparatus, dip switches, operation keys on an operation panel, a memory means provided for the recording apparatus, or the like is used as designation information generation means, and an image formation control condition is varied according to designation information. In this embodiment, the designation information is the number of image recording colors from the designation information generation means.

Figure 25:
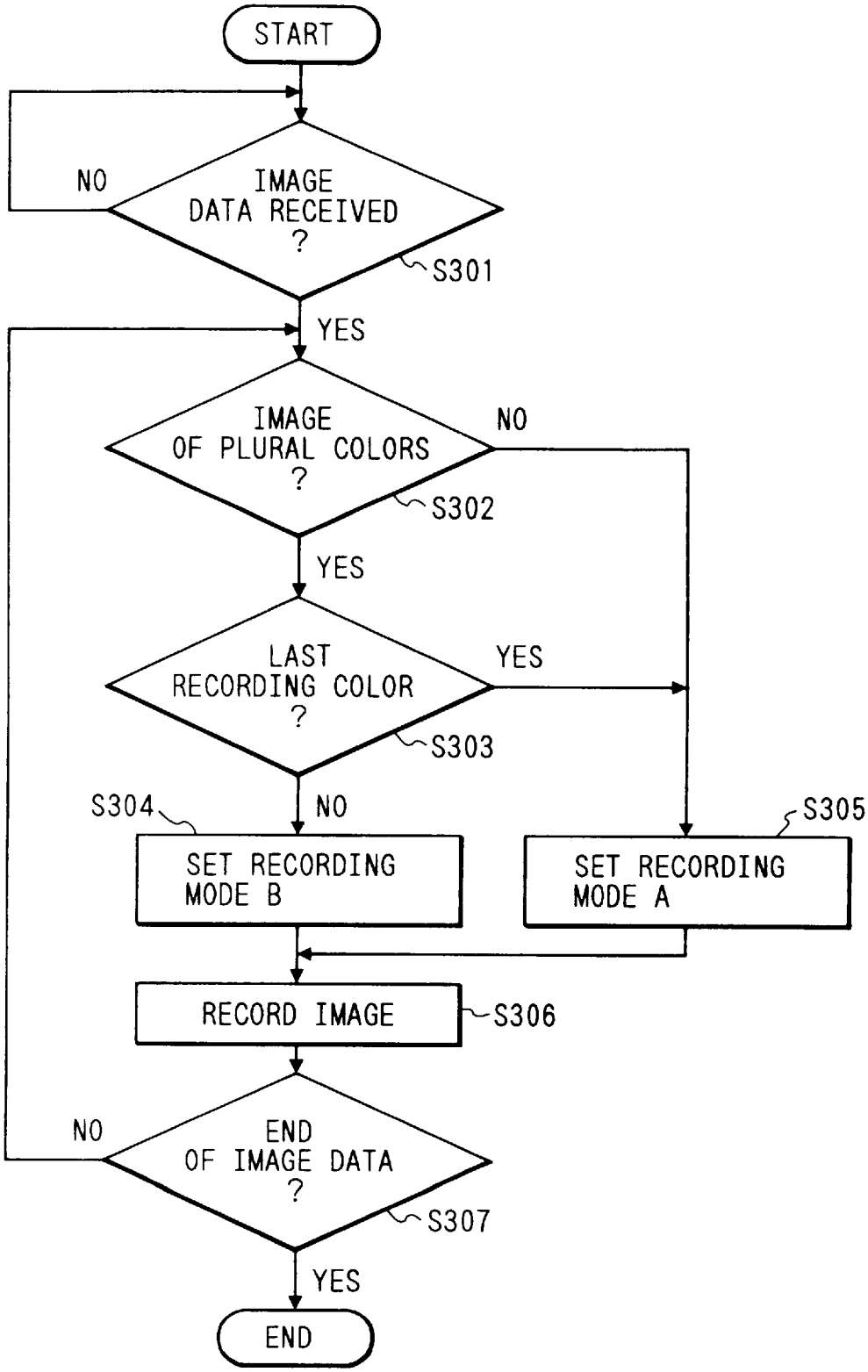
FIGS. 25 and 26 are flow charts showing control sequences of an image formation condition according to the seventh embodiment of the present invention.

FIG. 25 is a flow chart showing control of this embodiment.

In step S301, it is checked if image data is received. If YES in step S301, it is checked in step S302 if the image data represents an image of a plurality of colors. If NO in step S302, the flow advances to step S305 to set a recording mode A, and image recording is performed in step 306 according the recording mode set in step S305. However, if YES in step S302, the flow advances to step S303. If the last recording color is determined in step S303, the recording mode A is set in step S305, and image recording is performed in step 306 according the recording mode set in step S305. Otherwise, the flow advances to step S304 to set a recording mode B, and image recording is performed in step 306 according the recording mode set in step S304. If the end of image data is determined in step S307, the flow is ended; otherwise, the flow returns to step S302.

Figure 26:
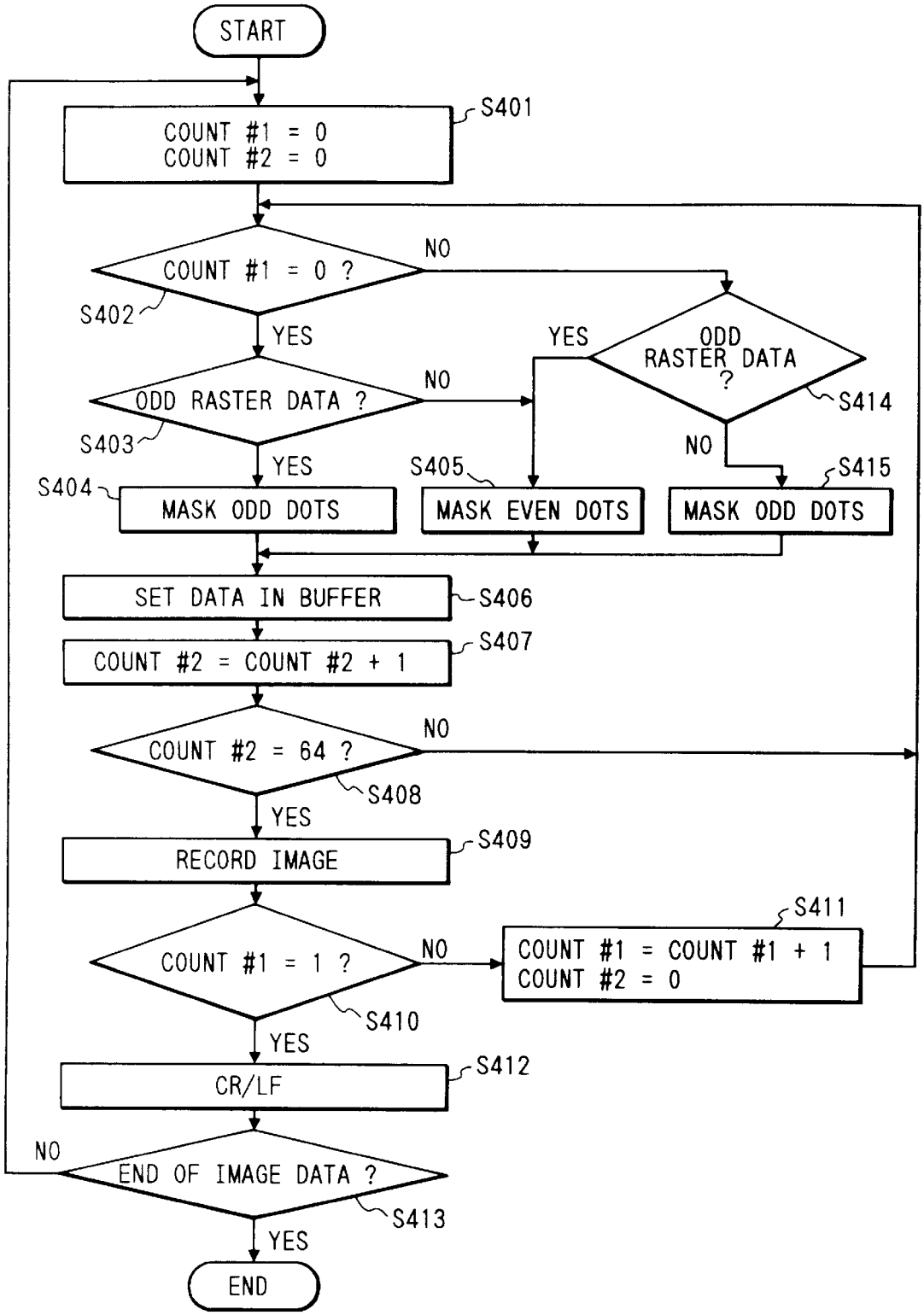

FIG. 26 shows print control in the recording mode B. In step S401, "0" is set in counters #1 and #2. The content of the counter #1 indicates the recording scan number on a single line, and the content of the counter #2 indicates the raster number. It is then checked in step S402 if the content of the counter #1 is 0. If YES in step S402, i.e., if the first recording scan is detected, the flow advances to step S403 to check if a recording image signal corresponds to odd raster data. If it is determined based on the content of the counter #2 that the recording image signal corresponds to odd raster data, odd dots are masked by a control circuit in step S404, and recording data is set in a recording buffer memory in step S406. On the other hand, if it is determined in step S403 that the recording image signal corresponds to even raster data, even dots are masked by the control circuit in step S405, and recording data is set in the recording buffer memory in step S406. Thus, mask processing of data for one raster is completed.

In step S407, the count value of the counter #2 is incremented by 1, i.e., is set to indicate the next raster. If it is determined in step S408 that the counter #2 presents a predetermined count value (in this embodiment, 64 rasters=1 line), recording for one scan is performed in step S409, and it is then checked in step S410 if the count value of the counter #1 is 1. If NO in step S410, i.e., if the first recording scan is detected, the count value of the counter #1 is incremented by 1 and the counter #2 is reset in step S411. Thereafter, the flow returns to step S402 for the second recording scan.

In the second recording scan, since the count value of the counter #1 is 1, the flow advances to step S414. The flow then advances to step S405 or S415 depending on the checking result in step S414 (i.e., odd or even raster), and predetermined dots opposite to the first recording scan are masked by the control circuit. Thereafter, the flow advances to step S406.

Upon completion of the second recording scan, carriage return and line feed operations are performed in step S412, and steps S401 to S413 are repeated until image data is ended.

Under the above-mentioned control, in the recording mode B, a thin-out image is recorded in the first recording scan, and an image is recorded in the second recording scan to compensate for the thin-out image in the first recording scan (i.e., two-pass recording operations are performed). In the recording mode A, an image is recorded by a normal one-pass recording operation.

In the recording apparatus and recording method used in the present invention, as an image recorded in an immediately preceding process is sufficiently fixed and dried and is stable, the quality of an image recorded later can be improved.

Therefore, this embodiment is effective for a case wherein a recording medium on which a previously recorded image is formed is discharged after the image is sufficiently fixed and dried since a plurality of recording processes are executed even when an apparatus, which has a high recording speed in normal image formation control, is used, i.e., a case wherein a plurality of recording colors are to be used.

In order to sufficiently fix and dry a recorded image in an immediately preceding process upon discharge of a recording medium, a rest time may be set in units of recording scans to prolong the recording scan interval in addition to the above-mentioned image formation control condition, so that recording can be performed while fixing and drying a recorded image.

In a recording apparatus or method with a predetermined recording order of recording colors, image formation control other than the last recording color may be changed. In this case, the same effect as described above can be expected if the order of image recording processes or image recording colors is used as designation information. Furthermore, when image recording colors are used as the designation information, a signal from an ink recording means attached to the recording apparatus may be used as the information generation means.

EIGHTH EMBODIMENT

Figure 27A:
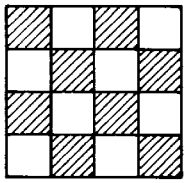
FIGS. 27A and 27B are views showing mask patterns for masking a recording image.
Figure 27B:
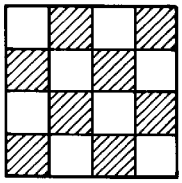
Figure 28A:
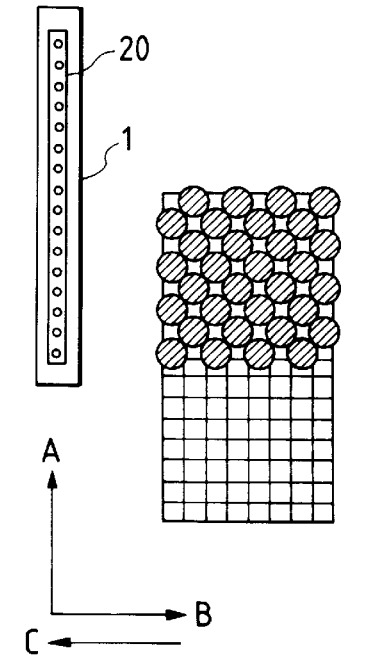
FIGS. 28A to 28C are views showing image recording processes according to the eighth embodiment of the present invention.
Figure 28B:
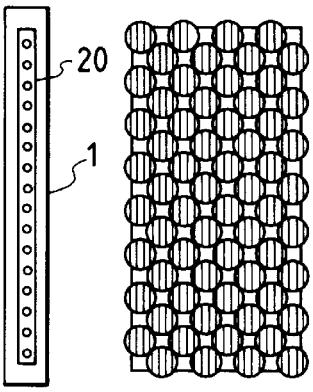
Figure 28C:
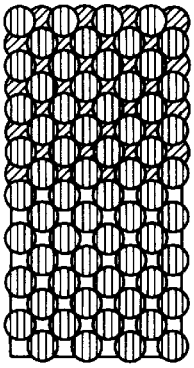

FIGS. 27A and 27B show patterns for masking a recording image. In each pattern, a hatched portion is a portion to be masked of a signal, and a blank portion is a recordable portion. Each mask pattern is constituted by a 4×4 matrix, and an image signal is masked upon repetition of these patterns in both the up-and-down and right-and-left directions. FIGS. 28A to 28C show image recording processes in a case wherein an ejection orifice array of a recording head is equally divided into two regions (n=2). In FIGS. 28A to 28C, the convey direction of a recording medium is denoted by reference symbol A, and the scanning directions of the recording head are denoted by reference symbols B and C.

Recording data is masked according to the mask pattern shown in FIG. 27A, and the upper-half image (FIG. 28A) is recorded by the first recording scan. The recording medium is conveyed in the direction A by a width (eight nozzles in FIG. 28A) of a region obtained by equally dividing the ejection orifice array (16 nozzles in FIG. 28A) into two regions. Then, recording data is masked according to the mask pattern shown in FIG. 27B, and an image (FIG. 28B) is recorded by scanning the recording head in the direction C. As a result of the above-mentioned two recording processes, an image (FIG. 28C) is formed. The image shown in FIG. 28C is completed by two recording scans respectively using upper eight nozzles and lower eight nozzles. Thereafter, these recording processes are repeated to form an image.

In this embodiment, a recording medium is conveyed by a width of a region obtained by equally dividing the ejection orifice array of the recording head into n regions, and a recording signal is masked, so that the number of recording dots formed on the recording medium by ink ejection of the recording head becomes 1/n during one recording scan. Thus, since an image corresponding to the width of the region obtained by equally dividing the ejection orifice array into n regions is completed in n recording scans using n-equally divided different ejection orifice array regions, nonuniformity and a stripe at a boundary portion between adjacent scan lines, and variations in ink ejection amounts and landing precision of ink ejection orifices can be effectively eliminated.

In an apparatus, which mounts a plurality of color recording heads, and can simultaneously record a plurality of color images, when bidirectional recording is performed, since forward and backward scans have different recording orders (overlying order) on a recording medium, the hues of secondary and tertiary colors in color mixing are varied, thus deteriorating image quality. However, in a recording apparatus and method used in the present invention, since color-sequential image formation is performed, such a problem is not posed.

NINTH EMBODIMENT

In this embodiment, a case will be described below wherein DIP switches, operation keys on an operation panel, a detection switch arranged along a recording medium supply and convey path, switches in the form of transmission type photocouplers arranged to detect a transparency film, which is normally transparent, or the like is used as information generation means for generating identification information indicating whether a recording medium is a designated sheet or a special sheet such as a transparency film other than the designated sheet, and processing is executed according to identification information from these switches. The identification information indicating whether a recording medium is a designated sheet or a transparency film indicates the designated sheet when, e.g., the detection switch is ON.

Figure 29:
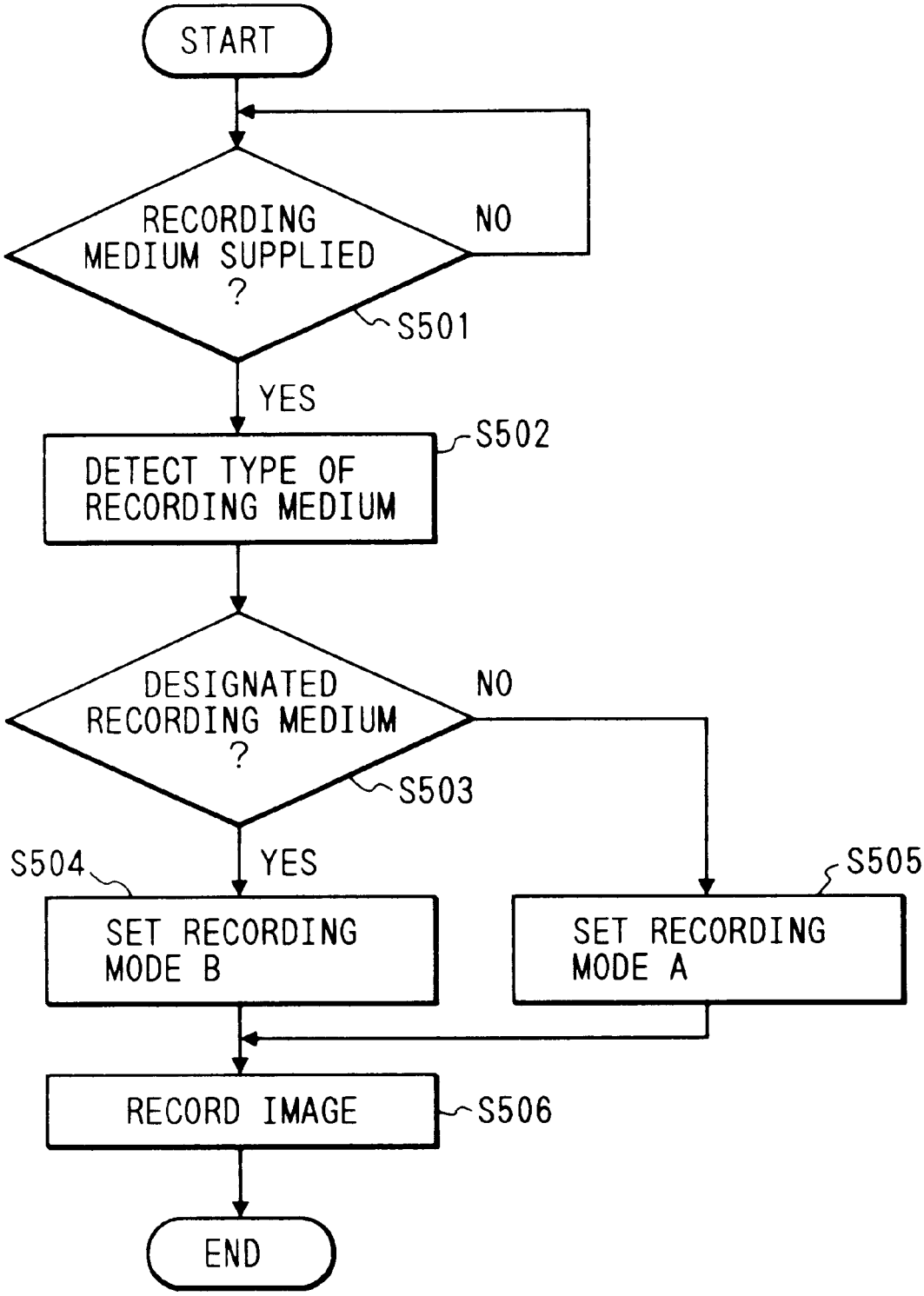
FIG. 29 is a flow chart showing a control sequence of an image formation condition according to the ninth embodiment of the present invention.

FIG. 29 is a flow chart showing control of this embodiment.

If it is determined in step S501 that a recording medium is supplied, the type of the recording medium is detected in step S502. In step S503, it is checked if the detected type of the recording medium indicates a designated recording medium. If YES in step S503, a recording mode B is set in step S504. However, if NO in step S503, a recording mode A is set in step S505. After the recording mode is set according to the detected information, an image is recorded according to the selected recording mode in step S506.

In a recording head used in the present invention, the ink ejection amount is increased to increase an ink coverage on a recording medium, so that a sufficient image density can be obtained on a normal high-quality paper sheet.

On the other hand, a transparency film available on the market as one for an ink jet recording apparatus is normally formed by coating a medium having an ink absorbency on a transparent film. Since this film has a poor ink absorbency and a low ink reception amount, if recording is performed under normal image formation control using the above-mentioned recording head, a beading phenomenon (an ink repelled on the film surface forms a bead shape) or blurring occurs, and deterioration of image quality is observed. However, when the control of this embodiment is executed, image quality can be remarkably improved.

When color mixing recording is performed using a plurality of ink colors, if the ink amount exceeds the limit of the ink reception amount, a problem of ink blurring or a non-fixing phenomenon occurs. In order to solve this problem, a second image obtained by mirror-image processing is recorded in a second process on the rear surface side of an image formed in a first process.

An image may be formed on a recording medium having a small ink absorption amount by recording thin-out recording information.

In this embodiment, the image formation control method of the transparency film has been described. This embodiment can also be applied to control for a thick sheet such as a post card, and a special recording medium such as a cloth.

On a recording medium which has a large ink absorption amount but has a low image density, overlay recording may be performed by scanning an identical position a plurality of number of times so as to increase the density.

10TH EMBODIMENT

In this embodiment, a case will be described below wherein only designated image information is selectively processed.

Figure 30:
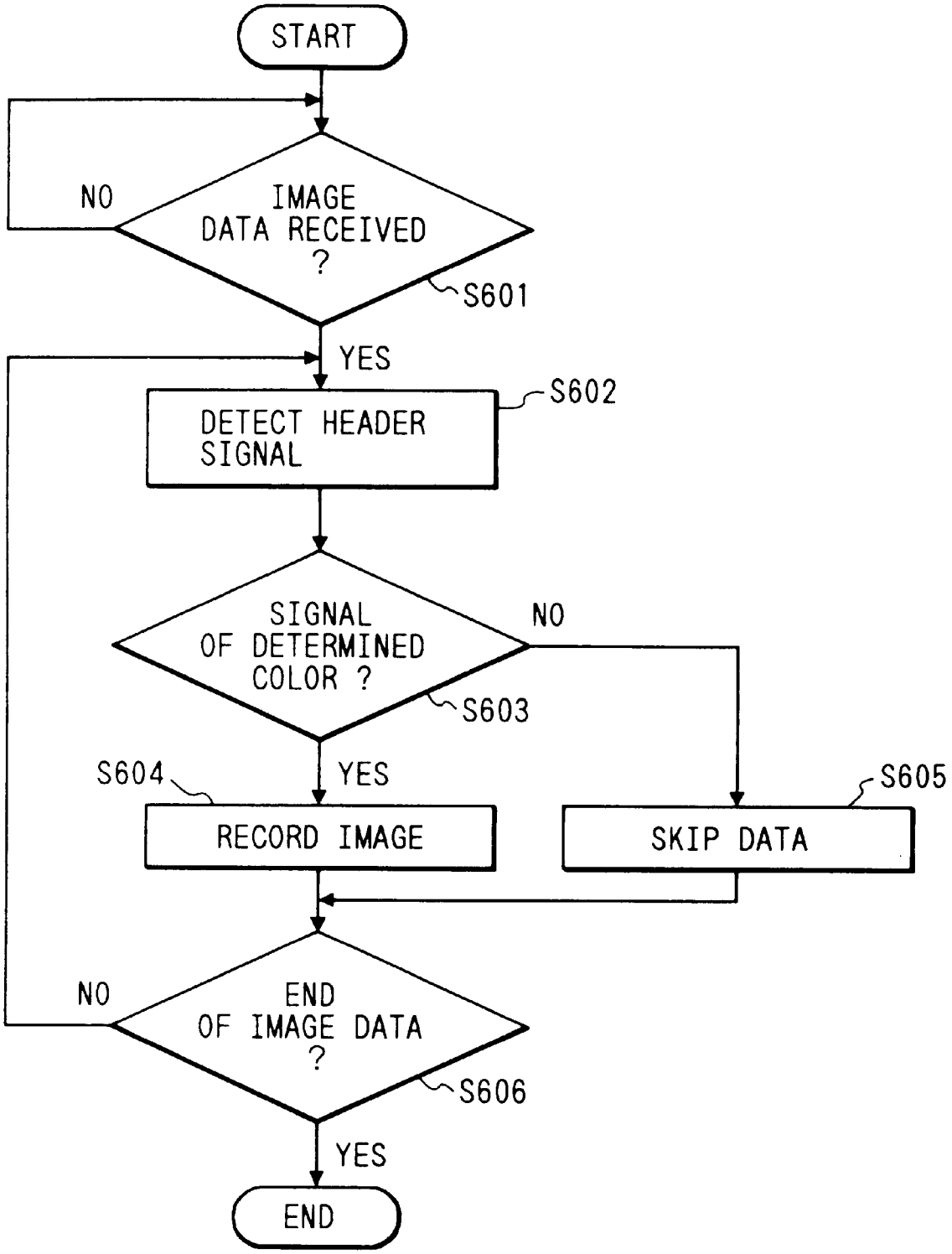
FIG. 30 is a flow chart showing control according to the 10th embodiment of the present invention.

FIG. 30 is a flow chart showing processing of image recording information of this embodiment. In FIG. 30, if it is determined in step S601 that image data is received, a header signal of the received image data is detected and analyzed in step S602. If it is determined in step S603 that the detected header signal is a signal of a predetermined color, image recording is performed in step S604. However, if it is determined in step S603 that the detected header signal is a signal of a color other than a predetermined color, data of a predetermined amount is skipped in step S605. Thereafter, steps S602 to S606 are repeated until the end of image data is determined in step S606.

This embodiment is effective since a monochrome recording apparatus can use a recording control command signal similar to that of an expensive apparatus, which mounts a plurality of color recording heads, and can simultaneously record a plurality of color images.

11TH EMBODIMENT

In this embodiment, a case will be described below wherein a host computer connected to a recording apparatus, dip switches, operation keys on an operation panel, a memory means provided to the recording apparatus, or the like is used as designation information generation means, and an image formation control condition is varied according to designation information. In this embodiment, the designation information is the number of image recording colors from the designation information generation means.

Figure 31:
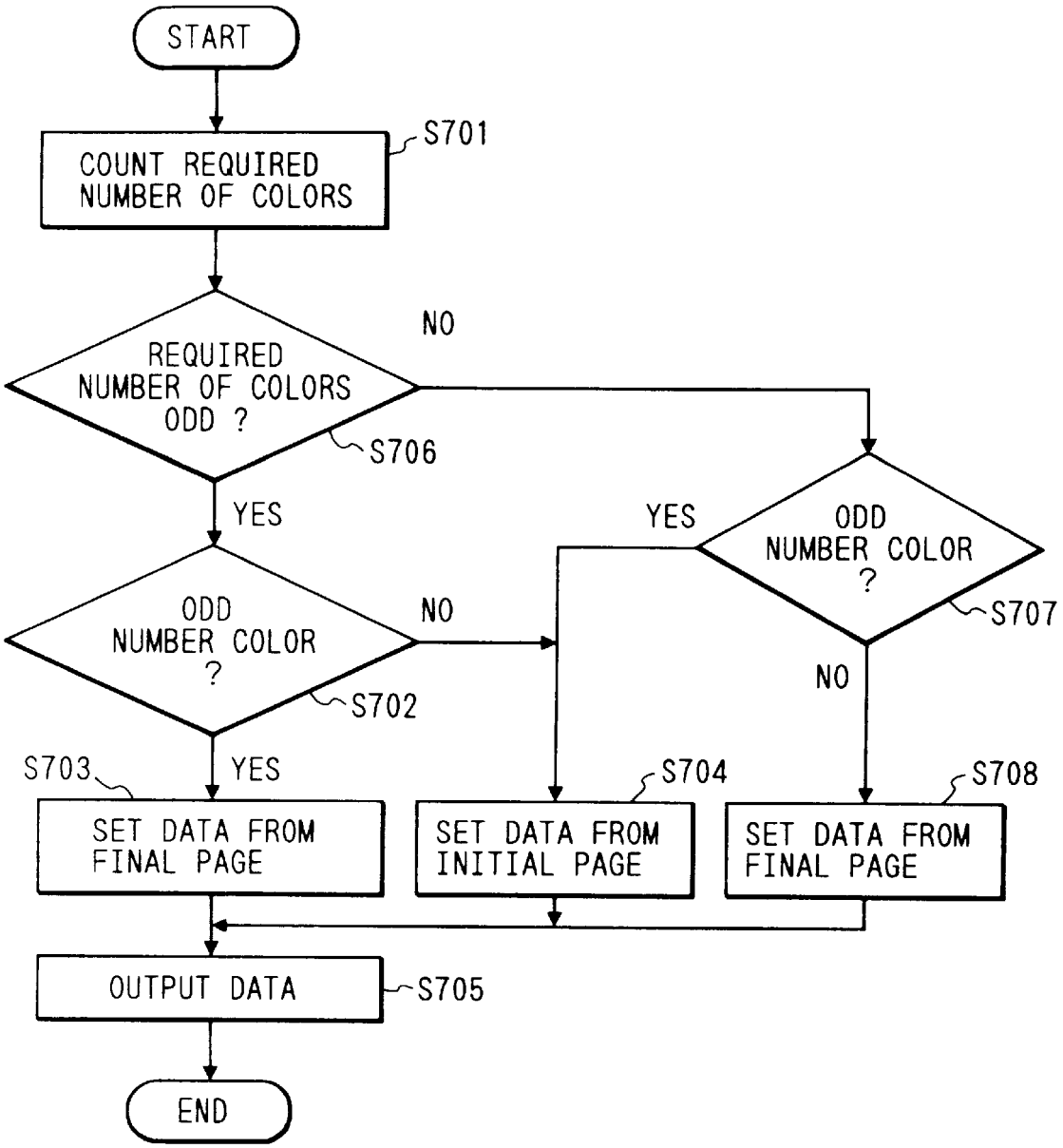
FIG. 31 is a flow chart showing processing control of image recording information according to the 11th embodiment of the present invention.

FIG. 31 is a flow chart showing processing of image recording information of this embodiment. In FIG. 31, the required number of colors is counted in step S701. It is checked in step S706 if the counted number of colors is an odd number. If YES in step S706, and if it is determined in step S702 that an odd number color is to be recorded, data is set in the order from a final page to an initial page in step S703. On the other hand, if it is determined in step S702 that an even number color is to be recorded, data is set in the order from an initial page to a final page in step S704. After data is set in step S703 or S704, data is output in the order of set pages in step S705. More specifically, when the number of recording colors is an odd number, pages of image data of an odd number color to be recorded are set in the reversed order. On the other hand, if the counted number of colors is an even number, pages of image data of an even number color to be recorded are set in the reversed order (steps S707 and S708).

Figure 32A:
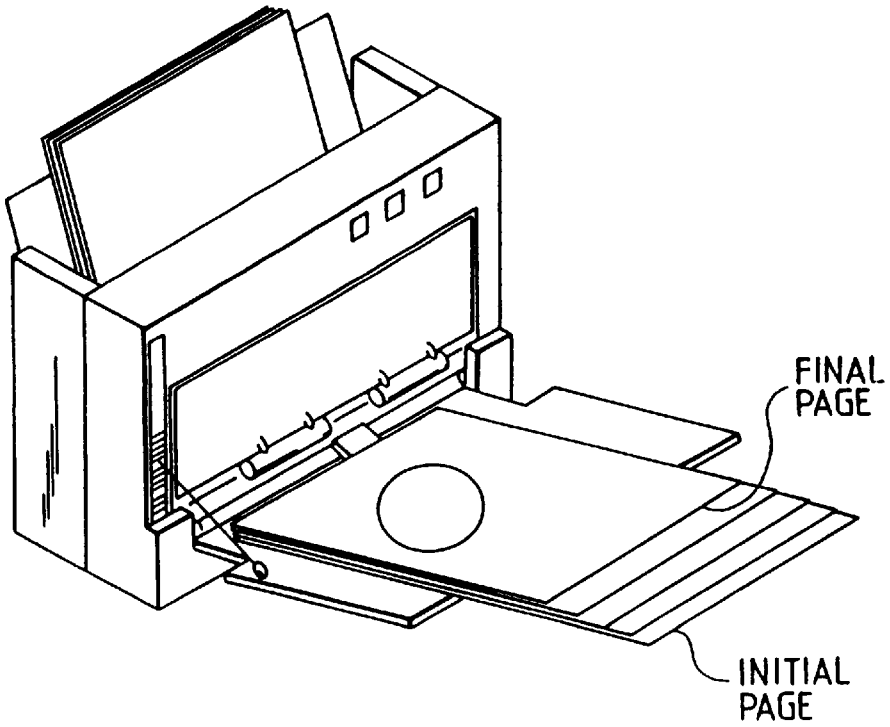
FIGS. 32A and 32B are perspective views respectively showing an image recording state under the processing control shown in FIG. 31, and a discharged state of a recording medium.
Figure 32B:
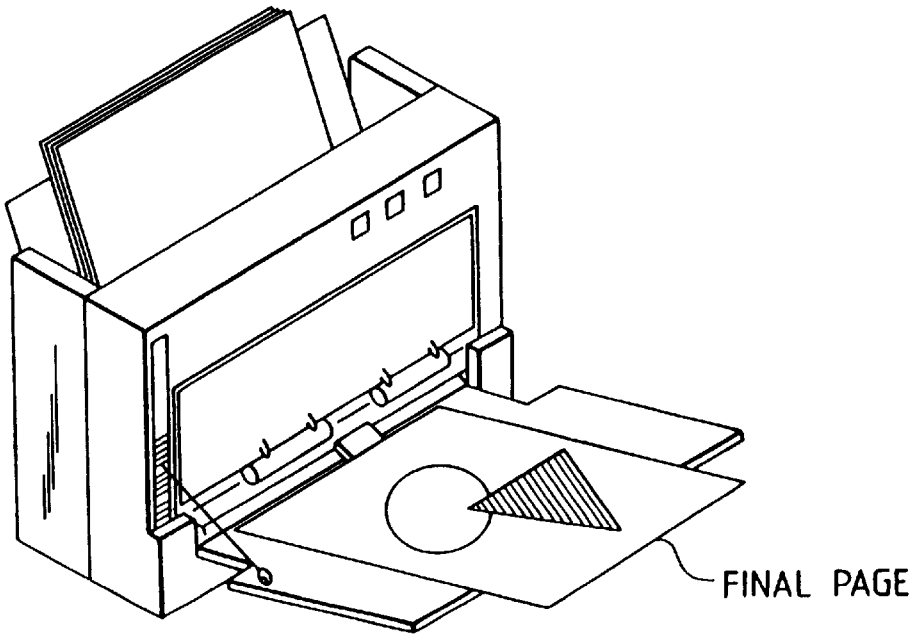

In this embodiment, even when a recording apparatus, which discharges a recorded recording medium facing up, as shown in FIGS. 32A and 32B, is used, the order of pages need not be changed in units of recording processes.

FIG. 32A shows a first process, and FIG. 32B shows a second process. In this case, since the number of colors is two, recording from the initial page is performed in the first process, and recording from the final page is performed in the second process. Note that the second process shown in FIG. 32B corresponds to a state wherein recording of the first page is completed.

When the order of image recording processes or the recording order of recording colors is determined, the same effect as described above can be obtained when image recording colors are used as designation information. When image recording colors are used as designation information, the designation information generation means may be a signal from an ink recording means mounted on a recording apparatus.

12TH EMBODIMENT

A case will be explained below wherein a binarizing condition is changed according to the order of image recording processes.

When multi-value image data is converted into binary image data by known threshold value processing using a dither matrix, different threshold value matrices are used according to the order of image recording processes. In this case, different screen angles may be used according to the order of image recording processes.

When an image is reproduced using a fixed pattern like in dither processing, color nonuniformity caused by moiré occurs on a halftone image in image formation using a plurality of colors due to mechanical influences of, e.g., skew or conveying nonuniformity upon conveying of a recording medium. In contrast to this, according to this embodiment, since different threshold value matrices are used in accordance with the order of image recording processes, generation of moiré can be prevented.

The same effect as described above can be expected when a threshold value matrix is varied according to image recording colors.

13TH EMBODIMENT

Figure 33A:
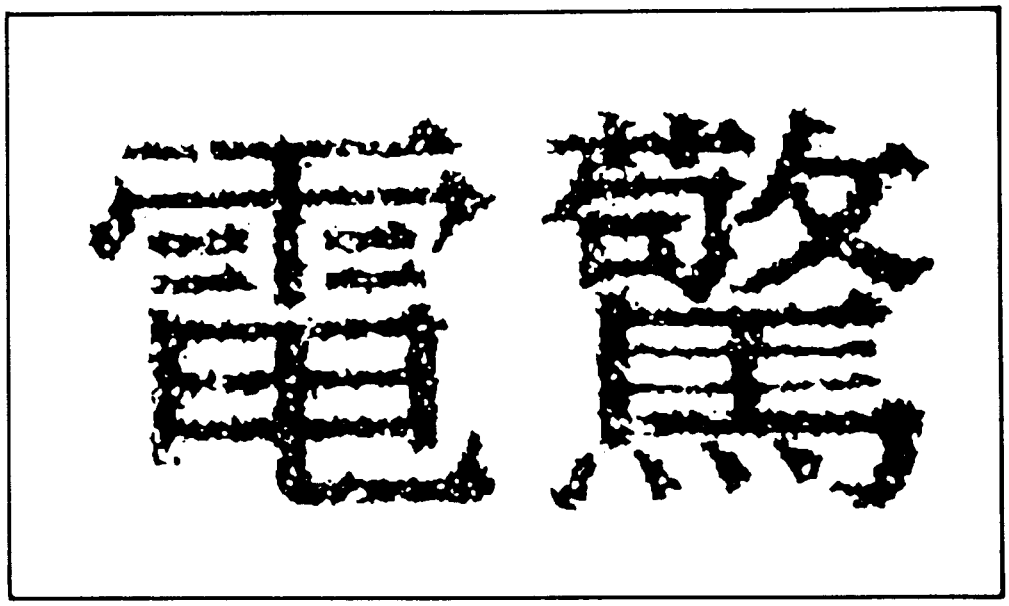
FIGS. 33A to 34B are views for explaining an image recorded by a recording method according to the 13th embodiment of the present invention, and blurring of the image.
Figure 33B:
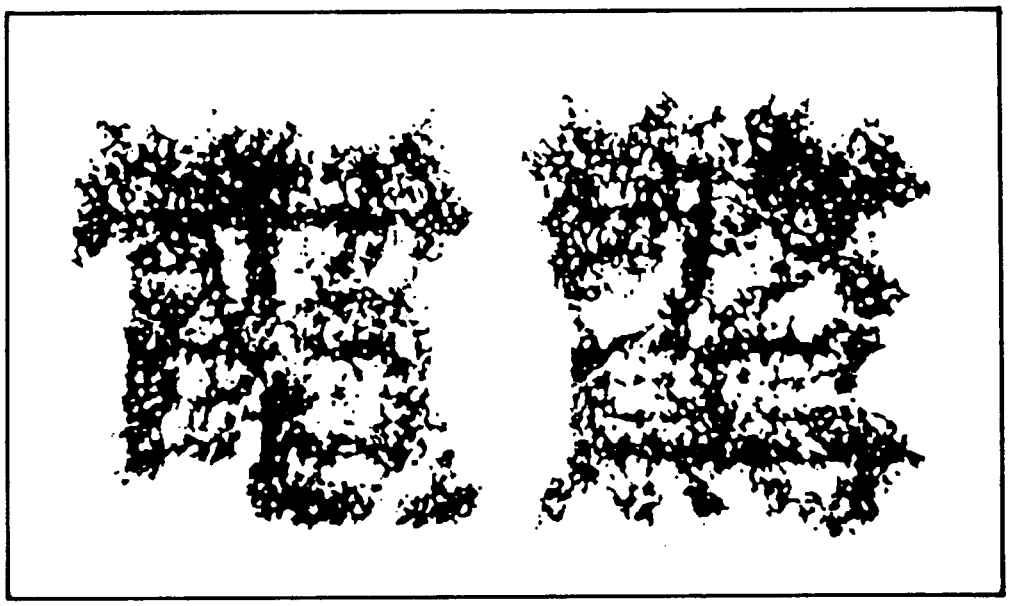

FIGS. 33A and 33B show images recorded according to this embodiment. The image in FIGS. 33A or 33B is obtained by recording a background having a high dot density in yellow (Y), and recording letters "[illegible]" in black (Bk).

The image shown in FIG. 33A is obtained by recording the yellow (Y) background having a high dot density first, and then, recording the black (Bk) letters "[illegible]" having a low dot density. The image shown in FIG. 33B is obtained by recording the black (Bk) letters "[illegible]" having a low dot density first, and then, recording the yellow (Y) background having a high dot density. In either of FIG. 33A or 33B, after an image formed in the first recording process is sufficiently stabilized and fixed, the second image recording process is performed.

However, when recording is performed by the method of FIG. 33B, the letters are considerably blurred to an illegible level.

The composition of an ink used in a recording apparatus of the present invention is equivalent to the following composition in any color.

| | |
|---|---|
| dye | 2.5 wt. % |
| diethylene glycol | 10.0 wt. % |
| glycerin | 10.0 wt. % |
| ethyl alcohol | 5.0 wt. % |
| water (distilled water) | 72.5 wt. % |

Recording was performed by changing the recording order of colors using the inks having the above-mentioned composition. However, the recording color order and blurring had no correlation therebetween, and a good image was obtained when a color having a high dot density was recorded first in any combination of colors.

The reason for this will be explained below with reference to FIGS. 34A and 34B.

Figure 34A:
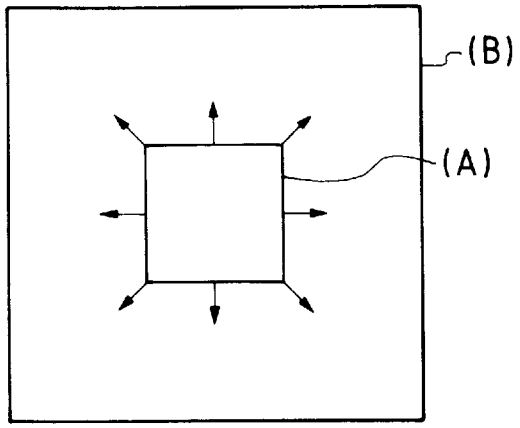
Figure 34B:
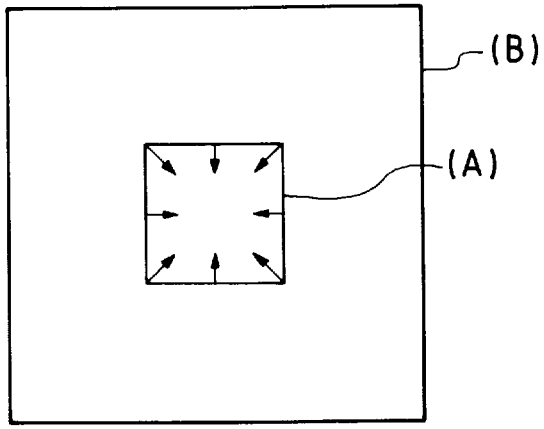

In FIGS. 34A and 34B, (A) represents an image having a low dot density, and (B) represents an image having a high dot density. FIG. 34A shows a case wherein the image (A) having a low dot density is recorded first, and thereafter, the image (B) having a high dot density is recorded. FIG. 34B shows a case wherein the image (B) having a high dot density is recorded first, and thereafter, the image (A) having a low dot density is recorded.

When the images are recorded in the order of FIG. 34A, the image (A) is damped again in the recording process of the image (B). In this case, since a water-soluble dye is used, the stably fixed dye is dissolved again, and is blurred in the directions of arrows, thus destroying the shape of the image (A). On the other hand, when recording is performed in the order of FIG. 34B, the stably fixed dye recorded in the first recording process is dissolved by the next recorded ink solvent in a portion of the image (B) corresponding to the image (A), and is blurred. In this case, however, since the color of the image (A) is originally formed by mixing the colors of the images (A) and (B), the adverse effect due to blurring is very small. Therefore, a good image, which is less affected by blurring, can be obtained when recording is performed in the order from an image color having a high dot density.

Figure 35:
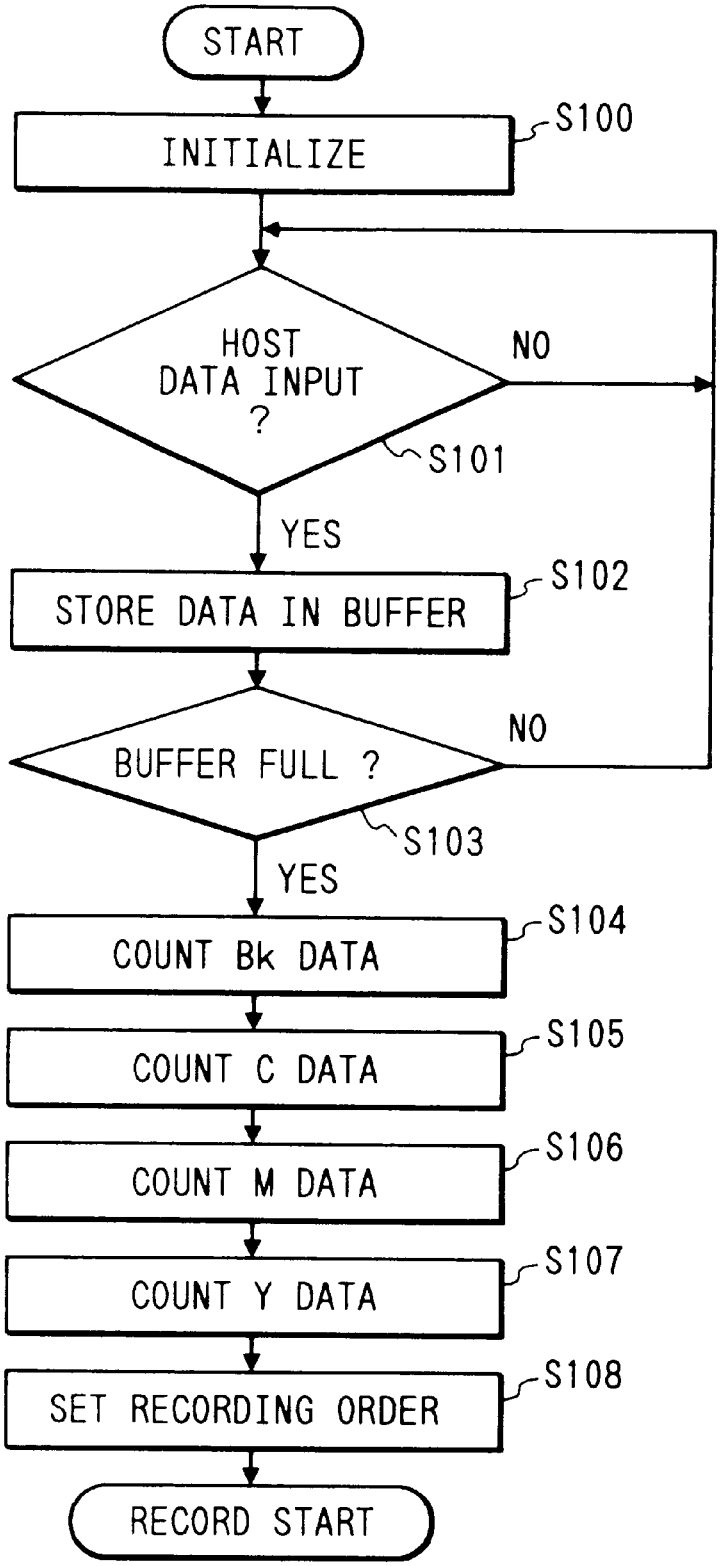
FIG. 35 is a flow chart showing a recording processing sequence in the 13th embodiment.

FIG. 35 shows a processing sequence according to the present invention, which is practiced based on the above description. In this embodiment, a case will be explained below wherein an image is recorded using four color inks, i.e., cyan (C), magenta (M), yellow (Y), and black (Bk).

In step S100, a control unit is initialized. In step S101, the control waits for control commands and recording data input from a host apparatus connected to the recording apparatus while monitoring the inputs via an interface. If it is determined in step S101 that recording data is input from the host apparatus, the input recording data is stored in a reception buffer (step S102). Steps S101 to S103 are repeated until recording data for a predetermined amount (one page in this embodiment) is received from the host apparatus.

If the end of reception is determined in step S103, the data in the buffer are counted in units of colors in steps S104 to S107 so as to discriminate recording color information having a high dot density. Furthermore, in step S108, the recording data counts are checked, and the recording order is set, so that image recording is performed in the order from recording data having the largest count, e.g., in the order of C→M→Y→Bk if Bk<Y<M<C. Then, the recording data are output to a recording head in this order.

Therefore, a cyan (C) image is recorded in the first recording process, a magenta (M) image is recorded in the second recording process, a yellow (Y) image is recorded in the third recording process, and then, a black (Bk) image is recorded in the fourth recording process. In this embodiment, since recording is performed in the order from an image color having a high dot density, a good image which is less affected by blurring can be obtained.

14TH EMBODIMENT

Figure 36:
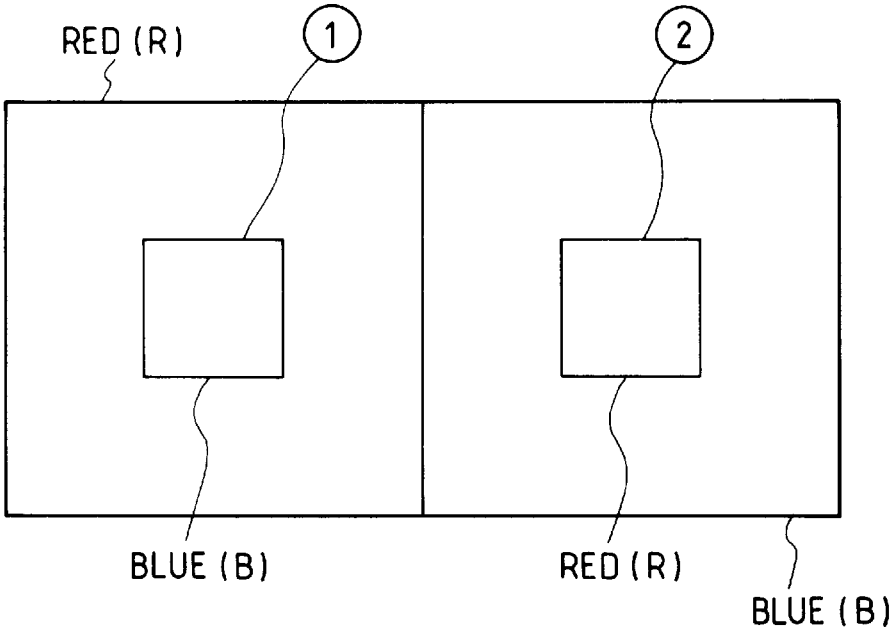
FIG. 36 is a view showing an image having both high- and low-dot density portions.

FIG. 36 shows an image in which portions having high and low dot densities are mixed. In this case, blurring occurs even when the recording order is changed.

A red (R) ink is obtained by mixing magenta (M) and yellow (Y), and a blue (B) ink is obtained by mixing cyan (C) and magenta (M). Therefore, in a blurred portion, cyan (C), magenta (M), and yellow (Y) are mixed, and gray or black (Bk) appears in this portion due to subtractive color mixture.

When the present inventors formed images by changing the recording order, an image formed by recording a red (R) image first was observed to suffer from less blurring. This phenomenon is caused by a visual influence: visually, it appears as if an image is blurred from a portion having a low brightness toward a portion having a high brightness at a boundary portion between a color reproduced by mixing colors and a color having a large brightness difference therefrom. When the brightness values of the respective colors were measured, the brightness of black (Bk) was 35; red (R), 55; and blue (B), 40.

When a blue (B) image is recorded first, blurring occurs at a portion ①, and a mixed color ink spreads toward red (R) having a large brightness difference from black (Bk). However, when a red (R) image is recorded first, blurring occurs at a portion ②, and a mixed color ink spreads toward blue (B) having a small brightness difference from black (Bk).

Therefore, when images are recorded in the recording order, so that an image is always blurred toward a color having a brightness close to that of a color reproduced by color mixing, the influence of blurring can be minimized. More specifically, image blurring can be rendered inconspicuous by executing recording in the order from a color having a high brightness.

Upon comparison of conspicuousness of blurring in various combinations of colors, a good image can be obtained by executing recording in the above-mentioned order from a color having a high brightness.

In the recording apparatus used in the present invention, on normal high-quality paper, the brightness value of black (Bk) was 35; yellow (Y), 86; magenta (M), 56; cyan (C), 60; red (R), 55; green (G), 53; and blue (B), 40, and the order from a color having the highest brightness was Y→C→M→R→G→B→Bk. The brightness value is a brightness (L*) value measured by the standard source C field angle two degree in the DIE 1976 L*a*b* color space. Therefore, recording is preferably performed in the order of Y→C→M→R→G→B→Bk.

Figure 37:
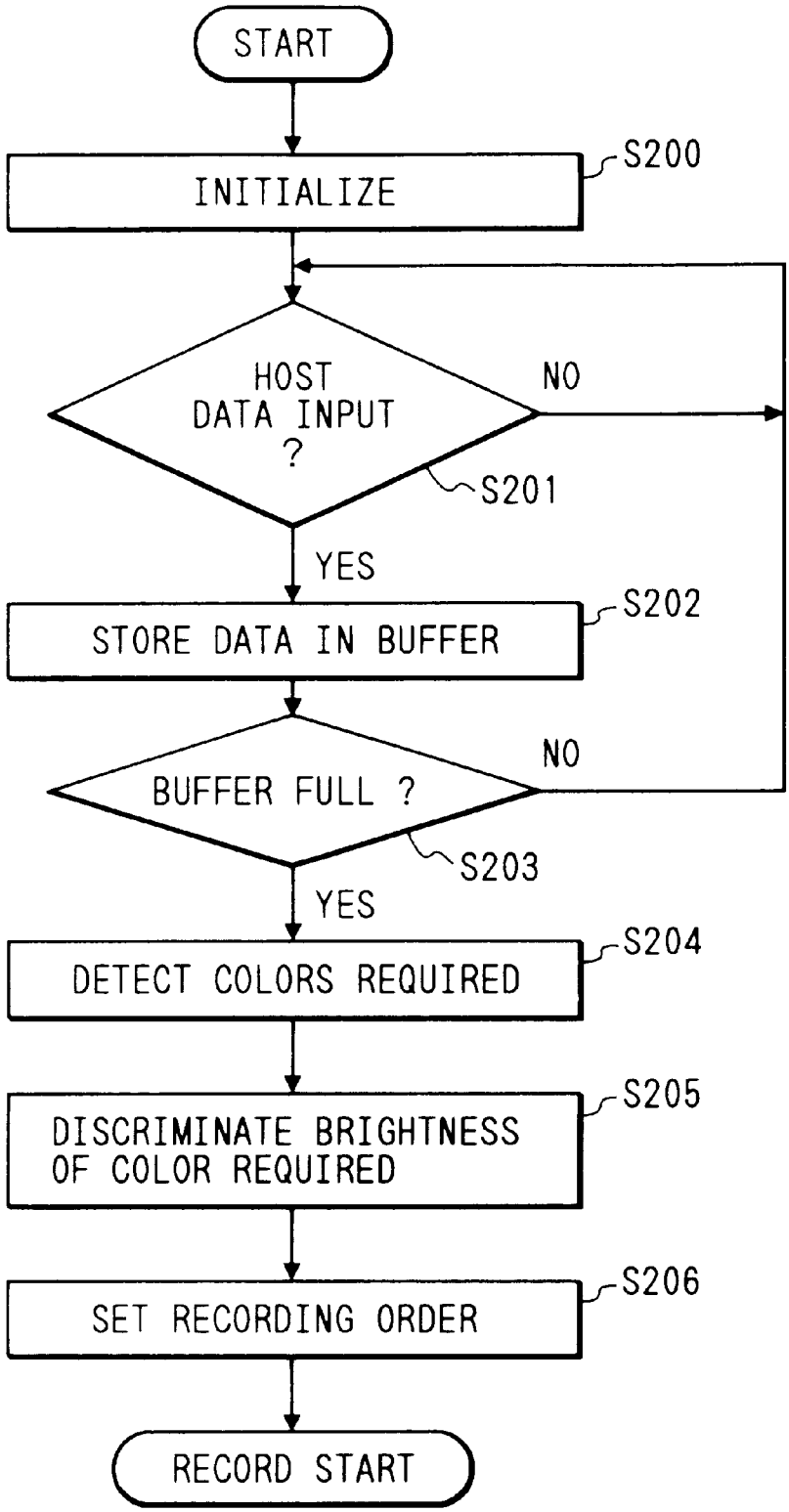
FIG. 37 is a flow chart showing a recording processing sequence according to the 14th embodiment of the present invention.

FIG. 37 shows a processing sequence according to the present invention practiced on the basis of the above description. In step S200, a control unit is initialized. In step S201, the control waits for control commands and recording data input from a host apparatus connected to the recording apparatus while monitoring the inputs via an interface. If it is determined in step S201 that recording data is input from the host apparatus, the input recording data is stored in a reception buffer (step S202). Steps S201 to S203 are repeated until recording data for a predetermined amount (one page in this embodiment) is received from the host apparatus.

If the end of reception is determined in step S203, colors required for a recording image are detected in step S204. In step S205, the brightness values of the required colors are checked, and in step S206, the recording order is set, so that image recording is performed in the order from a color having the largest brightness value. For example, when the required colors are B, G, R, and Bk, since the brightness values of these colors satisfy Bk<B<G<R, the recording order of R→G→B→Bk is set. Then, the recording data are output to the recording head in this order.

Therefore, a red (R) image is recorded in the first recording process, a green (G) image is recorded in the second recording process, a blue (B) image is recorded in the third recording process, and a black (Bk) image is recorded in the fourth recording process. In this embodiment, since recording is performed in the order from a high brightness, image blurring can be rendered inconspicuous.

The above-mentioned order is not a fixed one. That is, since the brightness values of colors vary depending on the characteristics of a recording medium (e.g., a pH value) or ink characteristics, various other orders may be adopted as long as they are matched with a recording system. Furthermore, different recording orders may be used according to recording media.

This embodiment is directed to recording order control means effective for an image having various recording areas, an image in which foreground and background colors are mixed, or an image in which portions having high and low dot densities are mixed like in the above embodiment.

In the recording control of the present invention including the above embodiment, an optimal recording order may be instructed or executed inside the recording apparatus or on a software program such as a printer driver operated by a host computer connected to the recording apparatus.

The above-mentioned recording control method can also be applied to a recording apparatus for performing color recording in a frame-sequential manner while rotating a recording medium wound around a rotary drum, or a recording apparatus for performing color recording in a frame-sequential manner while moving a recording medium forward and backward in the sub-scanning direction with respect to the recording head.

15TH EMBODIMENT

This embodiment corresponds to a further improvement of the first embodiment described above. More specifically, this embodiment pays attention to the fact that a sequential recording method like in the first embodiment has the following features which cannot be obtained by a normal ink jet printer.

1 Blurring at an overlying portion of inks caused by sequential recording is small, and blurring at a boundary portion, which is conspicuous in different color portions, is small.

2 The density of an overlying portion of dots formed in first and second recording processes can be expressed by almost an arithmetic sum of their individual densities.

In this embodiment, multi-value gradation expression is made using inks having different densities. More specifically, inks ejected from first and second IJC units consist of the same color dye as a color development agent, and have different dye densities. The 15th embodiment of the present invention using a density ternary recording method will be described below.

Figure 38:
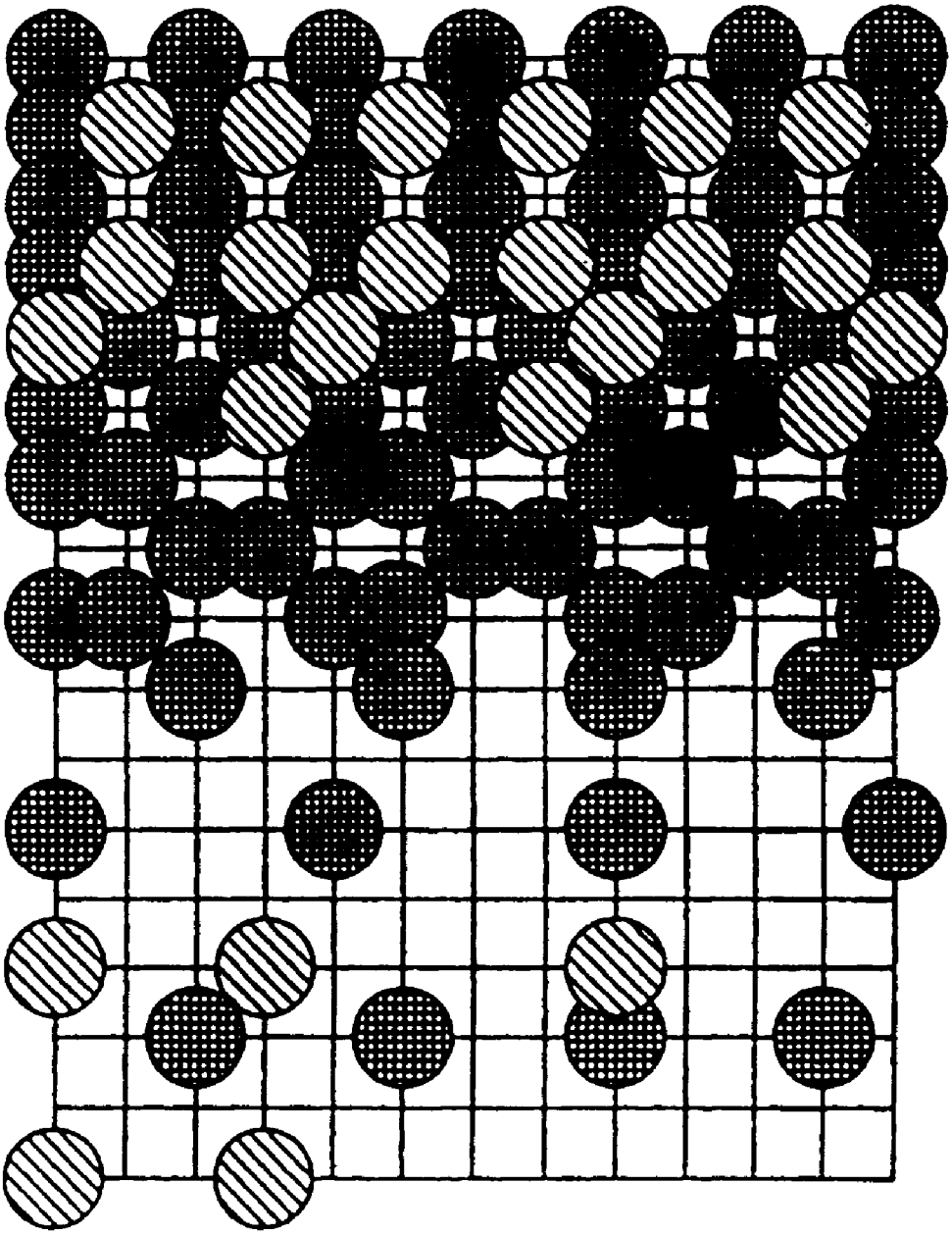
FIG. 38 is a view showing a state of a recorded image according to the 15th embodiment of the present invention.

FIG. 38 shows an image printed according to this embodiment. In FIG. 38, a cross-hatched dot indicates a dot recorded by a dark ink in the first recording process, and a hatched dot indicates a dot recorded by a light ink in the second recording process. FIG. 38 shows dots recorded in only one color. However, the same applies to a case wherein a plurality of colors are recorded using dark and light dots for each color. For example, when recording colors are Y, M, and C, density ternary full-color image recording can be achieved.

In the density ternary recording method, since a maximum of four gradation levels can be expressed per pixel, both the resolution and gradation characteristics can be easily improved, and high-precision recording can be achieved as compared to binary recording.

In order to obtain a required multi-value gradation image by the density ternary recording, required image data (normally, multi-value data having color information) must be converted into print data allowing the density ternary recording, and various methods of generating such density ternary recording data are available. For example, an example of conversion means will be explained below wherein image data is separated into dark and light data with reference to a known density separation table, the separated image data are then binarized, and the binarized data are respectively supplied to IJC units for recording dark and light dots.

Figure 39:
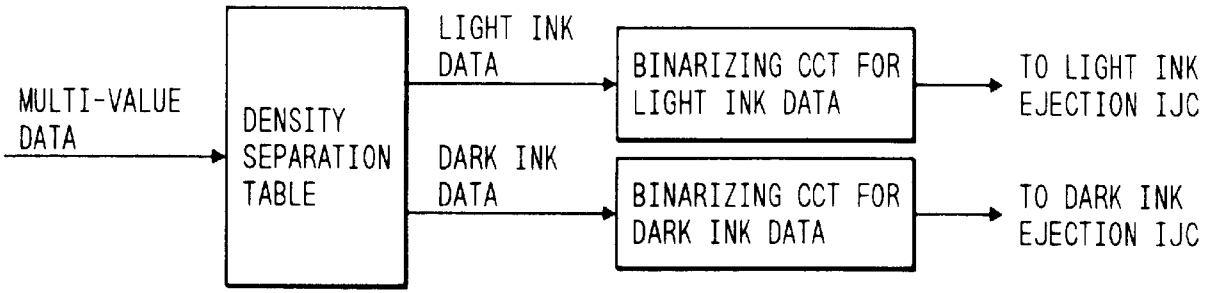
FIG. 39 is a block diagram showing an image ternary conversion processing block in the 15th embodiment.
Figure 40:
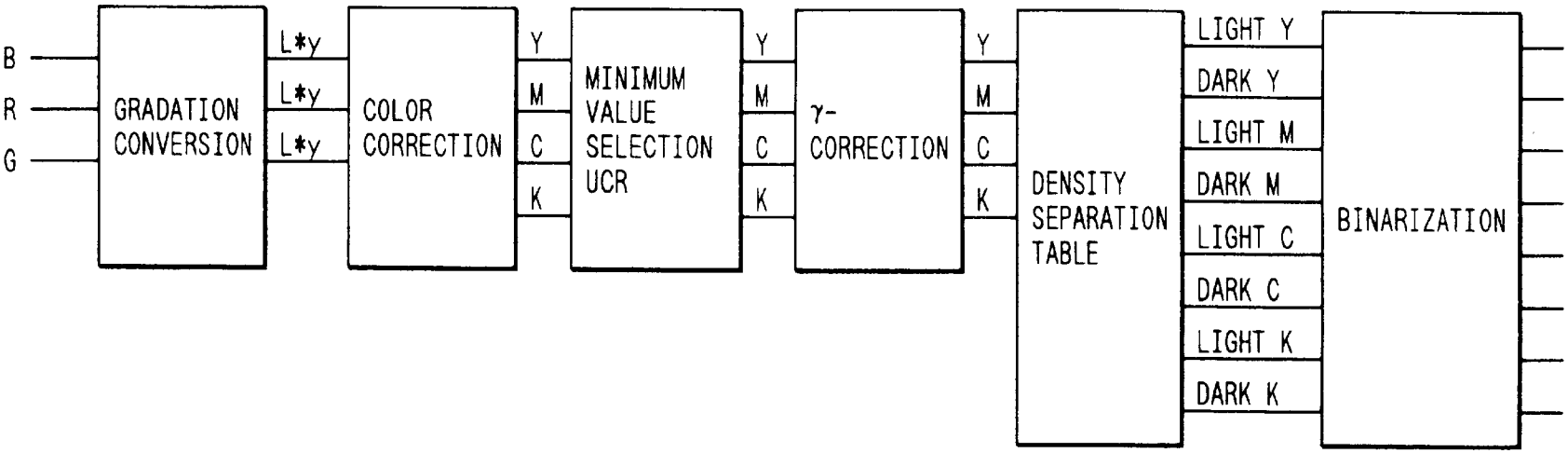
FIG. 40 is a diagram showing the flow of full-color image formation processing in the 15th embodiment.

FIG. 39 shows such ternary processing blocks, and FIG. 40 shows the flow of image data processing when this embodiment is applied to color image recording.

In such a density ternary recording data generation method, since binarizing operations of dark and light data are independently performed, dark and light dots are overlaid. For this reason, when a full-color image is recorded, a total of six dots of Y, M, and C light and dark inks may be printed on one pixel. In this case, in a normal color ink jet recording method, the ink overflows on the upper surface of a recording sheet, and flows toward adjacent pixels. As a result, an image is blurred, and image quality is deteriorated (blurring). Also, the ink leaks from the lower surface of the recording sheet, and the lower surface cannot be used (strike through). For this reason, when high-quality density multi-value recording is performed, special-purpose coating paper having a high ink absorbing ability must be used. Thus, it is impossible to record a high-quality color image on normal paper.

However, when the multi-color multiple print method and the density ternary recording method of this embodiment are combined, the image recorded in the first recording process is completely fixed, as described above. For this reason, the state of the recording medium is restored to a state before ink recording in the first recording process, and a high-quality color image can be recorded on normal paper without causing blurring, strike through, and the like.

As described above, since the density of the overlying portion of dots formed in the first and second recording processes is expressed by almost an arithmetic sum of their individual densities, the density of the overlying portion of dark and light dots can be estimated regardless of the characteristics of a recording medium, and processing parameters can be easily optimized.

It is easy to design the IJC unit for ejecting a dark ink so as to have an ink ejection amount capable of recording dots for normal binary recording when it is used alone. With this IJC unit, both binary recording of, e.g., characters and density ternary recording of, e.g., images can be achieved.

In this embodiment, the independent IJC units for respectively ejecting dark and light inks are used. Alternatively, ink tank units respectively storing dark and light inks may be detachably arranged in a single ink jet unit. When the ink tank units are exchanged to perform multi-color multiple recording using dark and light inks, the number of ink jet units can be halved, and high-quality color recording can be achieved at low cost.

When a single IJC unit integrated with a recording unit capable of ejecting both dark and light inks is used, and is exchanged in units of colors to perform multi-color multiple recording, the registration precision of dark and light dots in a single color can be improved, and higher precision recording can be achieved.

In this embodiment, dark and light ink dots of the same color are used for achieving density gradation expression by one pixel. Alternatively, inks having the same density may be used, and dots may be overlaid by sequential recording. In this case, according to the characteristic of the recording method, i.e., since the density of the overlying portion of dots formed in the first and second recording processes is expressed by almost an arithmetic sum of their individual densities, multi-gradation expression can be achieved by one pixel. As compared to an image using dark and light inks, although granularity of a highlight portion is slightly impaired, since only one IJC unit is required for each color, cost can be reduced, and the registration precision of overlying dots can be improved, thus allowing high-precision recording.

Also, IJC units having different ink ejection amounts may be used, and gradation reproduction may be achieved by large and small dots having different areas. In this case, since the granularity of a highlight portion can be improved by small dots, the quality of an image such as a man's skin, which places an importance on the highlight portion, can be improved. Furthermore, when recording is performed using large and small dots, dots need not always be modulated by exchanging the IJC units like in this embodiment, but may be modulated by changing head driving conditions (head temperature, driving pulse modulation, and the like) of the main body. In this case, since only one IJC unit is required per color, cost can be reduced, and the registration precision of large and small dots can be improved, thus allowing high-precision recording.

The same effect as described above can be expected when an IJC unit in which a solvent composition other than the dye of a recording ink is changed to control the way of blurring on a recording sheet, and one or both of the dot density and the dot area are changed, may be used.

Figure 41A:
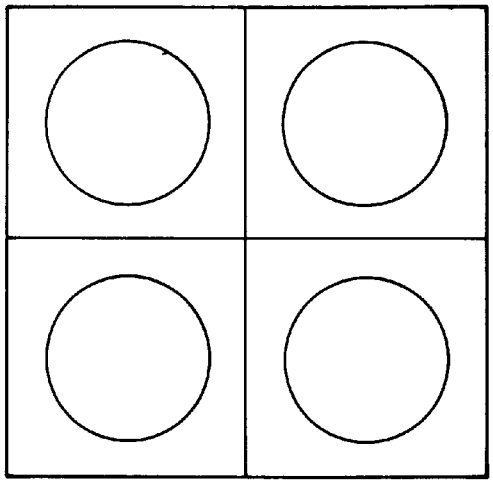
FIGS. 41A to 41C are views showing states of recorded images by other printing methods in the 15th embodiment.
Figure 41B:
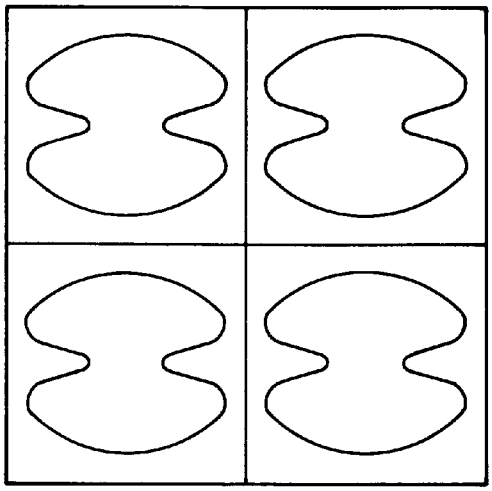
Figure 41C:
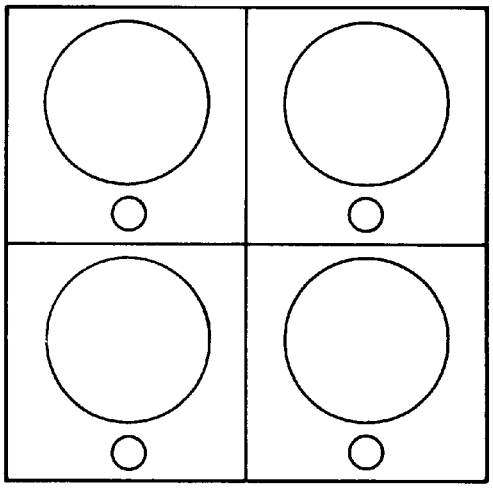

In addition, the same effect as described above can be expected when an IJC unit or head driving control of the main body, which controls the dot shape to change the effective density including the optical dot gain, may be used. FIGS. 41A to 41C show examples wherein the effective density is changed by dot shapes.

16TH EMBODIMENT

In this embodiment, multi-value gradation expression is performed by shifting pixels by half a pixel. In the arrangement of the above embodiment, first and second IJC units whose ink ejection orifice positions are shifted by half a pixel are used, so as to have different recording dot positions in the first and second recording processes. The 16th embodiment of the present invention using a half-pixel-shifted dot overlaying ternary recording method will be described in detail below.

Figure 42:
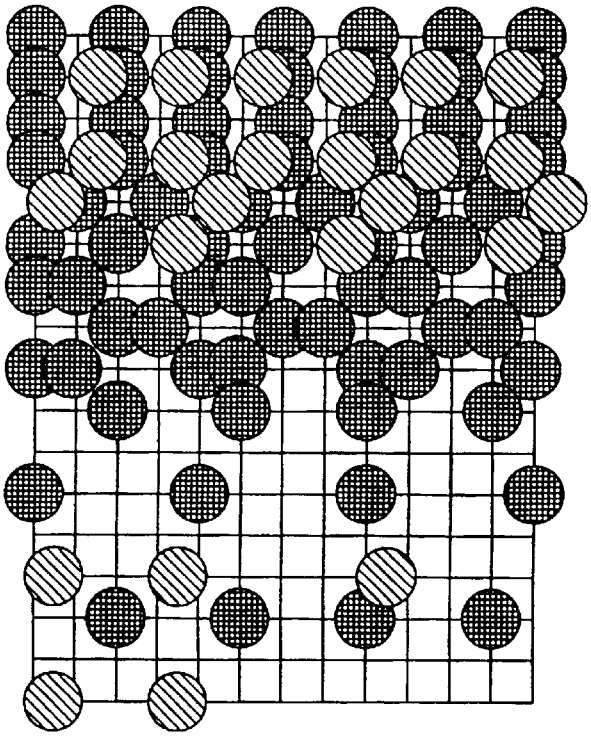
FIG. 42 is a view showing a state of a recorded image according to the 16th embodiment of the present invention.
Figure 43:
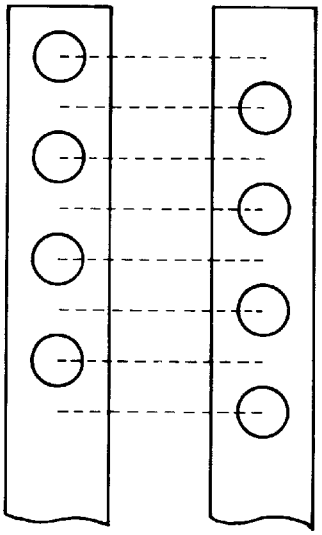
FIG. 43 is a view showing an arrangement of ink ejection orifices of an IJC in the 16th embodiment.

FIG. 42 shows an image printed according to this embodiment. In FIG. 42, a cross-hatched dot indicates a dot recorded by the first IJC unit in the first recording process, and a hatched dot indicates a dot recorded by the second IJC unit in the second recording process. FIG. 43 shows the positional relationship of the ejection orifices of the first and second IJC units used in the recording method of this embodiment, and shows dots recorded in only one color. However, the same applies to a case wherein a plurality of colors are recorded using dots shifted by half a pixel. For example, when recording colors are Y, M, and C, ternary full-color image recording can be achieved.

In the half-pixel-shifted dot overlaying ternary recording method, since a maximum of four gradation levels can be expressed per pixel, both the resolution and gradation characteristics can be easily improved, and high-precision recording can be achieved as compared to binary recording.

Figure 44:
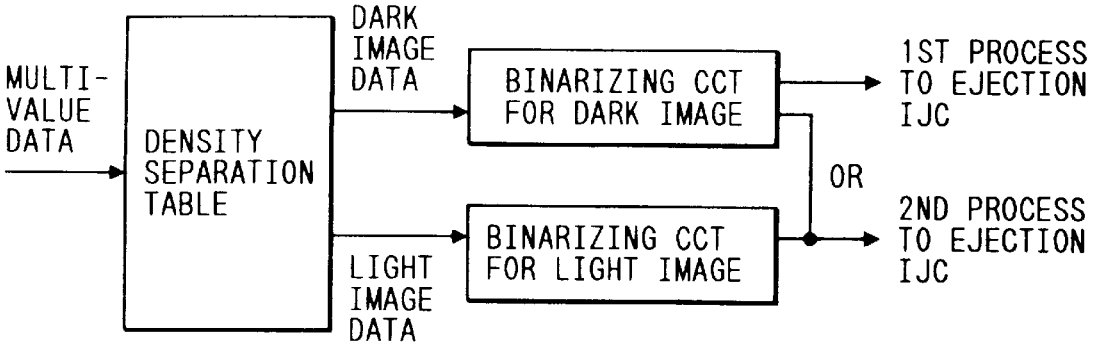
FIG. 44 is a block diagram showing an image ternary conversion processing block in the 16th embodiment.

In order to obtain a required multi-gradation image by the half-pixel-shifted dot overlaying ternary recording method, required image data (normally, multi-value data having color information) must be converted into print data allowing the half-pixel-shifted dot overlaying ternary recording. Various methods of generating such ternary recording data are available. Of these methods, a ternary recording method in which ternary processing blocks including the density selection table described in the above embodiment with reference to FIG. 39 are used, a dark data signal is input to the IJC unit for the first recording process, and an OR signal of light and dark data is input to the IJC unit for the second recording process, is known. FIG. 44 shows such ternary processing blocks.

In the dot overlaying ternary recording method, the surface density of the recorded ink is increased as a whole. For this reason, the edge shape of each recording dot becomes unstable due to the above-mentioned burring, and image sharpness is impaired. For this reason, when high-quality density multi-value recording is performed, special-purpose coating paper having a high ink absorbing ability must be used. Thus, it is impossible to record a high-quality color image on normal paper.

However, when the multi-color multiple print method and the half-pixel-shifted dot overlaying ternary recording method of this embodiment are combined, an image recorded in the first recording process is completely fixed. For this reason, since the state of the recording medium is restored to a state before ink recording in the first recording process, blurring at the overlying portion of the ink in the second recording process is small, and a high-quality image whose blurring is minimized can be recorded without impairing image sharpness.

As described above, since the density of the overlying portion of dots formed in the first and second recording processes is expressed by almost an arithmetic sum of their individual densities, and recording can be performed at a higher density than normal dot overlaying recording, a high-contrast image can be recorded as well.

Furthermore, since a sufficient density can be obtained by covering one pixel with at least two dots, an image can be recorded on normal paper by utilizing an IJC unit, which is designed for special-purpose coating paper, and has a small ink ejection amount.

In this embodiment, in order to perform half-pixel-shifted dot overlaying recording, the two IJC units whose ink ejection orifice positions are relatively shifted by half a pixel in the alignment direction of the ejection orifices are used, and monochrome multiple recording is performed by exchanging the IJC units. Alternatively, heads whose ink ejection orifice positions are relatively shifted by half a pixel in a direction perpendicular to the alignment direction of the ejection orifices may be used. In this case, the recording dot positions of the two IJC units can be aligned by electrical correction at the main body side, and two heads can be equivalently used when normal binary image recording is performed.

The same effect as described above can be obtained when an IJC unit using an ink jet unit, in which the shapes of ejection orifices and nozzles are changed to control the ejection direction so as to consequently shift recording dots by half a pixel, may be used.

Dots may be shifted by changing the back-and-forth position, right-and-left position, or recording start position upon feeding of a recording sheet.

Figure 45:
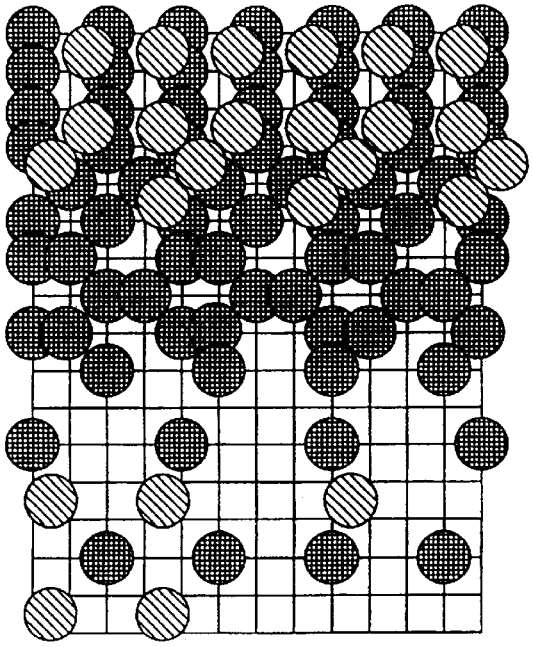
FIG. 45 is a view showing a state of a recorded image in the 16th embodiment.

The shift direction of pixels is not limited to the print main scanning direction or sub-scanning direction, but may be an oblique direction. In this case, since the overlying portion of dots formed in the first and second recording processes becomes small, and the recording sheet coverage of dots is increased, density nonuniformity is decreased, and uniformity of an image can be improved. FIG. 45 shows an image recorded by such a recording method.

Also, the same effect as described above can be obtained when a single IJC unit is used, and the recording dot positions in the second recording process may be mechanically or electrically shifted by half a pixel in a recording apparatus main body.

In this embodiment, only the recording dot positions in the first and second recording processes are changed. However, upon combination with the recording method described in the 15th embodiment, which changes the density, area, and shape as other characteristics of the dot, an image with still higher image quality can be obtained.

In this embodiment, recording dots are shifted by half a pixel. However, the present invention is not limited to this. For example, when the area of a recording dot is smaller than a pixel area, the shift amount is preferably set to be smaller than half a pixel. In this case, since the recording sheet coverage of dots is increased, density nonuniformity is decreased, and uniformity of an image can be improved.

17TH EMBODIMENT

This embodiment relates to a high-saturation image formation method for forming an image using dots shifted by half a pixel and different color inks. More specifically, this embodiment uses a different-color half-pixel-shifted dot recording method in which first and second IJC units whose ink ejection orifice positions are shifted by half a pixel are used in the arrangement of the above-mentioned embodiment, the recording dot positions in the first and second recording processes are different from each other, and ink colors in the first and second recording processes are also different from each other. The 17th embodiment will be described in detail below.

As an example of an image printed according to this embodiment, an image shown in FIG. 45 is quoted. In FIG. 457 a cross-hatched dot indicates one of Y, M, and C color dots recorded by the first IJC unit in the first recording process, and a hatched dot indicates a Bk dot recorded by the second IJC unit in the second recording process. In this manner, in the dot recording method for shifting only Bk dots by half a pixel, since the overlying amount between each Bk dot and another color dot is small as a whole, blurring of the Bk dot, and color turbidity can be minimized, and a high-saturation image can be obtained.

In the dot recording method for shifting different color dots by half a pixel, Bk dots have large unnecessary dot overlying portions with adjacent dots in a halftone image having a high recording sheet coverage of dots, and considerable color turbidity is often caused by even slight blurring. In particular, this phenomenon is conspicuous on normal paper having a low ink absorbing ability. Thus, it is impossible to form a high-saturation color image on normal paper.

However, when the multi-color multiple print method and the different-color half-pixel-shifted dot recording method of this embodiment are combined, an image recorded in the first recording process is completely fixed, as described above. For this reason, since the state of the recording medium is restored to a state before ink recording in the first recording process, blurring at the overlying portion of the ink in the second recording process is small, and a high-saturation image whose blurring is minimized and which is free from color turbidity can be recorded on normal paper.

In this embodiment, the different-color half-pixel-shifted dot recording is performed between Bk dots and other color dots. However, the half-pixel-shifted dot recording may be performed for each of Y, M, and C colors as well. With this arrangement, the dot overlying amount is decreased, and the ratio of image whose color is generated by neighboring color mixture is increased, the degree of influence of the ink blurring characteristics of a recording sheet on a color tone is decreased, and stable color reproduction can be attained regardless of the type of recording sheet.

In this embodiment, a high-saturation recording method has been described. However, upon combination with the multi-gradation recording methods described in the 15th and 16th embodiments, a high-quality color image can be recorded on normal paper.

18TH EMBODIMENT

In each of the above embodiments, the present invention is applied to a recording method using an ink jet recording apparatus, which mounts a single IJC unit for ejecting one color ink. However, the present invention is not limited to this. For example, an ink recording means for performing color recording on a recording medium by ejecting a plurality of color inks may be used. In this case, first ink recording may be performed by ejecting the first ink in the first process, and after a recording medium is discharged outside the apparatus, second ink recording may be performed by ejecting the second ink in the second process.

In each of the above embodiments, the same effect can be expected even when another recording process is inserted between the first and second processes.

In each of the above embodiments, the density separation table is used as density image data conversion means. Alternatively, print multi-value data may be directly generated using a plurality of threshold values in the binarizing process.

As a binarizing method of print data generation means, a known dither method (an error diffusion method, an average density preservation method, a least mean error method, a systematic dither method, and the like), a density pattern method, a pixel distribution method, and the like may be used. In each of the above embodiments, ternary recording has been described. However, the recording method of the present invention is effective in ternary or higher recording.

As described above, according to the 15th to 18th embodiments of the present invention, multi-gradation color recording and high-saturation color recording can be easily realized with high image quality.

19TH EMBODIMENT

In the first embodiment described above, the following drawbacks may still be caused. More specifically, in a recording apparatus, in which the reception order of color-separated information in units of colors is determined, if an ink recording head matching with a given color is not attached to the recording apparatus in the order of information, a required image cannot be obtained. The head matching with the information may not be mounted for the following reason. That is, since different heads must have substantially the same shape so as to mount ink recording heads of different colors on a single mounting portion, an operator may perform an erroneous operation or may erroneously mount the head. This error may be caused more often with heads which store inks having the same color but different densities (to be referred to as recording heads under different conditions including the above-mentioned case).

This embodiment solves the drawbacks of the first embodiment.

Figure 46:
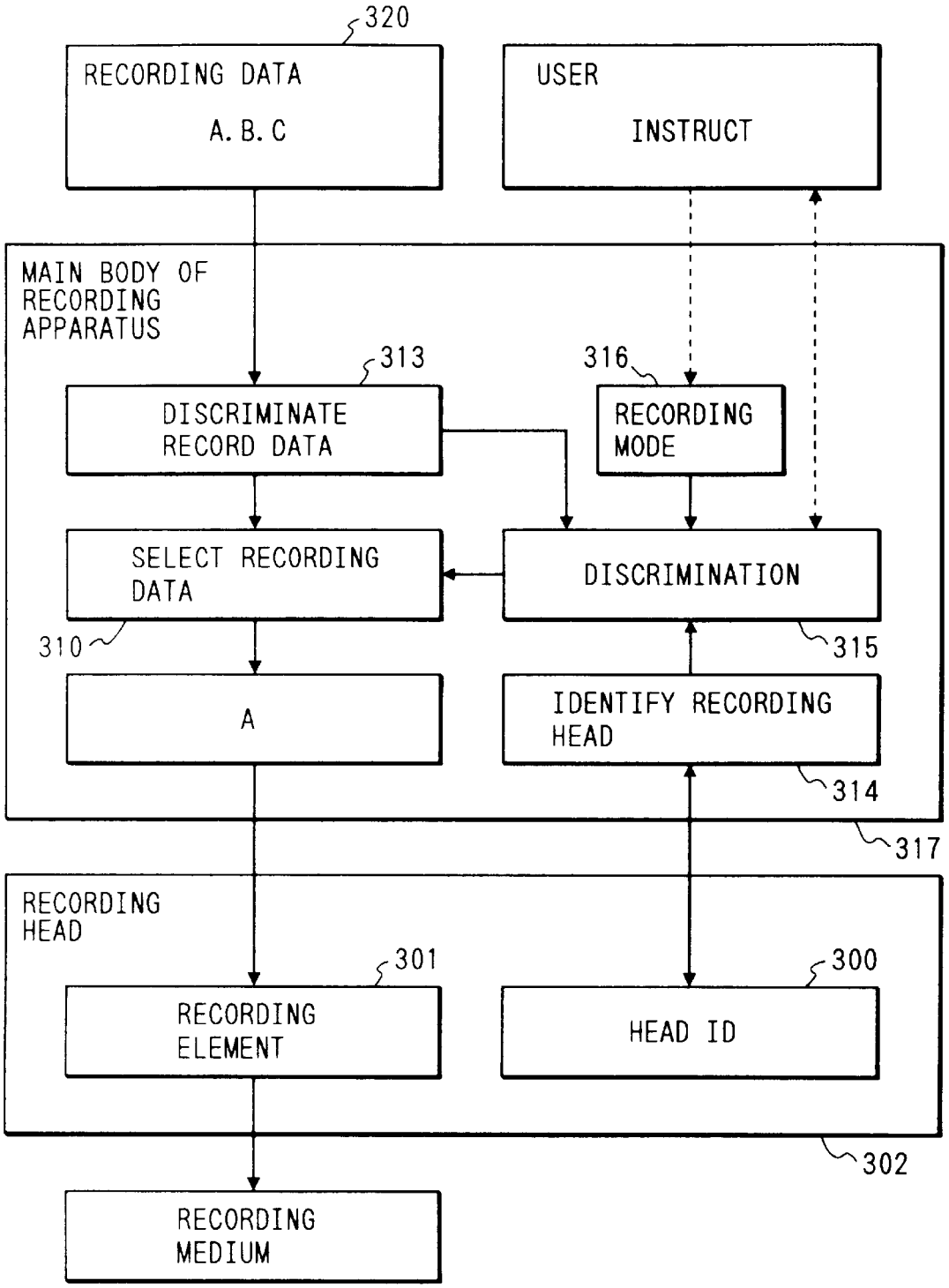
FIGS. 46 and 47 are block diagrams showing system arrangements according to the 19th embodiment of the present invention.

FIG. 46 is a diagram showing the overall system of this embodiment. In FIG. 46, a recording apparatus main body 317 comprises a means 313 for discriminating the type of recording data from recording data 320, and a means for identifying a recording element 301 based on a recording head ID 300. When recording data is input to the recording apparatus main body 317, the type of recording data and the type of recording head are recognized by the means 313 and 314, and a discrimination means 315 discriminates if they coincide with each other. The way of processing according to this discrimination result is determined by a recording mode 316. Since operations required for exchanging recording heads or re-feeding a recording medium by a user vary according to a method of supplying recording data corresponding to each recording head 302 to the recording apparatus 317, efficient recording can be performed depending on the way of processing for the above-mentioned discrimination result.

When the types of recording data and the type of recording head coincide with each other, this recording data is selected, and a signal corresponding to the data is supplied to a recording element of the recording head, thus recording the data on a recording medium. When the types of recording data and the type of recording head do not coincide with each other, processing is changed by the recording mode 316. As one mode, recording is interrupted, and the control asks for a user's decision. In this case, the content of the decision is whether recording is performed without exchanging recording heads, or recording is restarted by mounting another recording head corresponding to the input recording data.

As another mode, data other than that corresponding to the recording head is inhibited and is not used, and no recording is performed. More specifically, only recording data corresponding to the recording head is selected, and is supplied to the recording element to execute recording. As still another mode, an alarm is generated, and after an elapse of a predetermined period of time, recording is restarted. In this mode, the above-mentioned user's decision is preferably accepted within the predetermined period of time.

Figure 47:
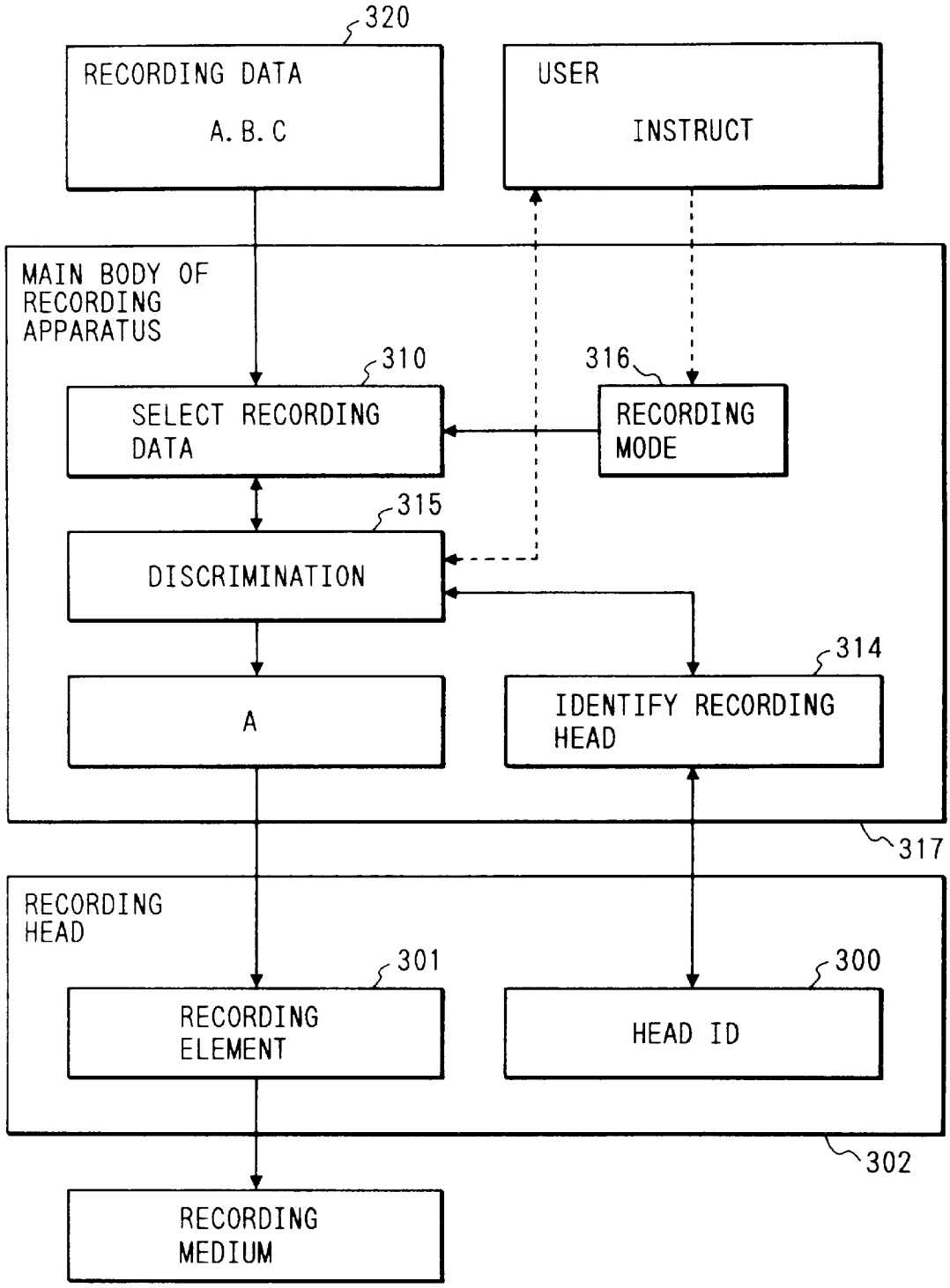

When the recording mode 316 for selecting recording data in advance is set, as shown in FIG. 47, the discrimination means 315 determines if the type of recording data and the type of recording head selected by a user coincide with each other. Processing for this determination result can be equivalent to the above-mentioned processing for the relationship between the recording data and the recording head.

Furthermore, when the type of recording data and the type of recording head are recognized, and it is checked if they coincide with each other, information for identifying the recording head may be displayed on the recording head, the recording apparatus main body, or a host apparatus. With this arrangement, a user can easily recognize the type of recording head, and user's operability can be improved.

It is also useful if the type of recording head is identified, and only recording data corresponding to the type of head is requested to the host apparatus. With this method, the recording heads can be efficiently exchanged. In particular, this method is effective when full-color recording is performed.

As an example of the recording head ID, a method in which a resistor having a resistance indicating the type of head is arranged in the recording head is available. In this case, the recording apparatus main body is provided with a contact for connection with the resistor, and a means for reading the resistance, and the type of recording head is identified based on the resistance.

Figure 48:
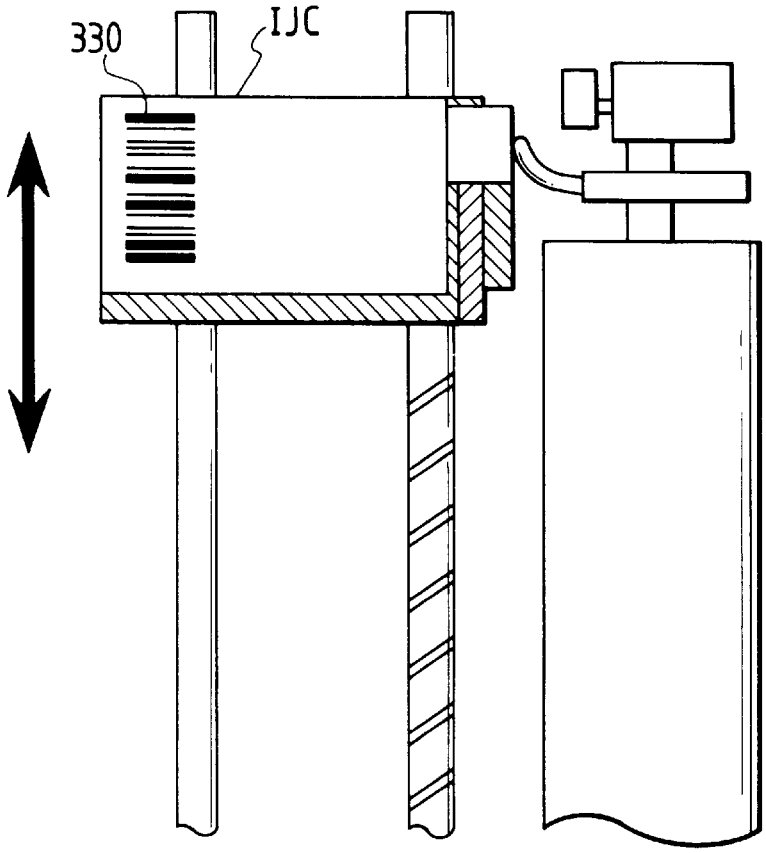
FIGS. 48 and 49 are explanatory views showing a bar code arrangement in the 19th embodiment.
Figure 49:
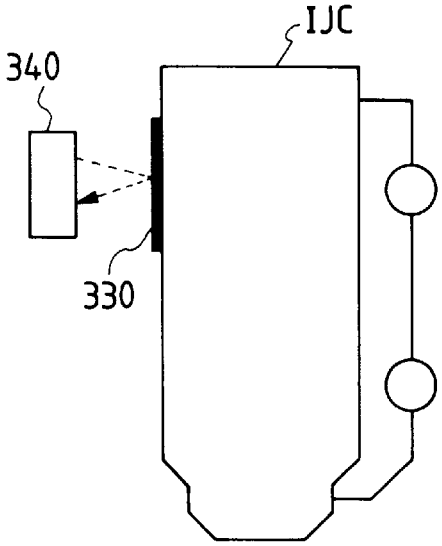

As another example of the recording head ID, as shown in FIG. 48, a method in which a bar code 330 indicating the type of head is provided on the surface of a recording head IJC to extend in the carriage moving direction is available. In this case, as shown in FIG. 49, a means for radiating a light beam onto the bar code and a detection means 340 for detecting light reflected by the bar code are fixed to the recording apparatus main body. A carriage is moved toward the detection means at a constant speed, and the information of the bar code is read by the recording apparatus main body on the basis of a change in signal of the reflected light over time, thereby identifying the type of head. In place of the bar code, it is effective to use a magnetic code and a magnetic sensor.

20TH EMBODIMENT

The 20th embodiment for executing recording by discriminating recording data will be described below.

Figure 50:
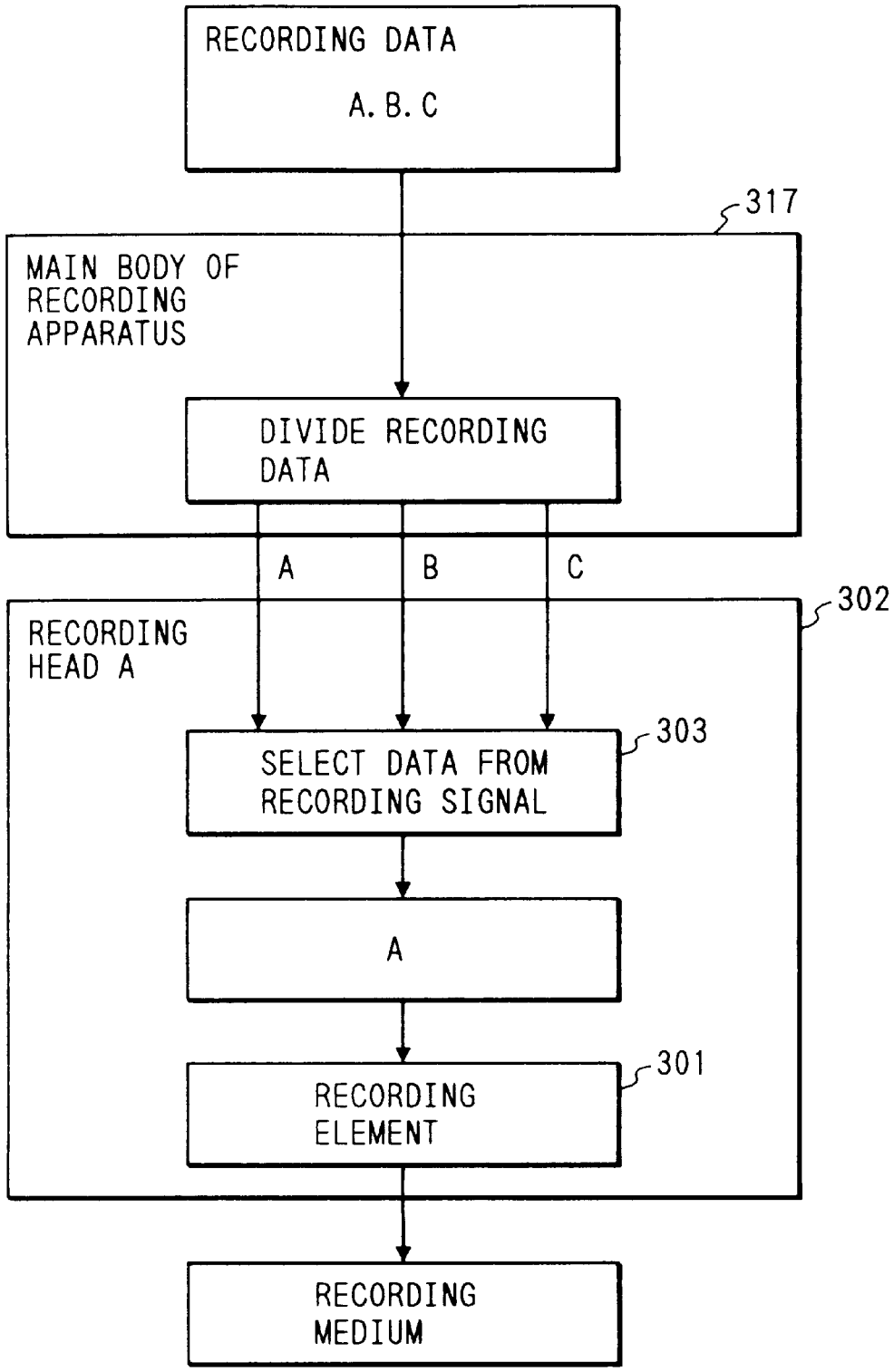
FIGS. 50 and 52 are block diagrams showing system arrangements according to the 20th embodiment of the present invention.
Figure 51:
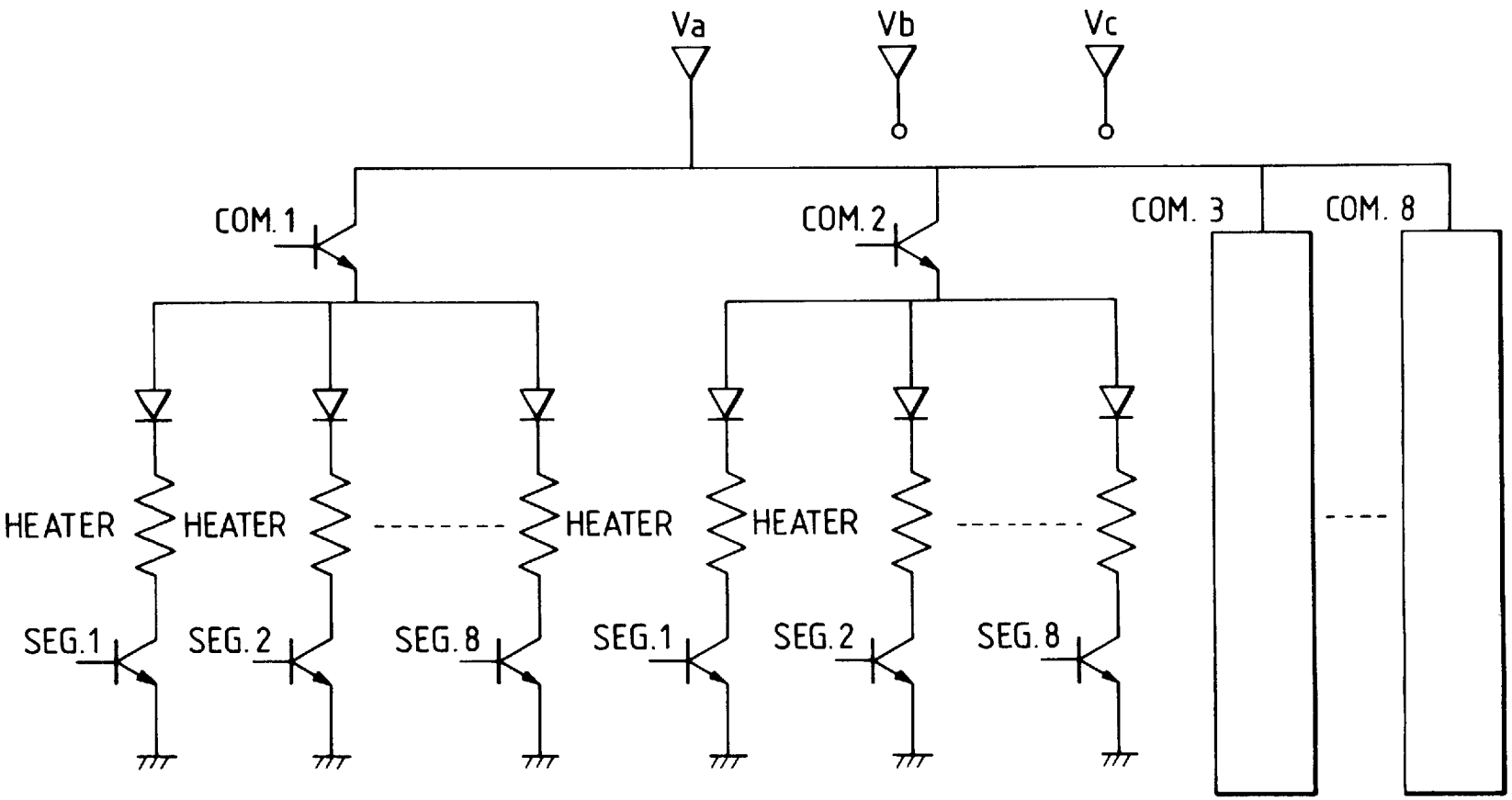
FIGS. 51 and 53 are circuit diagrams of an ink jet recording head in FIGS. 50 and 52, respectively.

In the 19th embodiment, the recording apparatus main body supplies only recording data corresponding to a recording head to the recording head. In this embodiment, as shown in FIG. 50, the recording head itself selects recording data from a recording signal using a selection means 303, and records the selected data on a recording medium. In a recording apparatus main body 317, contact terminals (Va, Vb, and Vc) for supplying voltages to a recording head 302 in units of types of recording data are separately arranged, and other contact terminals for, e.g., driving signals, are used commonly to the different types of recording data. As shown in FIG. 51, the recording head has voltage driving contact terminals (Va, Vb, and Vc) in units of types of recording data, only a voltage driving contact terminal (Va in FIG. 51) corresponding to the type of recording head is coupled to the recording element, and other voltage driving contact terminals (Vb and Vc in FIG. 51) are insulated from the recording element. In the recording apparatus main body, only when recording data is supplied to the recording element, a driving voltage is applied to the driving voltage terminal of the recording head corresponding to the recording data. With this arrangement, the recording head can record only the corresponding recording data on a recording medium.

Figure 52:
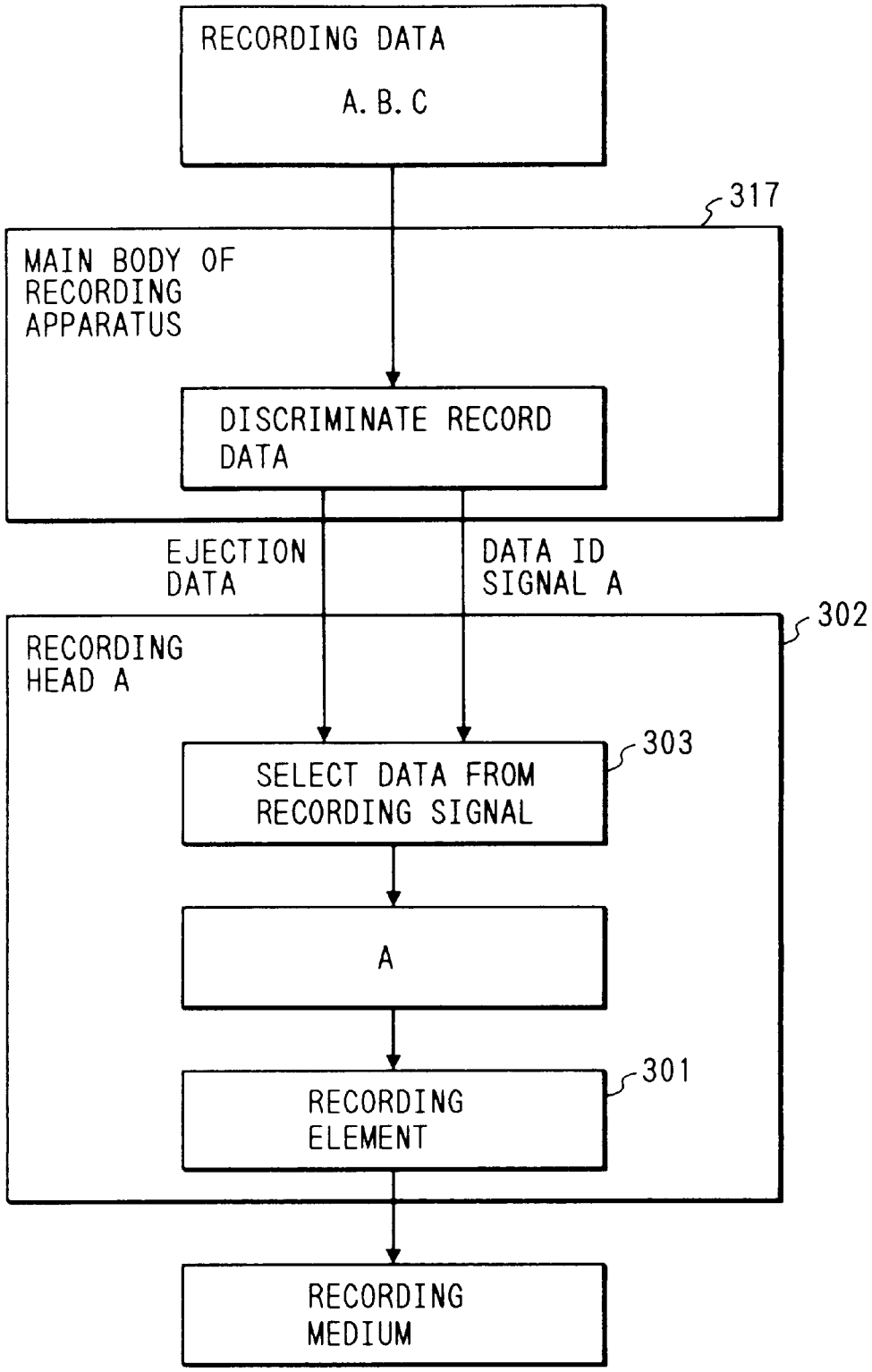
Figure 53:
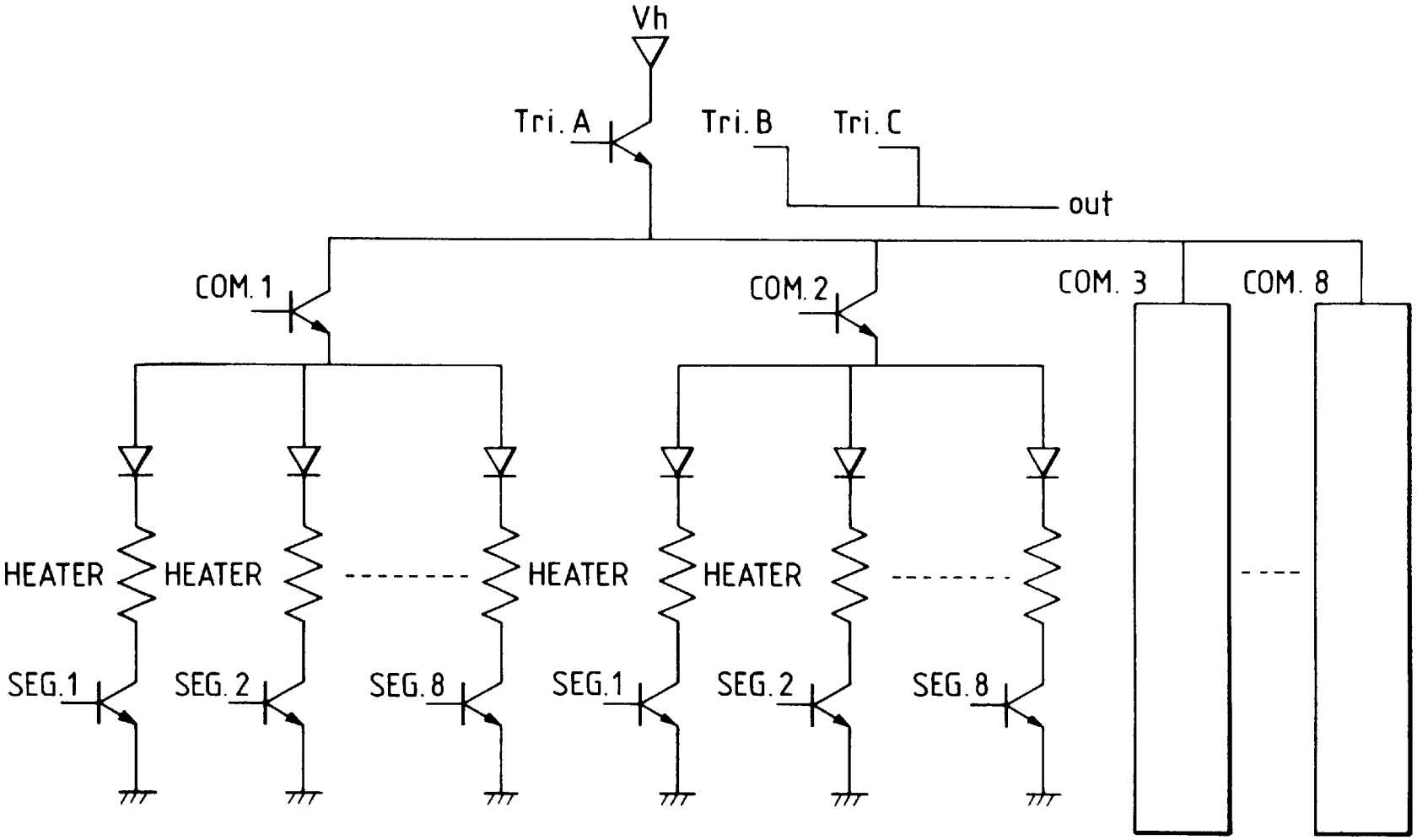

With the arrangement shown in FIG. 52 as well, the same effect can be obtained. When recording data is supplied from the recording apparatus main body, a signal for identifying the type of data is simultaneously supplied to recording head terminals (Tri.A, Tri.B, and Tri.C in FIG. 53), and the recording head determines based on the input signal if corresponding recording data is supplied. If the recording data determines that corresponding recording data is supplied (the signal to Tri.A in FIG. 53), a driving voltage (Vh) is applied to the recording element, and recording is performed. If the recording head determines that the recording data identification signal is not a corresponding one, no driving voltage is applied to the recording element, and the input signal is directly returned to the recording apparatus main body. Upon reception of the signal, the recording apparatus main body inhibits carriage movement associated with recording, thus preventing wasteful movement of the carriage.

21ST EMBODIMENT

Figure 54:
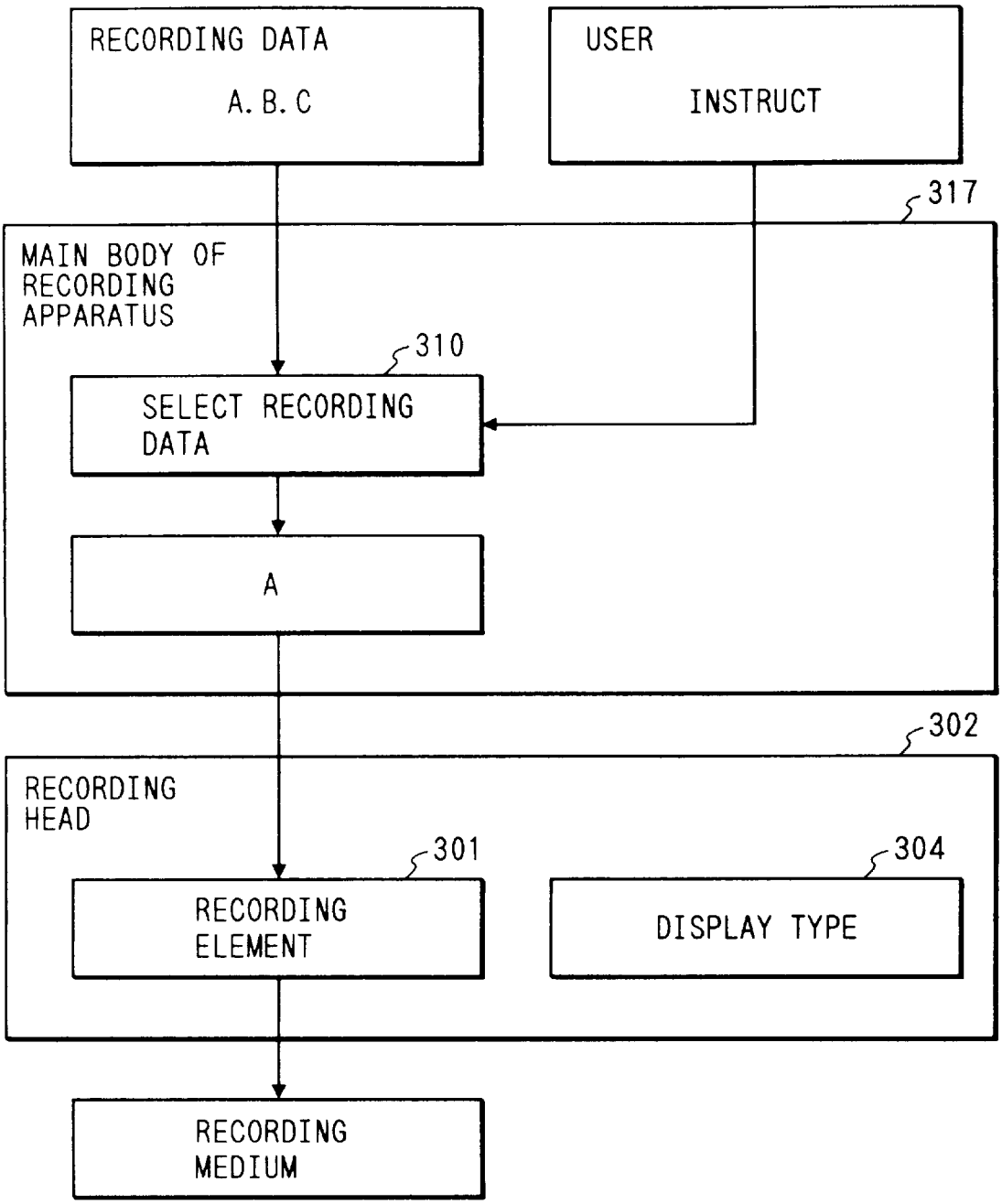
FIGS. 54 and 55 are block diagrams showing system arrangements according to the 21st embodiment of the present invention.

The 21st embodiment for executing recording by discriminating recording data will be described below with reference to FIG. 54.

The 19th embodiment has the means for discriminating whether or not the type of recording head and the type of recording data coincide with each other. As shown in FIG. 54 this embodiment leaves selection of recording data to a user so as to entrust a decision of a coincidence between data and a recording head to the user, thereby omitting information associated with the type of recording head to be supplied to the recording apparatus main body.

In this system arrangement, the type of recording head need be easily identifiable by a user. For this purpose, a label 304 indicating the type is attached to the recording head, or the head is designed to have a color or shape expressing the type. Also, the type of recording data supplied to the recording apparatus main body and the type of recording data selected by the recording apparatus main body are displayed on the main body or the host apparatus. With these arrangements, a recording method in which recording heads are selectively used according to the type of recording information can be easily executed.

Figure 55:
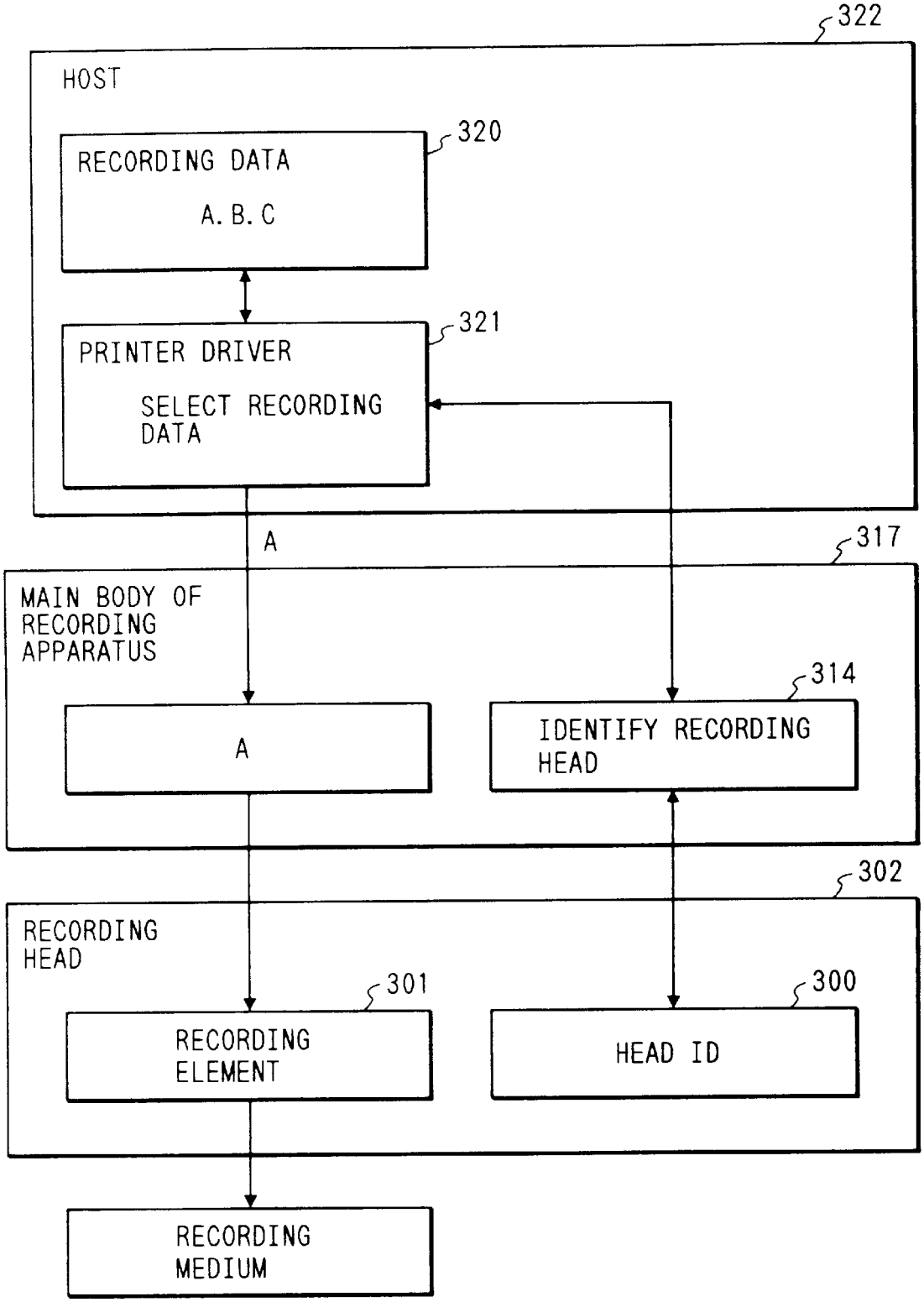

Also, as shown in FIG. 55, an ID 300 of a recording head 302 may be supplied from a recording apparatus main body 317 to a host apparatus 322, so that selection control 321 of recording data is executed by the host apparatus.

In the 19th to 21st embodiments, a recording signal may assume a case wherein information color-separated by the host apparatus is transmitted sequentially (in the predetermined color order or randomly) or simultaneously to the recording apparatus, a case wherein information input to a memory of the recording apparatus is color-separated by an internal circuit of the recording apparatus, or a case wherein a color identification memory of the recording apparatus has a driver for supplying color information selectively or in a predetermined order to the recording head.

As a means for discriminating or selecting these pieces of information, there may be proposed a means for enabling recording by checking matching between head information (an ID, including a bar code, magnetic information, an indication to be optically detected, a change in mechanical shape (e.g., presence/absence of projections), for indicating ink characteristics of a head) and recording information, a means for enabling recording by a head itself on the basis of only information matching with the head, a means for discriminating the predetermined color information order and the order of mounted heads, a discrimination means including an indication to a user, and the like.

When the above-mentioned recording method is executed in correspondence with a correlation between recording data and a recording head, a color image can be obtained more reliably.

22ND EMBODIMENT

Since the method of each of the above embodiments requires a plurality of processes to form an image, a problem about recording position precision in units of processes may often be posed. There are two major causes for the position precision errors.

One cause is a recording position precision error caused by paper feed position precision since a recording medium is fed/discharged a plurality of number of times.

The other cause is recording position precision error caused by cartridge position precision since a cartridge is attached/detached a plurality of number of times.

These causes for varying the recording position make it difficult to obtain very high image quality in the above-mentioned ink jet recording method.

This embodiment can solve these drawbacks.

Figure 56:
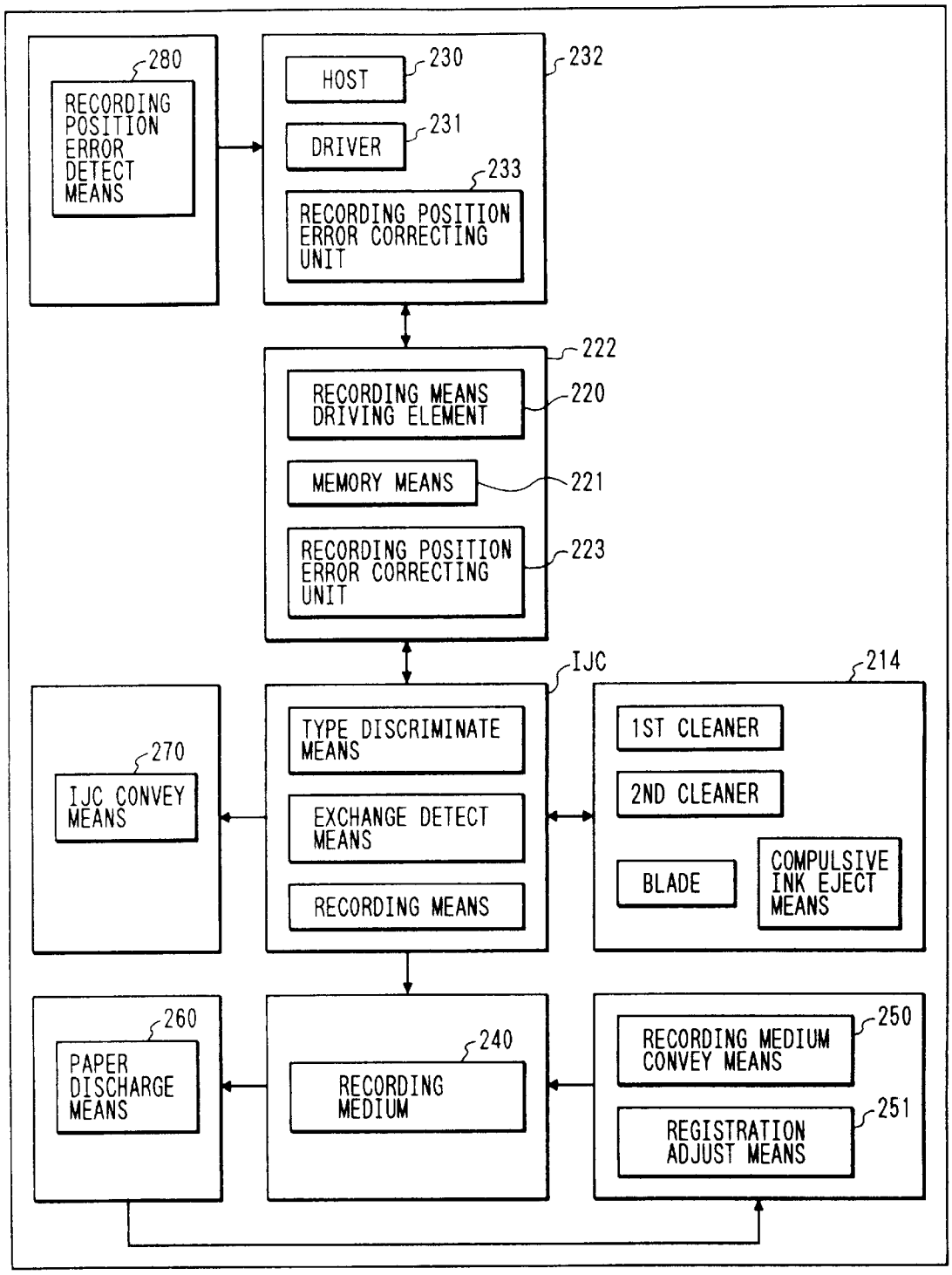
FIG. 56 is a block diagram showing the basic principle according to the 22nd embodiment of the present invention.

FIG. 56 is a diagram showing the overall system of the 22nd embodiment. The arrangement of this embodiment is substantially the same as that shown in FIG. 10, except that an IJC convey unit having an IJC convey means 270 for conveying an IJC unit onto a recording medium, a position error correcting means 223 or 233 for correcting a recording position error of the IJC unit, and a position error detect unit 280 for detecting a recording position error of the IJC unit, and supplying the detection value to at least one of a host unit 232 and a control unit 222 are added as a new arrangement.

Note that the position error correcting means 223 or 233 may be arranged in at least one of the host unit 232 and the control unit 222.

OVERALL CONTROL FLOW

Figure 57:
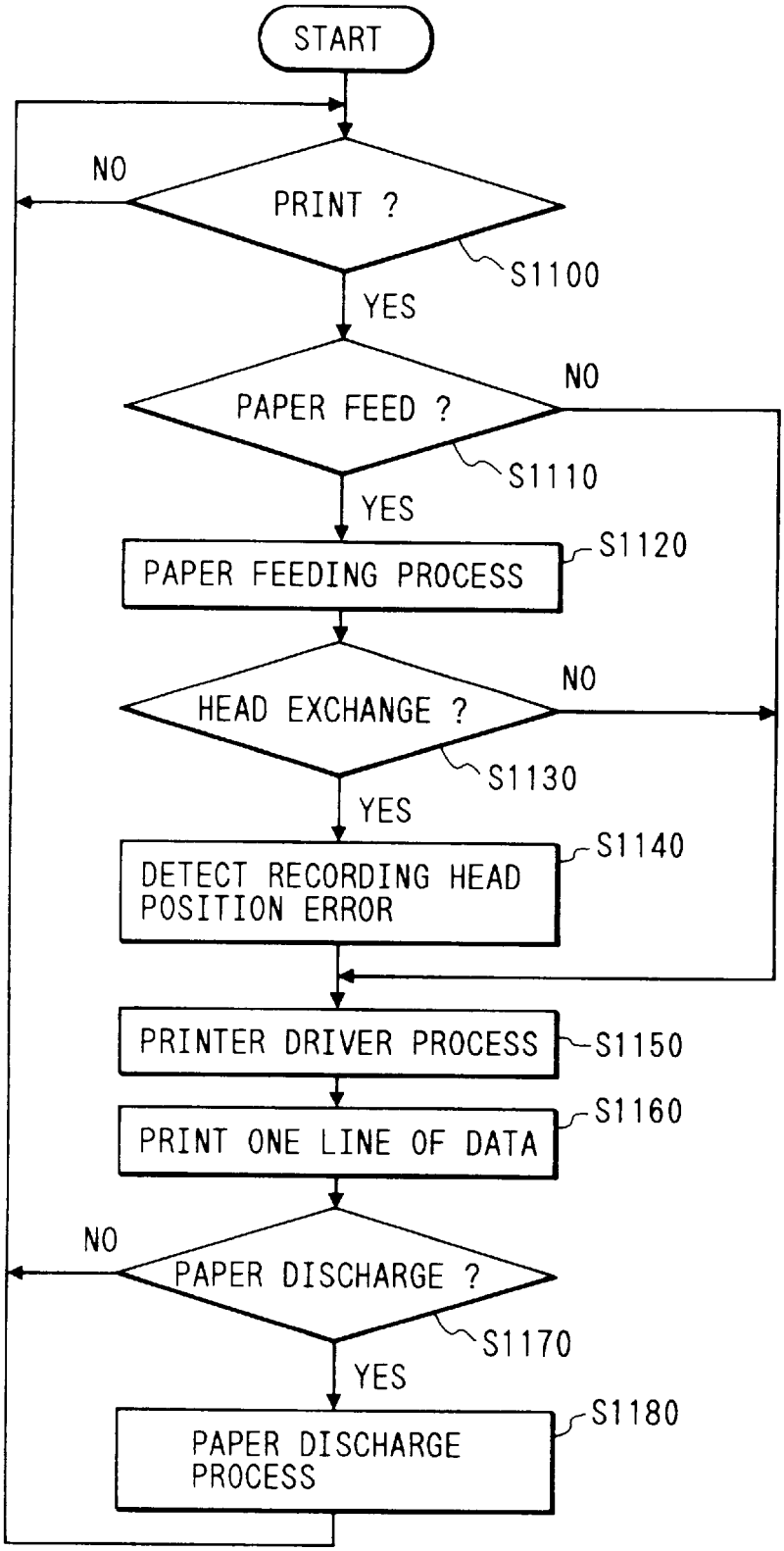
FIG. 57 is a flow chart for explaining an operation of the 22nd embodiment.

An operation executed when recording is performed using the recording apparatus with the above arrangement will be described below with reference to the flow chart of FIG. 57.

If it is determined in step S1100 that a print command is input, it is checked in step S1110 if a recording medium need be fed. If Y (YES) in step S1110, paper feeding processing of the recording medium is executed by the recording medium convey means in step S1120. At this time, if a recording head need be exchanged with another or attached/detached, the corresponding operation is performed (S1130). In step S1140, a recording position error caused upon re-feeding of the recording medium or attachment/detachment of the recording head is detected (the details of the position error detect means will be described later).

In step S1150, position error correction is performed by the position error correcting means according to the position error detect means (the details of the position error correcting means will be described later). Thereafter, print pattern information from the host unit is converted by a printer driver into a format suitable for the controller (or control) unit, and the converted information is transferred. The controller unit drives the IJC convey unit according to the transferred print information so as to scan the IJC unit to a correct recording position, and executes recording. Thus, the print operation for one line of data is completed (S1160). Simultaneously with completion of the print operation for one line, the recording medium is fed by one line, and it is then checked if the recording medium need be discharged (S1170).

In this case, the recording medium is discharged according to a command from the host unit or is discharged since a print region of the recording medium is ended. If the recording medium need be discharged, the recording medium is discharged outside the apparatus using a paper discharge means in step S1180. Upon repetition of the above-mentioned operations, the print operation on the recording medium can be executed while detecting and correcting the recording position error.

DETECTION OF RECORDING POSITION ERROR AMOUNT

The detect means for detecting the recording position error amount in the recording operations will be described in detail below with reference to the accompanying drawings.

Figure 58A:
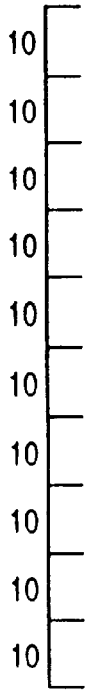
FIGS. 58A and 58B are explanatory views of a recording position error detection means.
Figure 58B:
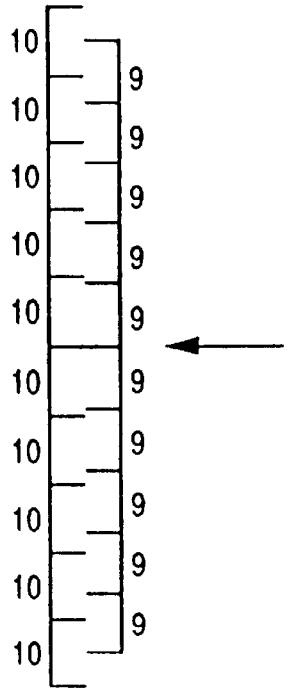

FIGS. 58A and 58B show position error amount detection patterns of recording practiced in this embodiment. FIG. 58A shows a position error detection pattern printed at a designated position of a recording medium at the beginning of recording executed by a head in a first process. An ink recording means for performing recording in the first process serves as a reference position for detecting a position error amount upon execution of recording in subsequent processes. FIG. 58B shows a state wherein a position detection pattern is printed at a designated position of the recording medium at the beginning of recording executed by an ink recording means in a second process. The position detection pattern in the first process has divisions at 10-mm intervals, while the position error detection pattern in the second process has divisions at 9-mm intervals.

Thus, the position error amount is detected as follows. For example, as shown in FIG. 58B, when the fifth division position of the position error detection pattern printed in the first process coincides with the sixth division position of the position error detection pattern printed in the second process, since the 50-mm position (10*5) in the first process coincides with the 54-mm position (9*6) in the second process, it can be detected that the recording positions in the first and second processes are shifted by +4 mm in the paper convey direction (to be referred to as a main scanning direction hereinafter).

Similarly, when a difference between horizontal position error detection patterns (not shown) printed in the first and second processes is read, an error amount in a direction perpendicular to the paper convey direction (to be referred to as a sub-scanning direction hereinafter) can be easily detected.

As described above, the first process is a process for performing recording on a recording medium using a first ink, and the second process is a process in which the recording medium discharged outside the apparatus by the paper discharge means after the end of recording in the first process using the first ink is re-fed into the apparatus by the recording medium convey means, and recording is restarted after a head cartridge is exchanged with another to perform recording using a second ink.

In this embodiment, the position error detection patterns and their print positions are set in advance in accordance with the types of head cartridge, and the same pattern will not be repetitively used among the cartridges. The type of cartridge is detected by a type discrimination means of the IJC unit. For example, a known head type discrimination means such as a method wherein a predetermined position of a signal line of a head is cut, and the type of cartridge is discriminated based on open/close information of the signal, and the like may be used.

Figure 59:
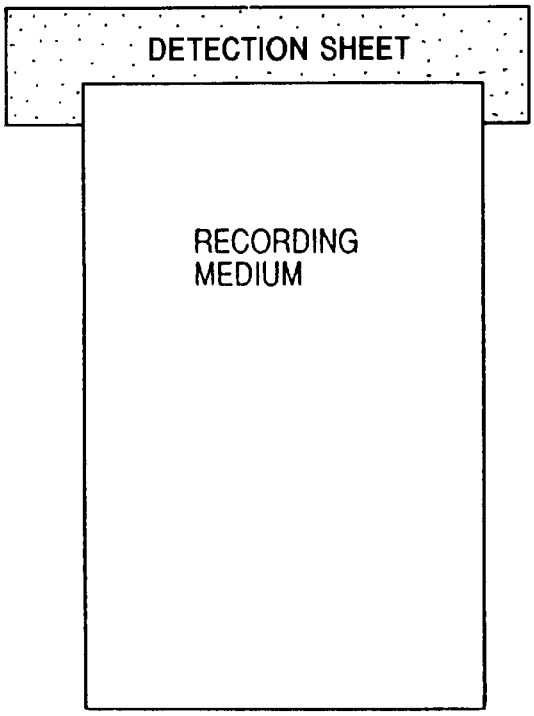
FIG. 59 is a view for explaining another recording position error detection method.

In this embodiment, since the position error detection patterns are printed on the recording medium, images (position error detection patterns) other than an image requested by a user remain on the recording surface. When a user does not want to leave the position error detection patterns on the recording surface, a detection sheet may be attached to the recording medium, as shown in FIG. 59. More specifically, the above-mentioned position error detection patterns are printed on the detection sheet, and after the required recording processes are completed, the detection sheet is peeled off. Thus, the position error amount can be detected without contaminating the recording surface. The detection sheet preferably has an adhesive layer, which can be easily peeled off from the recording sheet.

CORRECTION OF RECORDING POSITION ERROR

The correcting means for correcting the recording position error amounts in the recording operations will be described in detail below with reference to the accompanying drawings.

Figure 60:
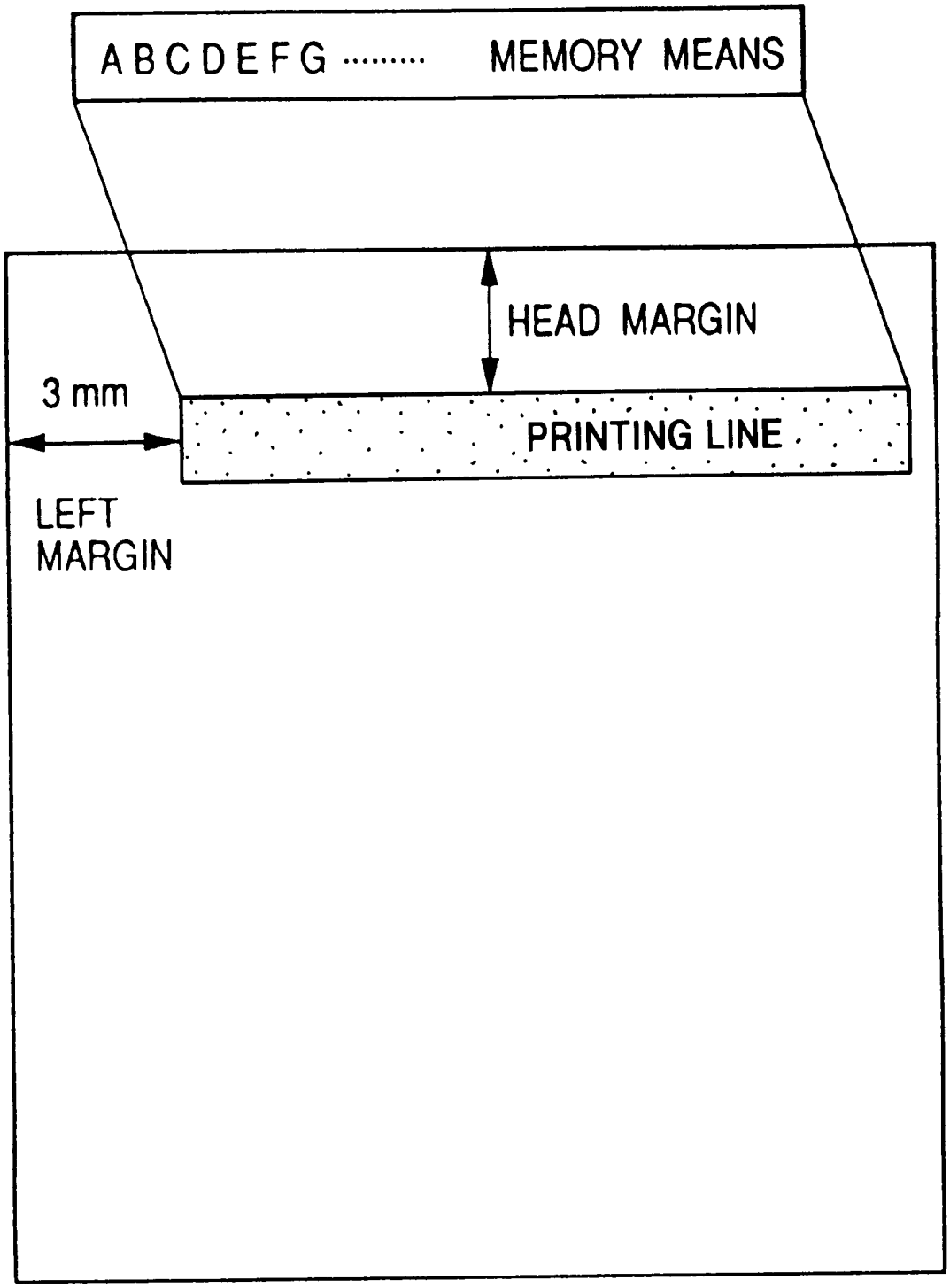
FIG. 60 is an explanatory view of a recording position error correction means.

FIG. 60 is an explanatory view of the correcting means for correcting the error amount of the recording position in the sub-scanning direction practiced in this embodiment. When there is no special designation from the host unit, the printer driver develops a pattern to be printed, and writes the developed pattern in a memory means of the control unit in a left-shifted state. Thereafter, the print operation is performed at a designated position according to the information on the memory means. In this embodiment, since an initial recording position is a position separated by 3 mm from the left edge of a recording sheet, the print operation is started from the position separated by 3 mm from the left edge of the recording sheet. A recording position offset can be set by a command. For example, when a user sets to start the print operation from a position separated by 5 mm from the left edge, the initial recording position must be offset by 2 mm in the sub-scanning direction. A general processing means in this case will be explained below.

The printer driver stores margin data for 2 mm at the beginning of the memory means before it stores print data in the memory means, and thereafter, stores the print data. Since a recording means starts the print operation of print data including the margin data from the position separated by 3 mm from the left edge as a reference left-margin position, the print operation is consequently started from a position separated by 5 mm from the left edge, thus realizing the user's condition, i.e., the 5-mm left margin.

In this embodiment, the recording position error in the sub-scanning direction is corrected by changing the left margin. For example, assume that a left margin value set by a user is 5 mm, and a recording position error amount obtained by the above-mentioned means is +1 mm. More specifically, if the print start position in the immediately preceding process is a 5-mm position, the sub-scanning positions in two processes can coincide with each other by starting the print operation from a 6-mm (=5+1) position in the current process. Main causes of the error are an error caused by paper feeding position reproducibility upon re-feeding of a recording medium, and an error caused upon exchange of ink cartridges. Thus, in this embodiment, in order to correct the recording position error in units of processes, control is made by the position error correcting means of the host unit as if the left margin were 6 mm in this print process only. More specifically, the printer driver stores margin information for 3 mm in the memory means, and thereafter, stores print data. Under the above-mentioned control, the actual recording position corresponds to the 3-mm reference left-margin position+the 3-mm margin, i.e., a total of 6-mm margin, and recording is started after this margin. In this manner, the print operation can be performed while correcting a variation in recording position in units of processes.

The error amount in the main scanning direction is corrected by controlling a head margin setting value like in correction of the error amount in the sub-scanning direction. More specifically, if the head margin setting value is 5 mm, and the error amount in the main scanning direction is +1 mm, control is made to have a head margin of 6 mm (=5+1), thus correcting the error amount in the main scanning direction.

In this embodiment, since the detection value of the position error amount is input by a user to the host unit, the recording position error amount is corrected by margin information set by the printer driver in the memory means of the control unit. Alternatively, the position error correcting means may be provided to the control unit, and a user may input data to the control unit via an interface. In this case, the position error correcting means is controlled to increase/decrease a margin of print information on the memory means set by the printer driver according to a position error correction value.

As described above, since the apparatus comprises the recording position error detect means for detecting a recording position error in units of recording processes, and the recording position error correcting means for correcting the recording position error in units of recording processes, the recording position error in units of processes can be eliminated even in an ink jet recording method including a plurality of paper feed/discharge processes, and a plurality of attachment/detachment operations of ink recording means, and a high-image quality ink jet recording apparatus using a plurality of ink recording means can be provided without deteriorating compact, low-cost, and easy-to-handle features of the apparatus itself.

23RD EMBODIMENT

In the above embodiment, a user detects the error amount. However, an apparatus may automatically detect the error amount without asking for a user's decision.

Figure 61:
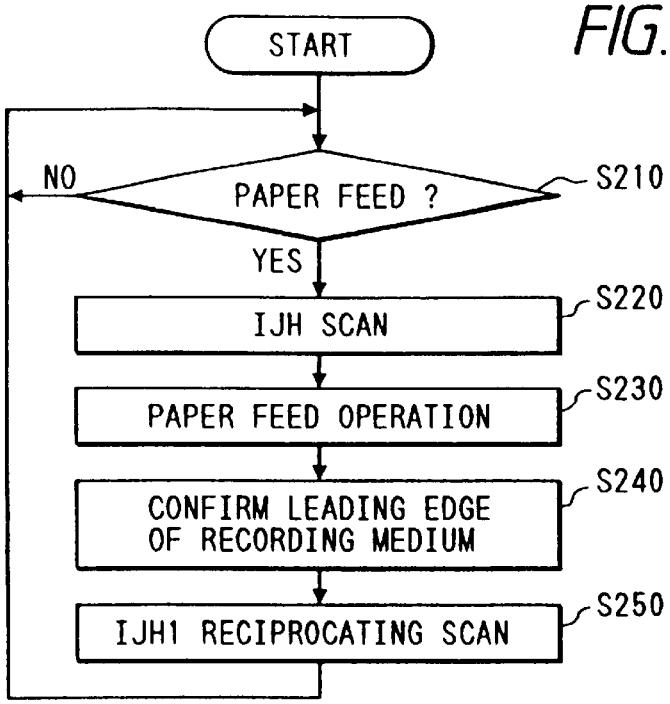
FIG. 61 is a flow chart for explaining an operation of a recording position error detection method according to the 23rd embodiment of the present invention.

In this embodiment, the recording position error amount is detected by a reflection type sensor (not shown) mounted on the ink jet head IJH shown in FIG. 5. A detection operation will be described in detail below with reference to the flow chart shown in FIG. 61.

If a paper feed command is input in step S1210, the driving motor 5013 of the carriage is driven to convey the carriage HC to a convey path position of a recording medium P (S1220). In step S1230, a recording medium convey means is driven to feed the recording medium P. The number of pulses for driving a driving motor (stepping motor; not shown) generated until the recording medium P is detected by the reflection type sensor mounted on the IJH is detected, thereby detecting the leading edge position of the recording medium P (S1240). Then, in step S1250, the driving motor 5013 for scanning the carriage HC is rotated in the forward and reverse directions so as to detect the left edge position of the recording medium in the same manner as detection of the leading edge position of the recording medium.

As described above, every time the recording medium P is fed, i.e., every time an ink recording means is exchanged with another, the recording position error (a difference from the recording position in the immediately preceding process) is detected by the reflection type sensor mounted on the IJH, and the position error information is transferred to a position error correcting means of a host unit or a control unit. Thus, the recording position error is corrected without asking for user's processing (decision), and high-image quality recording can be realized. As described above, the main causes of the error are an error caused by paper feeding position reproducibility upon re-feeding of a recording medium, and an error caused upon exchange of the ink recording means. In this embodiment, however, since the sensor mounted on the ink recording means is used, a detection reference is the ink recording means position after the ink recording means is mounted, and the error caused upon exchange of the ink recording means can be eliminated. Also, since the paper feeding position of the recording medium is detected every time the recording medium is fed, the error caused by paper feeding position reproducibility upon re-feeding of the recording medium can also be eliminated. Therefore, the recording position error can be precisely detected.

Furthermore, in the above embodiment, the print positions of the position error detection patterns are changed in correspondence with the types of recording heads. However, the position error detect means of this embodiment need not detect the type of ink recording means.

In this embodiment, the reflection type sensor is mounted on the ink recording means. However, in an apparatus in which the error caused upon exchange of the ink recording means is sufficiently small, the reflection type sensor may be mounted on the carriage HC so as to reduce cost of an ink ejection means. As the reflection type sensor, a normal sensor, which is mounted as a paper width sensor in a serial printer for scanning a carriage, integrally comprises a light-emitting element and a light-receiving element, and detects the presence/absence of a recording medium according to the level of reflected light received by the light-receiving element, may be used.

Under the above-mentioned control, the recording position error in units of recording processes can be detected by the apparatus alone without asking for a user's operation.

Since the arrangements and operations except for the recording position error detect means for detecting the recording position error in units of recording processes are the same as those in the above embodiment, a detailed description thereof will be omitted.

24TH EMBODIMENT

Each of the 22nd and 23rd embodiments has means for detecting the recording position error in units of recording processes, and correcting the print position according to the detection value. Alternatively, a means for preventing a recording position error of a practical use level may be used.

As described above, the main causes of the error are an error caused by paper feeding position reproducibility upon re-feeding of a recording medium, and an error caused upon exchange of ink recording means. In this case, the error amount caused upon exchange of ink recording means is normally several tens of $\mu$m, and the error amount caused by paper feeding position reproducibility upon re-feeding of a recording medium is normally several hundreds of $\mu$m. Therefore, a dominant error factor is normally caused by the paper feeding position reproducibility. Therefore, in this embodiment, a recording position error of a practical use level is prevented by suppressing the error factor caused by the paper feeding position reproducibility.

Figure 62:
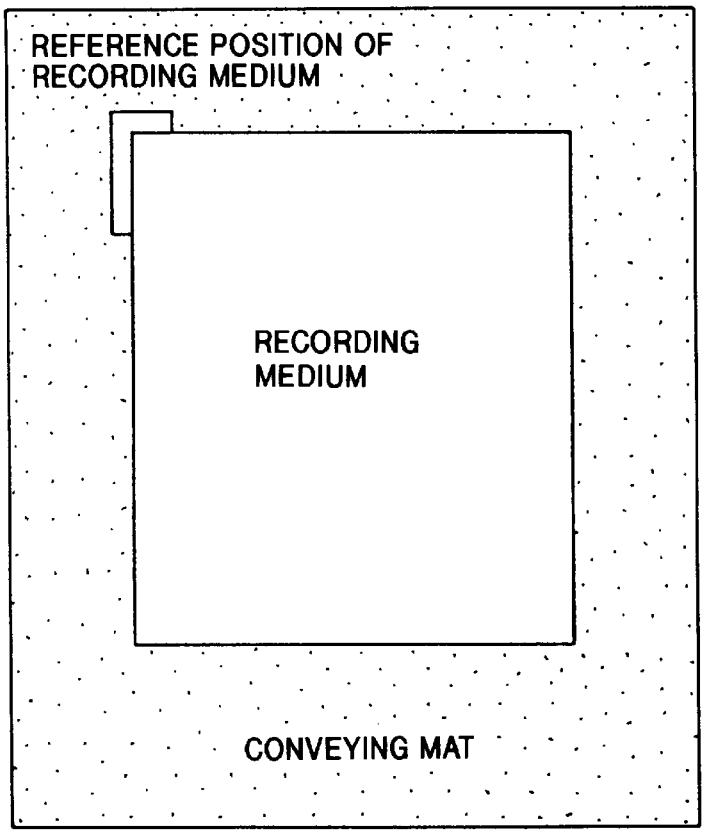
FIG. 62 is an explanatory view of a conveying means for eliminating a recording position error according to the 24th embodiment of the present invention.

FIG. 62 is an explanatory view of a position error preventing means for preventing the recording position error. In FIG. 62, a recording medium joined on a conveying mat is conveyed. The way of improving recording position precision upon joining of a recording medium on the conveying mat will be described in detail below.

The error factor caused by the paper feeding position reproducibility will be separately discussed in the main scanning direction (recording medium convey direction) and the sub-scanning direction.

The main cause of a paper feeding position reproducibility error in the subscanning direction is skewing of a recording medium during a convey process. More specifically, since a recording medium is conveyed not precisely in the main scanning direction but obliquely in a paper feeding or convey process, the recording position in the sub-scanning direction varies in units of processes. Therefore, in order to eliminate this error factor, a guide member for guiding the two sides of a recording medium over the total length of a convey path in the convey process of the recording medium is arranged, thus enhancing the skew preventing effect. Normally, however, since the size of a recording medium is not fixed, a recording medium convey means and a recording medium convey path must correspond to a random recording medium size. For this reason, it is very difficult to arrange the above-mentioned convey guide contiguous with all convey paths corresponding to all recording medium sizes.

However, in this embodiment, when recording is performed in a plurality of processes requiring high recording position precision, since a recording medium is always conveyed in a predetermined size, the convey guide can be exclusively arranged, and the recording position error in the sub-scanning direction can be greatly eliminated. Since the convey guide need not correspond to all paper types, it can be designed according to the characteristics (various characteristics of a conveying medium such as a making texture direction, stiffness, surface frictional coefficient, and the like) of the conveying mat. Thus, convey stability can be remarkably improved, and the recording position error in the sub-scanning direction can be greatly eliminated.

A paper feeding position reproducibility error in the main scanning direction is mainly caused by an error of a constant registration setting means upon feeding of a recording medium. Normally, the recording apparatus comprises a means for setting a constant registration position of the leading edge of a recording medium by utilizing body (stiffness) of the recording medium. As described above, however, it is difficult to optimize control and arrangement in correspondence with all recording media having various characteristics, and the condition of the recording medium convey means is set so as not to pose any serious problem even for recording media of any characteristics. For this reason, an error is easily generated by a paper feeding means which is a particularly sensitive means in the recording medium convey means, and utilizes body (stiffness) of a recording medium.

However, in this embodiment, when recording is performed in a plurality of processes requiring high recording position precision, since a recording medium is always a special-purpose conveying medium having predetermined characteristics, paper feeding stability of a recording medium (conveying mat) can be remarkably improved, and as a result, the recording position error in the main scanning direction can be greatly eliminated.

In order to further improve recording position precision, the conveying mat should be a medium, which does not change its characteristics depending on environmental conditions, but has good environmental stability.

The convey guide contiguous with the entire convey path, and the registration means utilizing body (stiffness) of a recording medium (conveying mat) described in this embodiment are merely examples. When various known techniques for stabilizing paper feed/discharge characteristics•conveying characteristics of a recording medium are selected in correspondence with the characteristics of the conveying mat, or when the characteristics of the conveying mat are optimally selected in correspondence with the various known techniques for stabilizing paper feed/discharge characteristics•conveying characteristics of a recording medium, the paper feed/discharge characteristics•conveying characteristics of the conveying mat can be remarkably stabilized.

As described above, since the recording medium convey means capable of improving precision of the paper feed/discharge characteristics•conveying characteristics, a dominant error factor which causes a variation in recording position precision in units of processes can be eliminated, and the recording position error can be suppressed to an allowable level in a practical use.

Since the arrangements and operations except for the recording position error preventing means for preventing the recording position error in units of recording processes are the same as those in the above embodiment, a detailed description thereof will be omitted.

25TH EMBODIMENT

The present invention includes use of various position correction means as its invention. As an example, an indication portion for position detection is provided to a recording medium itself, and is detected by a contact method or a non-contact method (e.g., an optical sensor) to repeat forward/reverse convey operations and leading edge registration adjustment of the recording medium, or to correct the data recording timing. Furthermore, in order to detect the edge or the indication portion of a recording medium, a paper width sensor attached to a carriage may be commonly used.

When such examples are expressed as means, a host-side position adjustment means, a printer-side position adjustment means, and a position adjustment means attained by a system of the host apparatus and the printer are available. These means include all kinds of methods such as a mechanical adjustment method alone, a software adjustment method alone, a combination of these adjustment methods, and the like.

As described above, according to the 22nd to 25th embodiments of the present invention, the recording position error in units of processes can be eliminated even in an ink jet recording method including a plurality of paper feed/discharge processes, and a plurality of attachment/detachment operations of ink recording means, and a high-image quality ink jet recording apparatus using a plurality of ink recording means can be provided without deteriorating compact, low-cost, and easy-to-handle features of the apparatus itself.

26TH EMBODIMENT

When recording operations are performed a plurality of number of times using different ink recording heads like in the first embodiment described above, the plurality of recording operations cannot always be performed in the same state, and the following problems are expected.

(1) Fixing Characteristics on Single Recording Medium

When a plurality of ink recording heads are used in a single ink jet recording apparatus, if a recording medium is discharged outside the apparatus after the end of a single recording process, the fixing characteristics of an image are relatively stable. Even when re-recording is performed, the recording medium is restored to a dried state before ink recording is performed. However, when recording is performed at a very high duty, an image is not fixed very easily, and it often takes a long period of time to restore the recording medium to a sufficiently dried state. There are various kinds of recording media, and the fixing time varies depending on the kinds of recording media. For example, an OHP sheet requires a particularly long fixing time. Furthermore, in, e.g., a high-humidity environment, an image is difficult to fix as compared to a normal environment, and the fixing characteristics vary depending on the environment of the ink jet recording apparatus. As described above, when the next recording is performed on a single recording medium on which an image formed in the immediately preceding process is not sufficiently fixed, a different or same color ink is printed on the ink remaining on the recording medium, and blurring is caused at their boundary.

(2) Influence of Ink Recording Head Temperature on Image Quality

When recording operations on a single recording medium are performed for a plurality of recording media, the ink recording heads are not always in the same state, and the temperature rise upon continuous execution of recording is different from that upon intermittent execution of recording. Also, the temperature rise of the ink recording head varies depending on the print duty. When the temperature of the ink recording head varies, the ejection amount varies accordingly even under the same driving condition, and the density is changed consequently. In a monochrome image, even when the density is changed more or less, it is not so conspicuous. However, when the density of a color image is changed, the color tone is changed, and such a change becomes visually conspicuous. That is, even though images are recorded by the same method, they have different color tones.

(3) Variation Among A Plurality of Ink Recording Heads

When recording is performed on a single recording medium using a plurality of ink recording heads, the ink recording heads suffer from a variation, e.g., a variation in optimal driving energy value. When such heads are used as they are, the following adverse effects appear. For example, when the heads are driven by energy higher than an optimal value, the service life of the ink recording heads may be shortened. Conversely, when the heads are driven by energy lower than the optimal value, ejection may be disabled or irregular ejection may be performed.

The 26th embodiment can solve the above-mentioned problems. A method of controlling a driving sequence for maintaining high image quality in an ink jet recording apparatus for performing recording on a single recording medium using a plurality of ink recording heads will be described below.

Figure 63:
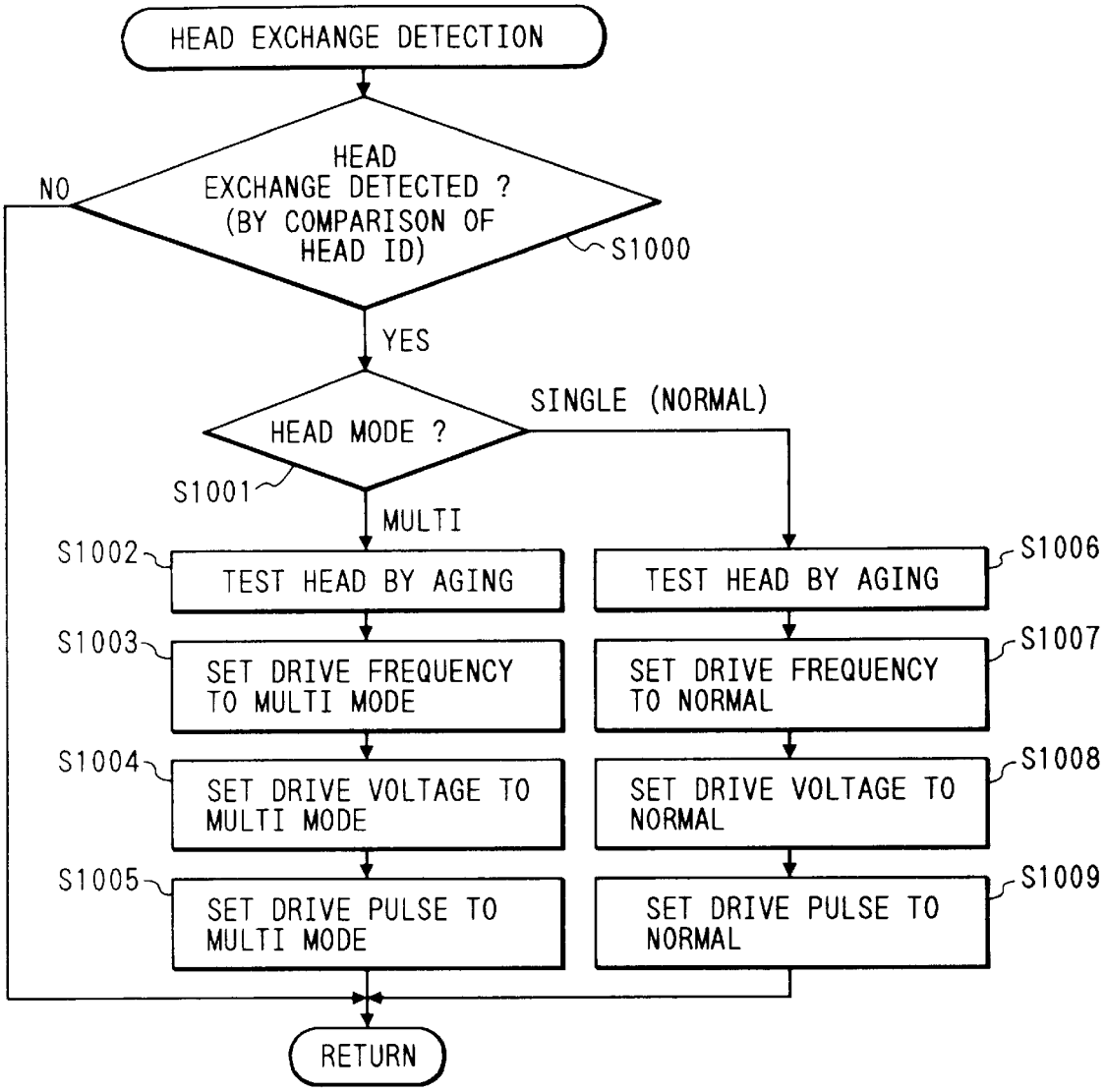
FIG. 63 is a flow chart showing a driving sequence upon exchange of ink recording heads so as to explain the basic principle according to the 26th embodiment of the present invention.

FIG. 63 is a flow chart showing a driving sequence for practicing the present invention. When exchange of ink recording heads is detected or recognized by an exchange detect means (step S1000), a mode of the ink recording head is detected or recognized (step S1001).

When a mode using a plurality of ink recording heads (multi mode) is detected or recognized, aging of the ink recording head is performed (step S1002). The state of the ink recording head can be tested by detecting the temperature rise of the ink recording head during aging. For example, an ejection amount is predicted based on the temperature rise within a predetermined period of time. In an efficient ink recording head, most of energy is used for ejecting an ink, and the temperature rise of the ink recording head caused by waste energy is small. However, in an ink recording head having poor efficiency, since energy is considerably wasted, the ejection amount is decreased accordingly, and the temperature of the ink recording head undesirably rises. Therefore, the ejection amount can be predicted from the temperature rise of the ink recording head during aging. When an ink recording head suffers from an ink omission state, the temperature of the head immediately rises. This abnormality can be detected before a print operation. Furthermore, in the multi mode, since recording operations are performed a plurality of number of times on a single recording medium, even a single erroneous recording operation considerably affects image quality as compared to a normal mode using a single ink recording head (normal mode). Therefore, aging is also effective for improving reliability.

Ink recording head driving conditions such as a driving frequency, a driving voltage, a driving pulse, and the like are set in the multi mode as a unique driving mode for performing recording operations a plurality of number of times on a single recording medium (steps S1003 to S1005).

The driving frequency is set to be lower than that in the normal mode since an importance is placed on reliability of high-quality recording. Also, reliability may be improved by setting an optimal frequency for each ink recording head. Conversely, in the multi mode, since recording operations are performed a plurality of number of times on a single recording medium, the print time is prolonged as compared to the normal mode. Thus, the driving frequency may be increased so as not to deteriorate image quality, so that the print time can be shortened.

The driving voltage must be set for each ink recording head. Since the driving voltage is an important factor for determining energy necessary for an ink recording head to perform ejection, if the ink recording head is driven by unnecessarily high energy, the service life of the ink recording head is shortened. Conversely, when energy is too low, normal ejection is disturbed. Therefore, when heads are exchanged, in particular, in the multi mode in which heads are exchanged frequently, the driving voltage must be set in correspondence with each ink recording head.

The driving pulse is also an important factor for determining energy necessary for an ink recording head to perform ejection as well as the driving voltage. Furthermore, the ejection amount can be controlled based on the pulse width or using multi-pulses. Therefore, when the driving pulse is set for each ink recording head, ejection amount control in units of ink recording heads can be realized. When the state of the ink recording head is detected during aging, the ejection amounts of the respective ink recording heads can be uniformed. Thus, ejection amount control can be performed to follow a change in state of the ink recording head, e.g., a change over time or a temperature rise due to ejection of a single ink recording head.

In the normal mode, normal conditions are set (steps S1006 to S1009).

Figures 64, 64A:
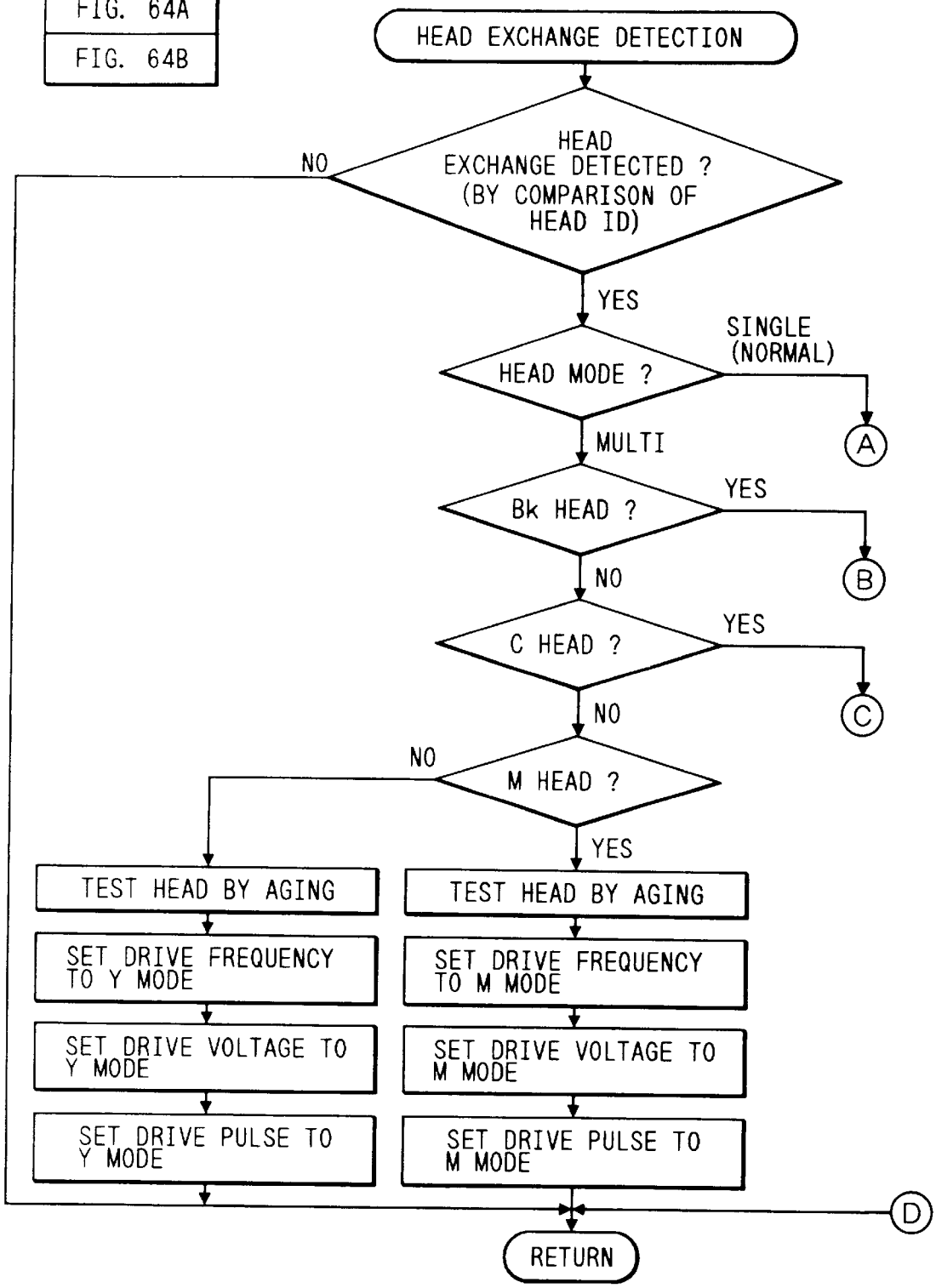
FIG. 64, which is comprised of FIGS. 64A and 64B, is a flow chart showing a sequence for setting a driving condition in units of ink recording heads upon exchange of the ink recording heads according to the 26th embodiment.
Figure 64B:
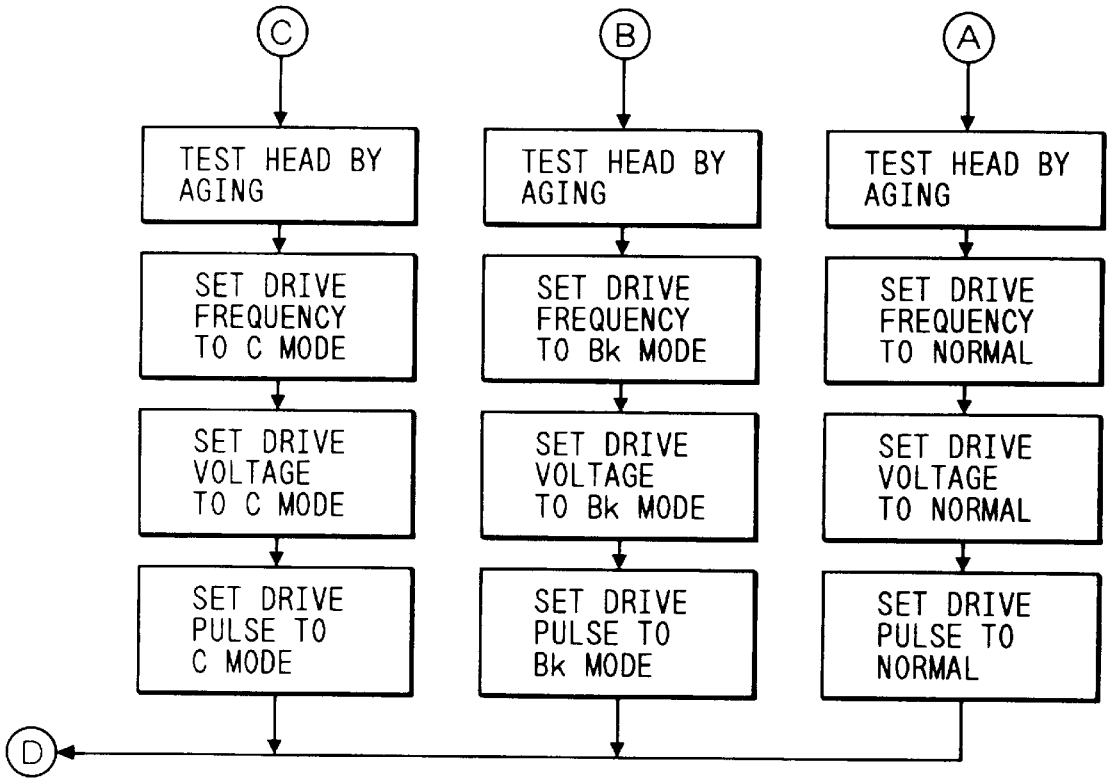

FIG. 64 shows a detailed driving sequence executed when Bk, C, M, and Y ink recording heads are used. When it is detected that ink recording heads are exchanged, the mode of the ink recording head to be used next is detected or recognized. If the multi mode is detected or recognized, the type of ink is sequentially discriminated. In the normal mode, the Bk ink recording head is normally used. However, since a Bk ink is sometimes used in the multi mode, the head can be selectively used based on, e.g., a head ID from the head for the normal mode.

It is checked if the exchanged head is a Bk ink recording head. If the exchanged head is a Bk ink recording head, the state of the ink recording head is checked by a head test by means of aging, and driving conditions unique to the Bk ink recording head are set in correspondence with the test result. If it is determined that the exchanged or new head is not a Bk ink recording head, it is checked if the exchanged head is a C ink recording head. If the exchanged head is a C ink recording head, aging is performed like in the Bk ink recording head, and driving conditions unique to the C ink recording head are set. Furthermore, if it is determined that the exchanged head is not a C ink recording head, it is checked if the exchanged head is an M ink recording head. If the exchanged head is an M ink recording head, driving conditions unique to the C ink recording head can be set; otherwise, driving conditions unique to a Y ink recording head can be set. In this embodiment, the type of ink is discriminated in the order of Bk, C, M, and Y. However, the head can be discriminated by the same method regardless of the discrimination order or the number of types of ink recording heads, and driving conditions unique to the multi mode can be set.

As described above, the mode for performing recording operations a plurality of number of times on a single recording medium is detected or recognized, and the driving conditions and sequence are set in the unique multi mode, so that high-image quality recording can be realized even when a plurality of ink recording heads are used.

27TH EMBODIMENT

In this embodiment, a driving method which pays attention to the fixing characteristics of an ink so as to maintain high image quality when recording operations are performed a plurality of number of times on a single recording medium will be explained.

When recording operations are performed a plurality of number of times on a single recording medium, the behavior of an ink landing on a new recording medium is different from that on a recording medium which is subjected to several recording operations, and on the surface of which an ink or an ink component remains. In the latter medium, if a different ink is used, it causes blurring due to color mixing. In order to prevent this, the previous ink is sufficiently fixed, and recording is resumed when the recording medium is restored to a dried state close to a state before ink recording. However, cost is considerably increased if, e.g., a fixing device for merely fixing the ink is arranged.

Figure 65:
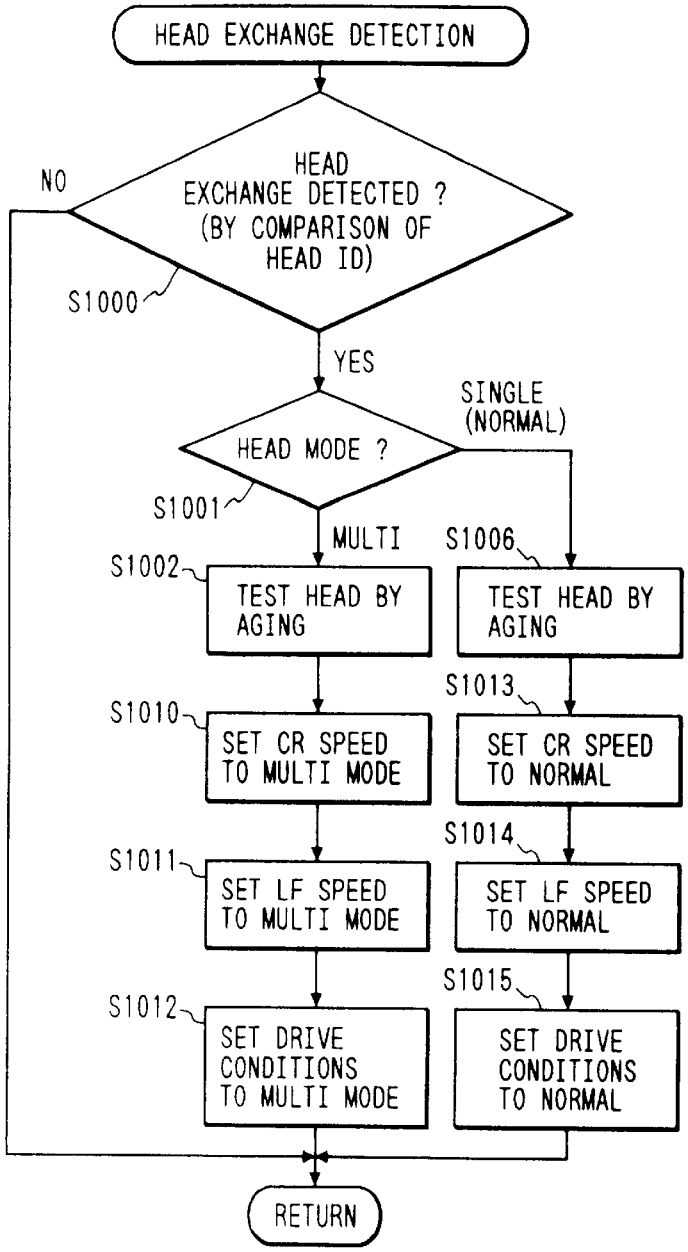
FIG. 65 is a flow chart showing a sequence for setting the CR and LF speeds in a multi ink recording head mode according to the 27th embodiment of the present invention.

In this embodiment, a fixing time for improving the fixing characteristics without increasing cost is set. More specifically, the fixing time is set by using a sequence shown in FIG. 65. If a mode using a plurality of ink recording heads (multi mode) is detected, a carriage moving speed (to be referred to as a CR speed hereinafter) and a recording medium convey speed (to be referred to as an LF speed hereinafter) are set to be different from those in a normal mode (steps S1010 and S1011). The CR and LF speeds in the multi mode may be uniquely set to be lower than those in the normal mode, or may be set in correspondence with each ink recording head. Thereafter, other driving conditions are set to prepare for recording (step S1012). In the normal mode, the CR and LF speeds are restored to normal speeds, and other driving conditions are re-set to prepare for recording. The CR and LF speeds can be independently set, and are set to have values according to the mode, the ink recording head to be used, and a recording medium (steps S1013 to S1015).

This method is effective for multi-pass recording (recording for one line is performed by a plurality of passes). That is, the CR and LF speeds can be set, so that a print operation in a given pass can be performed after an ink printed in the immediately preceding pass is sufficiently fixed.

Alternatively, the CR and LF speeds during printing may be left unchanged, and after the print operation for one page, a recording medium may be left in position for a while to promote fixing in place of discharging the recording medium immediately. In this case, since the recording medium is not discharged from the apparatus, a user can be prevented from touching an unfixed recording medium, and as a result, deterioration of image quality can be prevented. The stop time may be uniquely set for the multi mode, or may be set in correspondence with each ink recording head. Table 5 below shows examples of the stop time.

In Table 5, the CR and LF speeds are set according to the state of a recording medium, i.e., the ejected ink amount. The number of printed dots is counted and stored in a RAM.

As the number of dots is larger, the ink becomes more difficult to fix. Therefore, as the number of dots is larger, the CR speed is increased, and the LF stop time is prolonged. In this manner, the stop time suitable for the state of a recording medium can be set, and an efficient stop time can be selected as compared to a case wherein the stop time is set uniquely.

TABLE 5

CR/LF Control Table According to Print Duty

| No. of Print Dots per Page (M) | CR/LF Stop Time (sec) |
|---|---|
| less than 400 | 5 |
| 400 to 1,000 | 10 |
| 1,000 to 2,000 | 15 |
| 2,000 to 3,000 | 20 |
| 3,000 to 4,000 | 30 |
| 4,000 to 5,000 | 45 |
| more than 5,000 | 60 |

As described above, according to this embodiment, although the print speed is lowered, the fixing time is set to satisfactorily fix an ink, and recording operations can be performed a plurality of number of times when a recording medium is in a dried state close to a state before ink recording, thus maintaining high-quality recording.

28TH EMBODIMENT

In this embodiment, a case will be described below wherein movement of a carriage and convey of a recording medium are stopped according to the environment for recording.

In an ink jet recording apparatus, the fixing characteristics of a recording medium subjected to recording largely depend on the environment. The ink ejection amount depends on the environmental temperature. If the environmental temperature is high, the ejection amount is increased; otherwise, it is decreased. Also, the time required for fixing changes depending on the ejection amount. Therefore, fixing time control according the environment for recording is necessary.

Table 6 below shows a print stop time according to the environmental temperature or the temperature of an ink recording head. As the environmental temperature or the temperature of an ink recording head is higher, the required fixing time is prolonged. In Table 6, the print stop time is prolonged as the temperature becomes higher. When the stop time is set according to the environmental temperature or the temperature of the ink recording head immediately before a plurality of recording operations, a stop time suitable for recording to be performed can be set. When the temperature of the ink recording head can be detected or predicted, the stop time can be changed to follow a change in temperature of the ink recording head due to the temperature rise caused by the immediately preceding recording. Thus, the stop time can be more suitably controlled as compared to a case wherein the environmental temperature is used alone. When a plurality of ink recording heads are used, since the states of the ink recording heads are different from each other, the stop time is preferably set for each ink recording head.

TABLE 6

Print Stop Time Table According to Temperature

| Environmental Temperature or Ink Recording Head Temperature (° C.) | Print Stop Time (sec) |
|---|---|
| less than 10 | 0 |
| 10 to 15 | 2 |
| 15 to 20 | 5 |
| 20 to 25 | 10 |
| 25 to 30 | 20 |
| 30 to 35 | 30 |
| more than 30 | 40 |

Table 7 below is used when the stop time is controlled based on the temperature and the number of print dots. As the temperature is higher, and the ejection amount is larger, and as the number of print dots is larger, the fixing time is prolonged. When the print stop time is set for each ink recording head on the basis of a plurality of parameters, stop time control can be achieved more optimally.

TABLE 7

Print Stop Time Table According to State of Recording Medium

| | No. of Print Dots (M) | | | | | | |
|---|---|---|---|---|---|---|---|
| Temperature (° C.) | less than 400 | 400 to 1,000 | 1,000 to 2,000 | 2,000 to 3,000 | 3,000 to 4,000 | 4,000 to 5,000 | more than 5,000 |
| less than 10 | 0 | 2 | 5 | 10 | 20 | 35 | 50 |
| 10 to 15 | 2 | 5 | 10 | 15 | 25 | 40 | 55 |
| 15 to 20 | 5 | 10 | 15 | 20 | 30 | 45 | 60 |
| 20 to 25 | 10 | 15 | 20 | 25 | 35 | 50 | 65 |
| 25 to 30 | 20 | 25 | 30 | 35 | 45 | 60 | 75 |
| 30 to 35 | 30 | 35 | 40 | 45 | 55 | 70 | 85 |
| more than 35 | 40 | 45 | 50 | 55 | 65 | 80 | 55 |
| | | | | | | | (sec) |

In an ink jet recording apparatus comprising a humidity sensor, the stop time can be set according to the environmental humidity. Table 8 below shows the stop time according to the humidity. As the humidity is higher, the ink becomes difficult to dry, and a long fixing time is required. Therefore, as the humidity is higher, the stop time is prolonged.

TABLE 8

Print Stop Time Table According to Humidity

| Environmental Humidity (% RH) | Print Stop Time (sec) |
|---|---|
| less than 10 | 0 |
| 10 to 20 | 5 |
| 20 to 30 | 10 |
| 30 to 40 | 15 |
| 40 to 50 | 20 |
| 50 to 60 | 30 |
| 60 to 70 | 45 |
| 70 to 80 | 60 |
| 80 to 90 | 75 |
| more than 90 | 90 |

In this embodiment, the stop time of movement of the carriage and convey of a recording medium is controlled according to environmental conditions. When the stop time is set for each ink recording head, high image quality can be maintained even when recording operations are performed a plurality of number of times on a single recording medium. In this embodiment, control is made while paying attention to the fixing characteristics on a recording medium. The fixing characteristics of an ink also depend on the type of recording medium and the ink ejection amount. Also, the stop time of movement of the carriage and convey of a recording medium as the fixing time may be controlled according to the type of recording medium, which is set by a user in a host apparatus. Furthermore, the ejection amount of an ink recording head may be predicted from a change in temperature of the ink recording head during aging upon exchange detection of the ink recording head, and the stop time of movement of the carriage and convey of a recording medium may be controlled according to the predicted ejection amount. When control is made upon combination of a plurality of parameters, more proper control with higher precision can be achieved.

As described above, in this embodiment, since stop time of movement of the carriage and convey of a recording medium is set for each ink recording head in accordance with environmental conditions, the fixing characteristics are improved, and recording can be performed while maintaining high image quality even after a plurality of recording operations.

29TH EMBODIMENT

In this embodiment, a method of maintaining high image quality when recording is performed while repetitively exchanging a plurality of ink recording heads will be described below.

When recording is performed while repetitively exchanging a plurality of ink recording heads, the ink recording heads are not always in the same state, and the temperature rise upon continuous execution of recording is different from that upon intermittent execution of recording. Also, the temperature rise varies depending on the interval time between adjacent recording operations. Furthermore, a change in temperature of the ink recording head varies depending on the print duty. Even when recording is performed using the same ink recording head, the ejection amount changes according to the temperature of the head. When the ejection amount changes, the density changes accordingly, and the color tone of a color image is varied even by a slight variation in density. That is, images having different color tones are undesirably formed even when image formation is performed by the same print method using the same ink recording heads.

In order to realize higher image quality, the temperature of each ink recording head is detected or predicted, and driving conditions are set, so that the ink ejection amount estimated from the temperature of the ink recording head always remains the same in each ink recording head. Thus, recording can be performed at the same density even when the temperature of the ink recording head used varies. More specifically, the sequence shown in FIG. 63 is applied, so that every time ink recording heads are exchanged, the driving conditions are set to correct the ejection amount according to the temperature of the ink recording head to be used next.

When recording operations are performed a plurality of number of times on a single recording medium, recording beyond 300% duty must often be performed depending on print data. If recording is performed to have the same ejection amount as that in a normal mode, the ink amount on the recording medium becomes very large, and image quality is deteriorated. Therefore, in order to always maintain high image quality, the ejection amount in a multi mode is set to be smaller than in the normal mode. For example, the ejection amount of about 90 pl (picoliters) per dot in the normal mode is controlled to about 50 pl in the multi mode. In this case, data beyond 300% duty can be suppressed to 200% or less. The ejection amount can be set upon exchange of the ink recording head. In combination with the above-mentioned temperature, the ejection amount of each ink recording head can be effectively controlled. The ejection amount to be set may be stored in the ink jet recording apparatus itself or an ejection amount requested by a user may be set according to a command input in a host apparatus by the user. Furthermore, the ejection amounts of ink recording heads storing inks of the same type can be controlled to be equal to each other.

Figure 66:
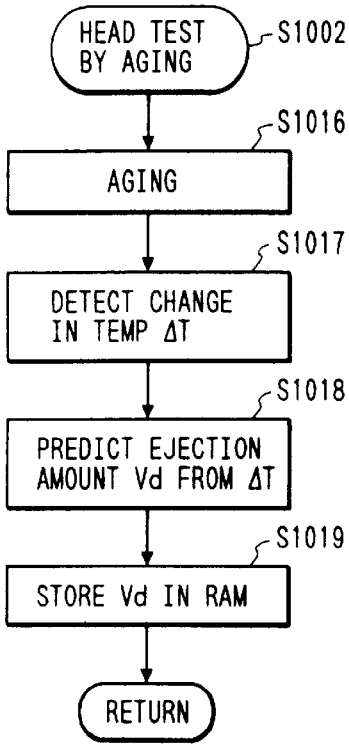
FIG. 66 is a flow chart showing a head test sequence on the basis of aging upon exchange of ink recording heads according to the 29th embodiment of the present invention.

The ejection amount is predicted based on a change in temperature during aging upon exchange of ink recording heads, and the predicted value is stored on a RAM in units of types of ink recording heads, so that the ejection amount of the current ink recording head is the same as that previously used in the ink jet recording apparatus. The RAM can store a plurality of ejection amounts for one type of ink recording head. More specifically, the ejection amount is predicted by a head test sequence shown in FIG. 66. First, aging is performed for the exchanged or new ink recording head (step S1016). A temperature rise of the head during a certain period, e.g., a period from the 1,000th shot to 4,000th shot, is detected (step S1017), and the ejection amount is predicted based on the temperature rise (step S1018). The ejection amounts corresponding to the temperature rises are measured in advance and are stored in the main body in the form of a table, and the ejection amount is predicted from the table values. Thereafter, the driving conditions are set based on the predicted ejection amount according to the sequence shown in FIG. 63. In this manner, even when various ink recording heads are used, the same ejection amount can always be obtained, and recording can always be performed at the same density. Note that the predicted ejection amount is stored in a RAM in the main body (step S1019).

In this embodiment, since the temperature of the ink recording head before recording is detected, the control can follow a change in environment, and a high-quality color image can always be formed.

As described above, according to the 26th to 29th embodiments of the present invention, in an ink jet recording apparatus for performing recording by ejecting an ink, the problems of the ink jet recording heads caused upon execution of a plurality of recording operations on a single recording medium can be solved, and a high-quality color image in at least two colors can be easily recorded.

30TH EMBODIMENT

Figure 67:
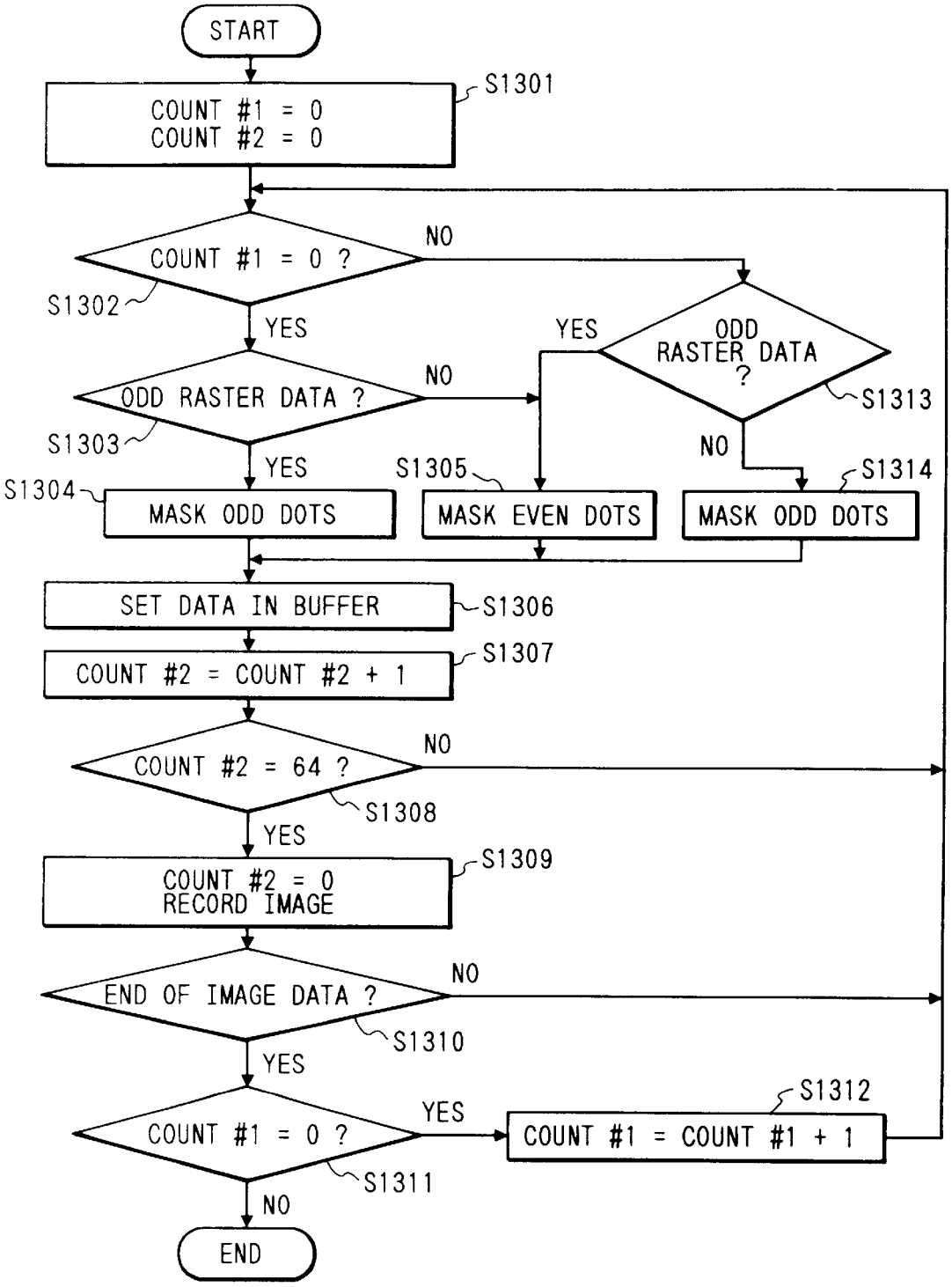
FIG. 67 is a flow chart showing image formation control according to the 30th embodiment of the present invention.

FIG. 67 shows image formation control of this embodiment. In step S1301, "0" is set in counters #1 and #2. In step S1302, it is checked if the content of the counter #1 is 0. If YES in step S1302, i.e., if recording on the first surface (first recording process) is determined, the flow advances to step S1303 to check if a recording image signal is odd raster data. If YES in step S1303, odd dots are masked by a control circuit in step S1304, and recording data is set in a recording buffer memory in step S1306. On the other hand, if NO in step S1303, even dots are masked by the control circuit in step S1305, and recording data is set in the recording buffer memory in step S1306. Thus, mask processing of data for one raster is completed.

In step S1307, the count value of the counter #2 is incremented by 1 to indicate the next raster. If it is determined in step S1308 that the counter #2 has a predetermined count value (in this case, 64 rasters=1 line), recording for one scan is performed, and the counter #2 is reset to 0 in step S1309. Thereafter, the flow returns to step S1302. If the end of image data (i.e., the end of the first recording process) is determined step S1310, it is checked in step S1311 if the count value of the counter #1 is 0. If YES in step S1311, the count value of the counter #1 is incremented by 1 in step S1312, and the flow returns to step S1302 to execute the next recording process. Thus, the recording operation on the first surface is ended, and a recording medium is discharged. The discharged recording medium is inserted again in the recording apparatus, and is subjected to recording on its second surface.

Since the count value of the counter #1 then becomes 1, the recording on the second surface (second recording process) is determined, and the flow advances to step S1313. The flow advances to step S1305 or S1314 depending on an odd or even raster determined in step S1313. In step S1305 or S1314, predetermined dots are masked by the control circuit, i.e., dots at positions opposite to that those on the first surface (first recording process) are masked. Thereafter, the flow advances to step S1306. In this embodiment, even dots are masked in common step S1305, and odd dots are masked in independent steps S1304 and S1314. Alternatively, these command and independent steps may be replaced. Furthermore, both the types of dots may be processed in common or independent steps.

Steps S1302 to S1310 are repeated until the end of image data (the end of the second recording process).

Under the above-mentioned control, a thin-out image is recorded in the first recording process, and an image is recorded in the second recording process to compensate for the thin-out image recorded in the first recording process.

Figure 68A:
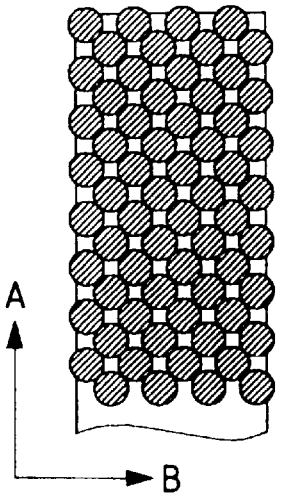
FIGS. 68A to 68C are views showing image recording processes in the 30th embodiment.
Figure 68B:
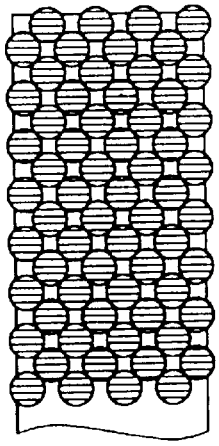
Figure 68C:
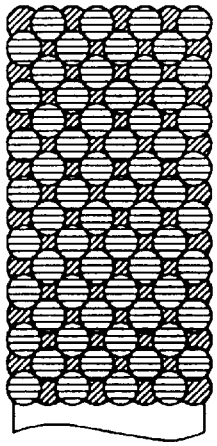

FIGS. 68A to 68C show images formed according to this embodiment. In FIGS. 68A to 68C, the convey direction of a recording medium is denoted by reference symbol A, and the scanning direction of a recording head is denoted by reference symbol B.

FIG. 68A shows an image recorded using a black (Bk) recording head in the first recording process, and FIG. 68B shows an image recorded using a recording head, different from that in the first recording process, in the second recording process. FIG. 68C shows an image obtained by re-recording the image, recorded in the first recording process, in the second recording process, and shows a state wherein an image is completed by the two recording processes.

In a serial scan type recording apparatus having a recording head, which has a plurality of ejection orifices and can perform high-density recording, the ink ejection orifices suffer from variations in ink ejection amount and landing precision, and image quality is deteriorated by a white or black stripe or periodic image density nonuniformity. However, when an image is recorded using different recording heads, the periodicity of the above-mentioned image deterioration factors can be canceled, and image quality can be effectively improved.

Furthermore, in this control, since an image is recorded in the second recording process to compensate for a thin-out image recorded in the first recording process after the thin-out image in the first recording process is sufficiently fixed and stabilized, blurring between adjacent dots can be minimized even on normal high-quality paper having poor ink absorbency, thus improving resolution.

In this embodiment, a host computer connected to a recording apparatus, dip switches, operation keys on an operation panel, a memory means provided to the recording apparatus, or the like may be used as designation information generation means, and the above-mentioned image formation control condition may be varied according to designation information (e.g., the order of recording processes, the number of image recording colors, image recording colors, and the like). For example, when black (Bk), cyan (C), magenta (M), and yellow (Y) are used as recording colors, image recording colors are used as designation information, recording for yellow (Y), which is less visually influenced by the ejection characteristics of the ink, and suffers from small image deterioration, is performed under the normal image formation control, and images of the remaining three colors, whose image quality is largely influenced by the ejection characteristics of the inks, are formed under the image formation control of the above embodiment, thereby obtaining a good image.

In a recording apparatus and method used in the present invention, as a previously recorded image is sufficiently fixed and dried and is stable, quality of an image recorded later can be improved. For this reason, even when an apparatus which has a high recording speed under the normal image formation control is used, since a plurality of recording colors are used, and a plurality of recording processes are to be executed, this embodiment provides a control means which is also effective for a case wherein a previously recorded image is preferably discharged in a sufficiently fixed/dried state. Therefore, whether or not recording processes using a plurality of colors are required may be determined using the order of recording processes and the number of image recording colors as the designation information so as to perform the control.

31ST EMBODIMENT

Figure 69A:
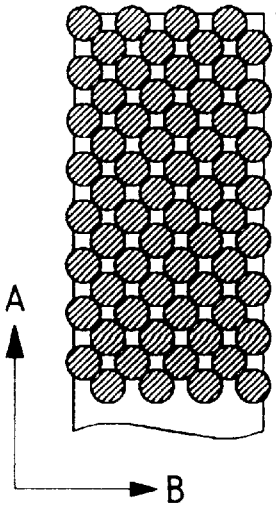
FIGS. 69A to 69C are views showing image recording processes according to the 31st embodiment of the present invention.
Figure 69B:
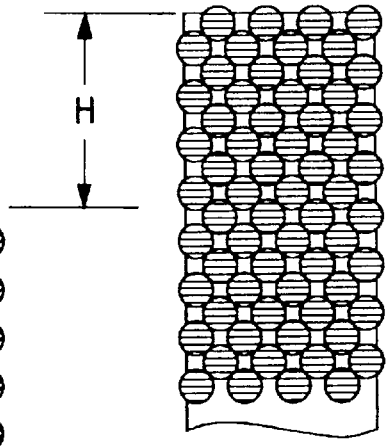
Figure 69C:
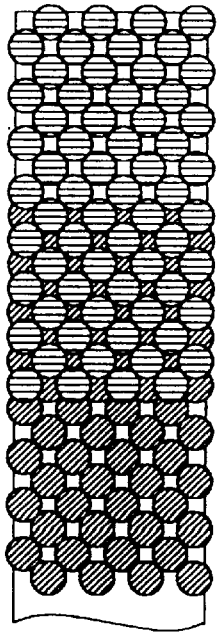

FIGS. 69A to 69C show images formed according to this embodiment. In FIGS. 69A to 69C, the convey direction of a recording medium is denoted by reference symbol A, and the scanning direction of a recording head is denoted by reference symbol B. In this embodiment, the mask patterns described above with reference to FIGS. 27A and 27B are used.

FIG. 69A shows an image (checker thin-out image) obtained by recording, using a black (Bk) recording head, recording data masked according to the mask pattern shown in FIG. 27A in the first recording process, and FIG. 69B shows an image (reverse checker thin-out image) obtained by recording, using the black (Bk) recording head, recording data masked according to the mask pattern shown in FIG. 27B in the second recording process while shifting the recording scan banding position by a width H from the first recording process. The width H preferably forms a difference of at least one dot. FIG. 69C shows an image obtained by re-recording the image, recorded in the first recording process, in the second recording process, and shows a state wherein an image is completed by the two recording processes. Since the recording scan banding position is shifted by H in the second recording process, recording data must also be shifted by H to have the same image recording position as in the first recording process.

Under the above-mentioned control, a thin-out image is recorded in the first recording process, and an image is recorded in the second recording process to compensate for the thin-out image recorded in the first recording process. The width H corresponds to ½ nozzles (eight nozzles in this embodiment) of an ink ejection orifice array (a total of 16 nozzles in this embodiment). In a portion wherein a thin-out image is recorded by the upper ½ ejection orifice array in the first recording process, an image is formed by the lower ½ ejection orifice array in the second recording process to compensate for the thin-out image. In a portion wherein a thin-out image is recorded by the lower ½ ejection orifice array in the first recording process, an image is formed by the upper ½ ejection orifice array in the second recording process to compensate for the thin-out image.

The mask patterns are not limited to those shown in FIGS. 27A and 27B, and any other patterns may be used as long as they can thin out image data to almost ½.

In a serial scan type recording apparatus having a recording head, which has a plurality of ejection orifices and can perform high-density recording, the ink ejection orifices suffer from variations in ink ejection amount and landing precision, and image quality is deteriorated by a white or black stripe or periodic image density nonuniformity. However, when the first and second recording processes have different recording scan banding positions, i.e., when an image in a single line is recorded using different ink ejection orifices, the periodicity of the above-mentioned image deterioration factors can be canceled, and image quality can be effectively improved. Furthermore, nonuniformity and stripes formed at boundary portions between adjacent recording scan lines can be effectively eliminated.

Furthermore, in this control, since an image is recorded in the second recording process to compensate for a thin-out image recorded in the first recording process after the thin-out image in the first recording process is sufficiently fixed and stabilized, blurring between adjacent dots can be minimized even on normal high-quality paper having poor ink absorbency, thus improving resolution.

This embodiment is a control means effective for recording not only a color image but also a monochrome gray-scale image like in the above embodiment, and can perform control even in a recording apparatus whose recording head cannot be attached/detached, thus obtaining the same effect.

In this embodiment, when an image is recorded using four different recording heads, i.e., red (R), green (G), blue (B), and black (Bk) heads, a red (R) checker thin-out image is recorded in the first recording process, and a red (R) reverse checker thin-out image is recorded in the second recording process. A green (G) checker thin-out image is recorded in the third recording process, and a green (G) reverse checker thin-out image is recorded in the fourth recording process. A blue (B) checker thin-out image is recorded in the fifth recording process, and a blue (B) reverse checker thin-out image is recorded in the sixth recording process. A black (Bk) checker thin-out image is recorded in the seventh recording process, and a black (Bk) reverse checker thin-out image is recorded in the eighth recording process. The recording scan banding position may be varied between a checker thin-out image and a reverse checker thin-out image. It is more preferable to set different recording scan banding positions in all the first to eighth recording processes.

In the first to eighth recording processes, checker and reverse checker thin-out images are alternately recorded. However, checker thin-out control may be performed in the first to fourth recording processes to record red (R), green (G), blue (B), and black (Bk) images, and thereafter, reverse checker thin-out control may be performed in the fifth to eighth recording processes to record red (R), green (G), blue (B), and black (Bk) images.

In this embodiment, a host computer connected to a recording apparatus, dip switches, operation keys on an operation panel, a memory means provided to the recording apparatus, or the like may be used as designation information generation means, and the above-mentioned image formation control condition may be varied according to designation information (e.g., the order of recording processes, the number of image recording colors, image recording colors, and the like) like in the above embodiment. For example, when black (Bk), cyan (C), magenta (M), and yellow (Y) are used as recording colors, image recording colors are used as designation information, recording for yellow (Y), which is less visually influenced by the ejection characteristics of the ink, and suffers from small image deterioration, is performed under the normal image formation control, and images of the remaining three colors, whose image quality is largely influenced by the ejection characteristics of the inks, are formed under the image formation control of the above embodiment, thereby obtaining a good image.

The image formation control method of the present invention can be applied to not only a case wherein a recording head for ejecting a monochrome ink, but also to a recording apparatus using a recording head capable of ejecting a plurality of color inks, and a recording apparatus, which mounts a plurality of recording heads for ejecting different color inks.

The present invention brings about excellent effects particularly in a recording head and a recording device of the ink jet system using a thermal energy among the ink jet recording systems.

As to its representative construction and principle, for example, one practiced by use of the basic principle disclosed in, for instance, U.S. Pat. Nos. 4,723,129 and 4,740,796 is preferred. The above system is applicable to either one of the so-called on-demand type and the continuous type. Particularly, the case of the on-demand type is effective because, by applying at least one driving signal which gives rapid temperature elevation exceeding nucleate boiling corresponding to the recording information on electrothermal converting elements arranged in a range corresponding to the sheet or liquid channels holding liquid (ink), a heat energy is generated by the electrothermal converting elements to effect film boiling on the heat acting surface of the recording head, and consequently the bubbles within the liquid (ink) can be formed in correspondence to the driving signals one by one. By discharging the liquid (ink) through a discharge port by growth and shrinkage of the bubble, at least one droplet is formed. By making the driving signals into pulse shapes, growth and shrinkage of the bubble can be effected instantly and adequately to accomplish more preferable discharging of the liquid (ink) particularly excellent in accordance with characteristics. As the driving signals of such pulse shapes, the signals as disclosed in U.S. Pat. Nos. 4,463,359 and 4,345,262 are suitable. Further excellent recording can be performed by using the conditions described in U.S. Pat. No. 4,313,124 of the invention concerning the temperature elevation rate of the above-mentioned heat acting surface.

As a construction of the recording head, in addition to the combined construction of a discharging orifice, a liquid channel, and an electrothermal converting element (linear liquid channel or right angle liquid channel) as disclosed in the above specifications, the construction by use of U.S. Pat. Nos. 4,558,333 and 4,459,600 disc losing the construction having the heat acting portion arranged in the flexed region is also included in the invention. The present invention can be also effectively constructed as disclosed in Japanese Laid-Open Patent Application No. 59-123670 which discloses the construction using a slit common to a plurality of electrothermal converting elements as a discharging portion of the electrothermal converting element or Japanese Laid-Open Patent Application No. 59-138461 which discloses the construction having the opening for absorbing a pressure wave of a heat energy corresponding to the discharging portion.

Further, as a recording head of the full line type having a length corresponding to the maximum width of a recording medium which can be recorded by the recording device, either the construction which satisfies its length by a combination of a plurality of recording heads as disclosed in the above specifications or the construction as a single recording head which has integratedly been formed can be used. The present invention can exhibit the effects as described above more effectively.

In addition, the invention is effective for a recording head of the freely exchangeable chip type which enables electrical connection to the main device or supply of ink from the main device by being mounted onto the main device, or for the case by use of a recording head of the cartridge type provided integratedly on the recording head itself.

It is also preferable to add a restoration means for the recording head, preliminary auxiliary means, and the like provided as a construction of the recording device of the invention because the effect of the invention can be further stabilized. Specific examples of them may include, for the recording head, capping means, cleaning means, pressurization or aspiration means, and electrothermal converting elements or another heating element or preliminary heating means according to a combination of them. It is also effective for performing a stable recording to realize the preliminary mode which executes the discharging separately from the recording.

As a recording mode of the recording device, further, the invention is extremely effective for not only the recording mode of only a primary color such as black or the like but also a device having at least one of a plurality of different colors or a full color by color mixing, depending on whether the recording head may be either integratedly constructed or combined in plural number.

To summarize, the present invention has as its basic principle to execute feed/discharge processes of a recording medium for each color in monochrome ink jet recording. This basic principle may be applied to an ink jet color recording apparatus to obtain a required color recording image, or may be applied to a recording medium having relatively poor fixing characteristics, or whether or not the method of the present invention is practiced may be selected according to a user's favor.

Monochrome ink jet recording apparatuses may be prepared in correspondence with colors, and the present invention may be practiced systematically. Such an application is also included in the present invention.

In an ink jet recording apparatus such as a full-line recording apparatus which can achieve high-speed recording, e.g., can record data corresponding to an A4 size within, e.g., one minute, a process including a stop or standby state for promoting fixing may be inserted between each two adjacent monochrome ink jet recording processes so as to achieve more stable recording. Normally, since a practical fixing assist time can be assured by a time required for exchanging recording heads or a transmission time of recording data, most of recording apparatuses do not require insertion of such a process.

What is claimed is:

1. A color recording method for forming a multi-color image on a single recording medium on the basis of recording information supplied from image supply means, using a monochrome recording apparatus, which comprises a mounting portion for selectively and detachably mounting one of a plurality of recording means for performing recording on the recording medium with monochrome ink corresponding to the recording means mounted in the mounting portion, feed means for feeding the recording medium to a recording region of said recording means, and discharge means for discharging the recording medium from the recording region, said method comprising:

a first step of supplying first recording information to first recording means, attached to said mounting portion, for ejecting a first ink, which is a yellow (Y) ink, performing recording using the first ink on the recording medium fed to the recording region by said feed means, and discharging the recording medium by said discharge means, the first recording information being information of a first one of three frames which one screen of an image is divided into;

a second step of supplying second recording information to second recording means, attached to said mounting portion in place of said first recording means, for ejecting a second ink, which is a magenta (M) ink, feeding the recording medium, on which recording using the first ink has been completed, to the recording region by said feed means, performing recording using the second ink, and discharging the recording medium by said discharge means, the second recording information being information of a second one of the three frames; and a third step of supplying third recording information to third recording means, attached to said mounting portion in place of said second recording means, for ejecting a third ink, which is a cyan (C) ink, feeding the recording medium, on which recording using the first and second inks has been completed, to the recording region by said feed means, performing recording using the third ink, and discharging the recording medium by said discharge means, the third recording information being information of a third one of the three frames, wherein said first, second and third steps are executed when the image to be recorded is present and the first, second and third steps are executed in this order.

2. A method according to claim 1, wherein said feed means comprises constant registration setting means for setting a constant leading edge registration position of the recording medium by utilizing stiffness of the recording medium, and the recording medium is fed to the recording region by said constant registration setting means.

3. A method according to claim 1, wherein each of said first, second, and third ink recording means comprises a unit integrally comprising an ink tank storing a corresponding ink, and a recording head having a recording element for ejecting the ink.

4. A method according to claim 3, wherein each of said first, second, and third recording means comprises the same number of ejection portions, and said recording element comprises an electro-thermal converting element for causing film boiling in the ink.

5. A method according to claim 1, wherein the monochrome recording apparatus comprises a blade for cleaning an ink ejection portion of said recording means, and cleaning means for cleaning said blade.

6. A method according to claim 1, further comprising:

a first assist step, provided between the first and second steps, of assuring a fixing time of the first ink on the recording medium in the first step; and a second assist step, provided between the second and third steps, of assuring a fixing time of the second ink on the recording medium in the second step.

7. A method according to claim 6, wherein said recording apparatus has a relatively high recording speed.

8. A color recording method capable of forming a multi-color image on a single recording medium by exchanging recording means for ejecting different color inks using a recording apparatus, which comprises a mounting portion for selectively and detachably mounting recording means for performing recording on the recording medium with an ink corresponding to the recording means mounted in the mounting portion, feed and convey means for feeding and conveying the recording medium to a recording region of said recording means, and discharge means for discharging the recording medium from the recording region, said method comprising:

a step of supplying to said recording means recording information of a first one of N frames which one screen of an image is divided into, wherein N is an integer not less than 2;

a step of executing a first recording process for performing recording, using first recording means on the basis of said recording information of the first frame for recording a first ink, attached to said mounting portion, for ejecting the first ink, on a recording medium fed and conveyed to the recording region by said feed and convey means, and discharging the recording medium outside said apparatus by said discharge means; and a repetition step of sequentially executing second to N-th supplying and recording processes for performing recording, using second to N-th ink recording means on the basis of second recording information to N-th recording information of second to N-th frames for recording second to N-th inks, attached to said mounting portion, for ejecting the second to N-th inks, on the recording medium fed and conveyed to the recording region by said feed and convey means, and discharging the recording medium outside said apparatus by said discharge means, wherein a banding position between adjacent serial scans in each of the recording processes is varied according to designation information, and wherein each of said ink recording means performs recording by serial scan.

9. A method according to claim 8, wherein the designation information is one of designation command information from a host computer, dip switch information from a dip switch, panel information from an operation panel, memory information from memory means, and a designation signal from said recording means.

10. A method according to claim 8, wherein the designation information is an order of the first to N-th recording processes.

11. A method according to claim 8, wherein the designation information is an image recording color.

12. A method according to claim 8, wherein the designation information is the number of image recording colors.

13. A method according to claim 8, wherein in each of the recording processes, only designated image information is selectively processed.

14. A method according to claim 13, wherein the selective processing of the image information is binarization processing.

15. A method according to claim 13, wherein the selective processing of the image information is change processing of an image formation direction.

16. A method according to claim 13, wherein the selective processing of the image information is change processing of an image recording order.

17. A method according to claim 8, wherein the designation information is identification information according to a type of recording medium used in recording in each of the recording processes.

18. A method according to claim 17, wherein the identification information is one of designation command information from a host computer, dip switch information from a dip switch, panel information from an operation panel, and detection information from a recording medium detector.

19. A method according to 8, wherein said ink recording means comprises a unit integrally comprising an ink tank storing the ink, and a recording head having ink ejection orifices having recording elements for ejecting the ink.

20. A method according to claim 19, wherein said recording head comprises heat energy generation means for causing a change in state by heat in the ink, and forming a flying ink droplet by ejecting the ink based on the change in state.

21. A method according to claim 8, wherein recording is performed using thin-out recording information in each of the first to N-th recording processes, and is performed to compensate for the thin-out portions in the first to N-th recording processes.

22. A method according to claim 21, wherein recording operations in the first to N-th recording processes are respectively performed using first to N-th recording means for respectively ejecting first to N-th inks.

23. A method according to claim 21, wherein said recording means comprises a unit integrally comprising an ink tank storing the ink, and a recording head having ink ejection orifices having recording elements for ejecting the ink.

24. A method according to claim 23, wherein said recording head comprises heat energy generation means for causing a change in state by heat in the ink, and forming a flying ink droplet by ejecting the ink based on the change in state.

25. A color recording method capable of forming a multi-color image on a single recording medium by exchanging recording means for ejecting different color inks using a recording apparatus, which comprises a mounting portion for selectively and detachably mounting recording means for performing recording on the recording medium with an ink corresponding to the recording means mounted in the mounting portion, feed and convey means for feeding and conveying the recording medium to a recording region of said recording means, and discharge means for discharging the recording medium from the recording region, said method comprising:

a step of supplying to said recording means recording information of a first one of N frames which one screen of an image is divided into, wherein N is an integer not less than 2;

a step of executing a first recording process for performing recording, using first recording means on the basis of said recording information of the first frame for recording a first ink, attached to said mounting portion, for ejecting the first ink, on a recording medium fed and conveyed to the recording region by said feed and convey means, and discharging the recording medium outside said apparatus by said discharge means; and a repetition step of sequentially executing second to N-th supplying and recording processes for performing recording, using second to N-th ink recording means on the basis of second recording information to N-th recording information of second to N-th frames for recording second to N-th inks, attached to said mounting portion, for ejecting the second to N-th inks, on the recording medium fed and conveyed to the recording region by said feed and convey means, and discharging the recording medium outside said apparatus by said discharge means, wherein a recording condition of each of the recording processes is varied according to designation information wherein each of said ink recording means performs recording by serial scans, and wherein the recording condition is a recording width per serial scan.

26. A method according to claim 25, wherein the recording width per serial scan is small in the first recording process, and is increased toward the N-th recording process.

27. A color recording method capable of forming a multi-color image on a single recording medium by exchanging recording means for ejecting different color inks using a recording apparatus, which comprises a mounting portion for selectively and detachably mounting recording means for performing recording on the recording medium with an ink corresponding to the recording means mounted in the mounting portion, feed and convey means for feeding and conveying the recording medium to a recording region of said recording means, and discharge means for discharging the recording medium from the recording region, said method comprising:

a step of supplying to said recording means recording information of a first one of N frames which one screen of an image is divided into, wherein N is an integer not less than 2;

a step of executing a first recording process for performing recording, using first recording means on the basis of said recording information of the first frame for recording a first ink, attached to said mounting portion, for ejecting the first ink, on a recording medium fed and conveyed to the recording region by said feed and convey means, and discharging the recording medium outside said apparatus by said discharge means; and a repetition step of sequentially executing second to N-th supplying and recording processes for performing recording, using second to N-th ink recording means on the basis of second recording information to N-th recording information of second to N-th frames for recording second to N-th inks, attached to said mounting portion, for ejecting the second to N-th inks, on the recording medium fed and conveyed to the recording region by said feed and convey means, and discharging the recording medium outside said apparatus by said discharge means, wherein a number of times of serial scans of each of the recording processes is varied according to designation information and each of said ink recording means performs recording by serial scans.

28. A color recording method capable of forming a multi-color image on a single recording medium by exchanging recording means for ejecting different color inks using a recording apparatus, which comprises a mounting portion for selectively and detachably mounting recording means for performing recording on the recording medium with an ink corresponding to the recording means mounted in the mounting portion, feed and convey means for feeding and conveying the recording medium to a recording region of said recording means, and discharge means for discharging the recording medium from the recording region, said method comprising:

a step of supplying to said recording means recording information of a first one of N frames which one screen of an image is divided into, wherein N is an integer not less than 2;

a step of executing a first recording process for performing recording, using first recording means on the basis of said recording information of the first frame for recording a first ink, attached to said mounting portion, for ejecting the first ink, on a recording medium fed and conveyed to the recording region by said feed and convey means, and discharging the recording medium outside said apparatus by said discharge means; and a repetition step of sequentially executing second to N-th supplying and recording processes for performing recording, using second to N-th ink recording means on the basis of second recording information to N-th recording information of second to N-th frames for recording second to N-th inks, attached to said mounting portion, for ejecting the second to N-th inks, on the recording medium fed and conveyed to the recording region by said feed and convey means, and discharging the recording medium outside said apparatus by said discharge means, wherein a time interval between adjacent serial scans of each of the recording processes is varied according to designation information and each of said recording means performs recording by serial scans.

29. A color recording method capable of forming a multi-color image on a single recording medium by exchanging recording means for ejecting different color inks using a recording apparatus, which comprises a mounting portion for selectively and detachably mounting recording means for performing recording on the recording medium with an ink corresponding to the recording means mounted in the mounting portion, feed and convey means for feeding and conveying the recording medium to a recording region of said recording means, and discharge means for discharging the recording medium from the recording region, said method comprising:

a step of supplying to said recording means recording information of a first one of N frames which one screen of an image is divided into, wherein N is an integer not less than 2;

a step of executing a first recording process for performnning recording, using first recording means on the basis of said recording information of the first frame for recording a first ink, attached to said mounting portion, for ejecting the first ink, on a recording medium fed and conveyed to the recording region by said feed and convey means, and discharging the recording medium outside said apparatus by said discharge means; and a repetition step of sequentially executing second to N-th supplying and recording processes for performing recording, using second to N-th ink recording means on the basis of second recording information to N-th recording information of second to N-th frames for recording second to N-th inks, attached to said mounting portion, for ejecting the second to N-th inks, on the recording medium fed and conveyed to the recording region by said feed and convey means, and discharging the recording medium outside said apparatus by said discharge means, wherein a thin-out pattern for the recording information of each of the recording processes is varied according to designation information and wherein each of said ink recording means performs recording by serial scans.

30. A method according to claim 29, wherein each of said recording means performs recording to compensate for the recording information thinned out by a plurality of serial scans.

31. A method according to claim 30, wherein each of said recording means performs recording using different ink ejection orifices in the plurality of serial scans.

32. A color recording method capable of forming a multi-color image on a single recording medium by exchanging recording means for electing different color inks using a recording apparatus, which comprises a mounting portion for selectively and detachably mounting recording means for performing recording on the recording medium with an ink corresponding to the recording means mounted in the mounting portion, feed and convey means for feeding and conveying the recording medium to a recording region of said recording means, and discharge means for discharging the recording medium from the recording region, said method comprising:

a step of supplying to said recording means recording information of a first one of N frames which one screen of an image is divided into, wherein N is an integer not less than 2;

a step of executing a first recording process for performing recording, using first recording means on the basis of said recording information of the first frame for recording a first ink, attached to said mounting portion, for ejecting the first ink, on a recording medium fed and conveyed to the recording region by said feed and convey means, and discharging the recording medium outside said apparatus by said discharge means; and a repetition step of sequentially executing second to N-th supplying and recording processes for performing recording, using second to N-th ink recording means on the basis of second recording information to N-th recording information of second to N-th frames for recording second to N-th inks, attached to said mounting portion, for ejecting the second to N-th inks, on the recording medium fed and conveyed to the recording region by said feed and convey means, and discharging the recording medium outside said apparatus by said discharge means, wherein a recording condition of each of the recording processes is varied according to designation information, and wherein the first to N-th recording processes are executed, so that recording is performed in an order beginning with the recording information of a color having a high dot density.

33. A color recording method capable of forming a multi-color image on a single recording medium by exchanging recording means for ejecting different color inks using a recording apparatus, which comprises a mounting portion for selectively and detachably mounting recording means for performing recording on the recording medium with an ink corresponding to the recording means mounted in the mounting portion, feed and convey means for feeding and conveying the recording medium to a recording region of said recording means, and discharge means for discharging the recording medium from the recording region, said method comprising:

a step of supplying to said recording means recording information of a first one of N frames which one screen of an image is divided into, wherein N is an integer not less than 2;

a step of executing a first recording process for performing recording, using first recording means on the basis of said recording information of the first frame for recording a first ink, attached to said mounting portion, for ejecting the first ink, on a recording medium fed and conveyed to the recording region by said feed and convey means, and discharging the recording medium outside said apparatus by said discharge means; and a repetition step of sequentially executing second to N-th supplying and recording processes for performing recording, using second to N-th ink recording means on the basis of second recording information to N-th recording information of second to N-th frames for recording second to N-th inks, attached to said mounting portion, for ejecting the second to N-th inks, on the recording medium fed and conveyed to the recording region by said feed and convey means, and discharging the recording medium outside said apparatus by said discharge means, wherein a recording condition of each of the recording processes is varied according to designation information, and wherein the first to N-th recording processes are executed, so that recording is performed in an order beginning with an ink color having a high brightness.

34. An ink jet recording method capable of forming an image on a recording medium using an ink jet recording apparatus, which comprises ink recording means for performing recording on the recording medium by ejecting an ink, and feed and convey means for feeding and conveying the recording medium to a recording region of said ink recording means, said method comprising:

a step of supplying to said ink recording means recording information of a first one of N frames which one screen of an image is divided into, wherein N is an integer not less than 2;

a step of conveying the recording medium set at a predetermined reference position toward the ink recording means;

a step of executing a first recording process for performing recording on the recording medium fed and conveyed to the recording region by said feed and convey means using said ink recording means on the basis of said recording information of the first frame; and a repetition step of frame-sequentially executing recording operations of second to N-th supplying and recording processes on the recording medium using said ink recording means, wherein said ink recording means performs recording by serial scans and a recording condition of each of the recording processes is varied; and wherein the recording condition is a recording width per serial scan.

35. An ink let recording method capable of forming an image on a recording medium using an ink jet recording apparatus, which comprises ink recording means for performing recording on the recording medium by ejecting an ink, and feed and convey means for feeding and conveying the recording medium to a recording region of said ink recording means, said method comprising:

a step of supplying to said ink recording means recording information of a first one of N frames which one screen of an image is divided into, wherein N is an integer not less than 2;

a step of conveying the recording medium set at a predetermined reference position toward the ink recording means;

a step of executing a first recording process for performing recording on the recording medium fed and conveyed to the recording region by said feed and convey means using said ink recording means on the basis of said recording information of the first frame; and a repetition step of frame-sequentially executing recording operations of second to N-th supplying and recording processes on the recording medium using said ink recording means, wherein the first to N-th recording processes are executed, so that recording is performed in an order from the recording information of a color having a high dot density.

36. An ink jet recording method capable of forming an image on a recording medium using an ink jet recording apparatus, which comprises ink recording means for performing recording on the recording medium by ejecting an ink, and feed and convey means for feeding and conveying the recording medium to a recording region of said ink recording means, said method comprising:

a step of supplying to said ink recording means recording information of a first one of N frames which one screen of an image is divided into, wherein N is an integer not less than 2;

a step of conveying the recording medium set at a predetermined reference position toward the ink recording means;

a step of executing a first recording process for performing recording on the recording medium fed and conveyed to the recording region by said feed and convey means using said ink recording means on the basis of said recording information of the first frame; and a repetition step of frame-sequentially executing recording operations of second to N-th supplying and recording processes on the recording medium using said ink recording means, wherein the first to N-th recording processes are executed, so that recording is performed in an order beginning with an ink color having a high brightness.

37. A color recording method capable of forming a multi-color image on a single recording medium by exchanging recording means for electing different color inks using a recording apparatus, which comprises a mounting portion for selectively and detachably mounting recording means for performing recording on the recording medium with an ink corresponding to the recording means mounted in the mounting portion, feed and convey means for feeding and conveying the recording medium to a recording region of said recording means, and discharge means for discharging the recording medium from the recording region, said method comprising:

a step of supplying to said recording means recording information of a first one of N frames which one screen of an image is divided into, wherein N is an integer not less than 2;

a step of executing a first recording process for performing recording, using first recording means on the basis of said recording information of the first frame for recording a first ink, attached to said mounting portion, for electing the first ink, on a recording medium fed and conveyed to the recording region by said feed and convey means, and discharging the recording medium outside said apparatus by said discharge means; and a repetition step of sequentially executing second to N-th supplying and recording processes for performing recording, using second to N-th ink recording means on the basis of second recording information to N-th recording information of second to N-th frames for recording second to N-th inks, attached to said mounting portion, for electing the second to N-th inks, on the recording medium fed and conveyed to the recording region by said feed and convey means, and discharging the recording medium outside said apparatus by said discharge means, wherein a recording condition of each of the recording processes is varied according to designation information, wherein of characteristics of recording dots formed in the recording processes, at least one of an area, a density, a shape, and an intra-pixel position is varied between at least two recording processes.

38. A method according to claim 37, wherein recording ink colors in the two recording processes having the different recording dot characteristics are the same.

39. A method according to claim 37, wherein recording ink colors in the two recording processes having the different recording dot characteristics are different.

40. A driving device, which can be attached to a monochrome recording apparatus comprising a mounting portion for selectively and detachably mounting one of a plurality of recording means for performing recording on a recording medium with monochrome ink corresponding to the recording means mounted in the mounting portion, feed means for feeding the recording medium to a recording region of said recording means, and setting means for setting the recording medium at a predetermined position, the setting means having a restricting member for restricting a position of recording means from the plurality of recording means at a predetermined reference position;

discharge means for discharging the recording medium from the recording region, and which effects a color recording method for forming a multi-color image on a single recording medium, said device comprising:

means for converting N-value (N is a natural number not less than 3) image data of a required image into M-value (M is a natural number satisfying $N>M\geqq 3$) image data for recording;

means for supplying first recording information based on the M-value image data converted by said converting means, for recording on a first ink in a first process in which recording is performed, using first recording means which is attached to said mounting portion and ejects the first ink, on a recording medium fed to the recording region by said feed means, and the recording medium is discharged by said discharge means; and means for repeating at least once an operation for supplying second recording information based on the M-value image data converted by said converting means, for recording a second ink in a second process in which recording is performed, using second recording means which is attached to said mounting portion in place of said first recording means, and ejects the second ink, on the recording medium, on which recording using the first ink has been completed, and which is fed to the recording region by said feed means, and the recording medium is discharged by said discharge means.

41. A driving device according to claim 40, further comprising:

identifying means for identifying a type of a mounted one of the plurality of recording means mounted in said mounting portion; and discriminating means for discriminating whether the supplied recording information is appropriate for the mounted recording means, on the basis of a type of the recording means identified by said identifying means and the supplied recording information.

42. An ink jet recording method capable of forming an image on a recording medium using an ink let recording apparatus, which comprises ink recording means for performing recording on the recording medium by ejecting an ink, and feed and convey means for feeding and conveying the recording medium to a recording region of said ink recording means, said method comprising:

a step of supplying to said ink recording means recording information of a first one of N frames which one screen of an image is divided into, wherein N is an integer not less than 2;

a step of conveying the recording medium set at a predetermined reference position toward the ink recording means;

a step of executing a first recording process for performing recording on the recording medium fed and conveyed to the recording region by said feed and convey means using said ink recording means on the basis of said recording information of the first frame; and a repetition step of frame-sequentially executing recording operations of second to N-th supplying and recording processes on the recording medium using said ink recording means, wherein recording is performed using thin-out recording information in each of the first to N-th recording processes, and is performed to compensate for the thin-out portions in the first to N-th recording processes.

43. A method according to claim 42, wherein a scan banding position between adjacent image recording scans is changed in each of the first to N-th recording processes.

44. A recording method for recording a multi-color image on a recording medium based on recording information, using a plurality of recording means respectively corresponding to a plurality of colors, in an apparatus which comprises a carriage for mounting one of the plurality of recording means thereon, main scan means for relatively scanning the carriage in a main scan direction and sub-scan means for relatively sub-scanning the recording medium in a sub-scan direction substantially perpendicular to the main scan direction, said method comprising:

a setting step of setting the recording medium at a recording position by said sub-scan means by restricting the recording medium at a predetermined reference position, and mounting one of the plurality of recording means on the carriage;

a recording step of supplying recording information according to a color corresponding to the recording means mounted on the carriage to perform recording on the recording medium; and a multi-color forming step of repeating said setting step and said recording step in accordance with other colors of the plurality of colors according to the recording information to form a multi-color image on the recording medium, wherein a first ink in a first recording step is a yellow (Y) ink, a second ink in a second recording step is a magenta (M) ink, and a third ink in a third recording step is a cyan (C) ink and the first, second and third steps are executed in this order.

45. A method according to claim 44, wherein in said setting step the recording means corresponding to the color to be recorded on the recording medium is selected in accordance with the recording information, and the selected recording means is mounted on the carriage.

46. A method according to claim 44, wherein said setting step and said recording step are repeated a number of times corresponding to a number of colors included in the recording information.

47. A method according to claim 44, wherein said setting step and said recording step are repeated in compliance with a number of colors corresponding to a number of the plurality of recording means.

48. A method according to claim 44, wherein in said multi-color forming step following recording relating to a predetermined color, said setting step and said recording step are repeated in a predetermined order of colors in accordance with the colors corresponding to the plurality of recording means.

49. A method according to claim 44, wherein in said setting step the recording medium is fed in a direction opposite to the sub-scan direction for recording without the discharge thereof so as to set the recording medium at the recording position.

* * * * *

UNITED STATES PATENT AND TRADEMARK OFFICE

CERTIFICATE OF CORRECTION

PATENT NO. : 6,053,595
DATED : April 25, 2000
INVENTOR(S) : Naoji Otsuka et al.

It is certified that error appears in the above-identified patent and that said Letters Patent is hereby corrected as shown below:

Sheet 15,
Fig. 18B, "DICRIMINATE" should read -- DISCRIMINATE --.

Column 3,
Line 51, "22" should read -- 22, --.

Column 11,
Line 4, "recording possible" should read -- possible recording --;
Line 10, "more" should read -- better --.

Column 25,
Line 3, "(overlying" should read -- (overlaying --.

Column 31,
Line 37, "strikethrough," should read -- strike-through, --;
Lines 38 and 41, "overlying" should read -- overlaying --.

Column 32,
Line 2, "overlying" should read -- overlaying --;
Line 10, "lying" should read -- laying --.

Column 33,
Line 16, "burring" should read -- blurring --;
Lines 28, 32, and 67, "overlying" should read -- overlaying --;

Column 34,
Line 39, "457" should read -- 45, --;
Line 64, "overlying" should read -- overlaying --.

Column 49,
Line 33, "convey" should read -- conveyance --;
Line 44, "depending" should read -- depends --;
Line 45, "according" should read -- according to --.

Column 51,
Lines 7 and 14, "convey" should read -- conveyance --.

Column 53,
Line 23, "that those" should read -- that of those --.

UNITED STATES PATENT AND TRADEMARK OFFICE

CERTIFICATE OF CORRECTION

PATENT NO. : 6,053,595
DATED : April 25, 2000
INVENTOR(S) : Naoji Otsuka et al.

It is certified that error appears in the above-identified patent and that said Letters Patent is hereby corrected as shown below:

Column 56,
Line 65, "disc losing" should read -- disclosing --.

Column 64,
Line 44, "let" should read -- jet --.

Column 65,
Line 32, "electing" should read -- ejecting --;
Line 61, "electing" should read -- ejecting --.

Column 66,
Line 62, "let" should read -- jet --.

Signed and Sealed this

Twenty-fifth Day of December, 2001

*Attest:*

*Attesting Officer*

JAMES E. ROGAN
*Director of the United States Patent and Trademark Office*